US010045894B2

(12) United States Patent
Magill et al.

(10) Patent No.: US 10,045,894 B2
(45) Date of Patent: Aug. 14, 2018

(54) SELF-ACTUATING COTS

(71) Applicant: FERNO-WASHINGTON, INC., Wilmington, OH (US)

(72) Inventors: Brian Magill, Morrow, OH (US); Robert Potak, Strongville, OH (US); Sailesh Tangirala, South Lebanon, OH (US); Nicholas Valentino, Springboro, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 0 days.

(21) Appl. No.: 15/036,983

(22) PCT Filed: Nov. 14, 2014

(86) PCT No.: PCT/US2014/065649

§ 371 (c)(1),
(2) Date: May 16, 2016

(87) PCT Pub. No.: WO2015/073792

PCT Pub. Date: May 21, 2015

(65) Prior Publication Data

US 2016/0287454 A1 Oct. 6, 2016

Related U.S. Application Data

(60) Provisional application No. 61/904,694, filed on Nov. 15, 2013, provisional application No. 61/904,805, filed on Nov. 15, 2013.

(51) Int. Cl.
*A61G 1/056* (2006.01)
*A61G 1/02* (2006.01)

(52) U.S. Cl.
CPC ..... *A61G 1/0567* (2013.01); *A61G 1/0212* (2013.01); *A61G 1/0237* (2013.01);
(Continued)

(58) Field of Classification Search
CPC .. A61G 1/0567; A61G 1/0562; A61G 1/0212; A61G 1/0237; A61G 1/0262; A61G 1/0256; A61G 2200/16
(Continued)

(56) References Cited

U.S. PATENT DOCUMENTS 2,203,204 A 6/1940 Nicolai
2,204,205 A 6/1940 Bell
(Continued)

FOREIGN PATENT DOCUMENTS

AU 353436 S 8/2014
AU 354706 S 8/2014
(Continued)

OTHER PUBLICATIONS

Google search: "timing belt purpose of idler pulley", Dec. 8, 2016 (2 pages) https://www.google.com/?gws_rd=ssl#q=timing+belt+purpose+of+idler+pulley.
(Continued)

*Primary Examiner* — Joseph D. Pape
*Assistant Examiner* — Dana D Ivey
(74) *Attorney, Agent, or Firm* — Dinsmore & Shohl LLP

(57) ABSTRACT

According to the embodiments described herein, a self-actuating cot can include a support frame, a pair of legs, and a hydraulic actuator. The support frame can extend from a front end to a back end. The pair of legs can be in movable engagement with the support frame. The hydraulic actuator can be in movable engagement with the pair of legs and the support frame. The hydraulic actuator can and extend and retract the pair of legs with respect to the support frame.

20 Claims, 33 Drawing Sheets

(52) U.S. Cl.
CPC ..... *A61G 1/0262* (2013.01); *A61G 1/0562* (2013.01); *A61G 1/0256* (2013.01); *A61G 2200/16* (2013.01)

(58) Field of Classification Search
USPC ..... 296/20
See application file for complete search history.

(56) References Cited

U.S. PATENT DOCUMENTS

| | | | |
|---|---|---|---|
| 2,278,749 | A | 4/1942 | Todd |
| 2,642,250 | A | 6/1953 | Kasnowich |
| 3,397,912 | A | 8/1968 | Bush |
| 3,544,163 | A | 12/1970 | Krein |
| 3,612,606 | A | 10/1971 | Swenson |
| 3,631,546 | A | 1/1972 | Eliasson |
| 3,880,770 | A | 4/1975 | Chenot et al. |
| 3,951,452 | A | 4/1976 | Harder |
| 4,037,871 | A | 7/1977 | Bourgraf et al. |
| 4,073,538 | A | 2/1978 | Hunter |
| 4,155,588 | A | 5/1979 | Danziger et al. |
| 4,186,905 | A | 2/1980 | Brudy |
| 4,225,183 | A | 9/1980 | Hanagan et al. |
| 4,270,798 | A | 6/1981 | Harder |
| 4,466,664 | A | 8/1984 | Kondou |
| D289,992 | S | 5/1987 | Schrager |
| 4,682,810 | A | 7/1987 | Zarka |
| 4,745,647 | A | 5/1988 | Goodwin |
| 4,761,841 | A | 8/1988 | Larsen |
| 4,767,148 | A | 8/1988 | Ferneau et al. |
| 4,829,633 | A | 5/1989 | Kassner et al. |
| 4,921,295 | A | 5/1990 | Stollenwerk |
| 5,015,024 | A | 5/1991 | Bloemer |
| 5,023,968 | A | 6/1991 | Diehl et al. |
| 5,039,118 | A | 8/1991 | Huang |
| 5,056,805 | A | 10/1991 | Wang |
| 5,062,179 | A | 11/1991 | Huang |
| 5,069,465 | A | 12/1991 | Stryker et al. |
| 5,084,922 | A | 2/1992 | Louit |
| 5,088,136 | A | 2/1992 | Stryker et al. |
| 5,168,601 | A | 12/1992 | Liu |
| 5,265,969 | A | 11/1993 | Chuang |
| 5,431,087 | A | 7/1995 | Kambara |
| 5,509,159 | A | 4/1996 | Du |
| 5,537,700 | A | 7/1996 | Way et al. |
| 5,586,346 | A | 12/1996 | Stacy et al. |
| 5,630,428 | A | 5/1997 | Wallace |
| 5,720,057 | A | 2/1998 | Duncan |
| 5,774,914 | A | 7/1998 | Johnson et al. |
| 5,839,136 | A | 11/1998 | Vance et al. |
| 5,867,911 | A | 2/1999 | Yates et al. |
| 5,971,091 | A | 10/1999 | Kamen et al. |
| 5,996,954 | A | 12/1999 | Rosen et al. |
| 6,311,952 | B2 | 11/2001 | Bainter |
| D454,319 | S | 3/2002 | Ito |
| 6,389,623 | B1 | 5/2002 | Flynn et al. |
| 6,405,393 | B2 | 6/2002 | Megown |
| 6,503,018 | B2 | 1/2003 | Hou et al. |
| 6,550,801 | B1 | 4/2003 | Newhard |
| 6,565,111 | B2 | 5/2003 | Ageneau |
| 6,578,922 | B2 | 6/2003 | Khedira |
| 6,654,973 | B2 | 12/2003 | Van Den Heuvel et al. |
| 6,735,794 | B1 | 5/2004 | Way et al. |
| 6,752,462 | B1 | 6/2004 | Kain et al. |
| 6,789,292 | B2 | 9/2004 | Oshima et al. |
| 6,948,197 | B1 | 9/2005 | Chen |
| 6,976,696 | B2 | 12/2005 | O'Krangley et al. |
| 7,003,829 | B2 | 2/2006 | Choi et al. |
| 7,013,510 | B1 | 3/2006 | Johnson |
| 7,273,256 | B2 | 9/2007 | Santamaria |
| 7,278,338 | B2 | 10/2007 | Chen |
| 7,389,552 | B1 | 6/2008 | Reed et al. |
| 7,424,758 | B2 | 9/2008 | Broadley et al. |
| 7,426,970 | B2 | 9/2008 | Olsen |
| 7,568,766 | B2 | 8/2009 | Chen et al. |
| 7,617,569 | B2 | 11/2009 | Liao |
| 7,621,003 | B2 | 11/2009 | Myers et al. |
| D606,910 | S | 12/2009 | Malassigne et al. |
| 7,631,373 | B2 | 12/2009 | Broadley et al. |
| 7,631,575 | B2 | 12/2009 | Gard et al. |
| 7,637,550 | B2 | 12/2009 | Menna |
| 7,641,211 | B2 | 1/2010 | Ivanchenko |
| 7,841,611 | B2 | 11/2010 | Ivanchenko |
| 7,857,393 | B2 | 12/2010 | Cebula et al. |
| 7,941,881 | B2 | 5/2011 | Hayes et al. |
| 7,996,939 | B2 | 8/2011 | Benedict et al. |
| 8,051,513 | B2 * | 11/2011 | Reed ..... A61G 1/052 5/611 |
| 8,056,950 | B2 | 11/2011 | Souke et al. |
| 8,085,695 | B2 | 12/2011 | Kushalnagar et al. |
| 8,100,307 | B2 | 1/2012 | Chinn et al. |
| 8,155,918 | B2 | 4/2012 | Reed et al. |
| 8,240,410 | B2 | 8/2012 | Heimbrock et al. |
| 8,439,416 | B2 * | 5/2013 | Lambarth ..... A61G 1/02 296/20 |
| 8,459,679 | B2 | 6/2013 | Jessie, Jr. |
| RE44,884 | E | 5/2014 | Lambarth |
| 8,714,612 | B2 | 5/2014 | Chinn |
| 8,898,862 | B1 | 12/2014 | McGrath |
| 8,901,747 | B2 | 12/2014 | Miller et al. |
| D729,132 | S | 5/2015 | Valentino et al. |
| D729,702 | S | 5/2015 | Valentino |
| 9,021,634 | B2 | 5/2015 | Goto et al. |
| D742,794 | S | 11/2015 | Valentino et al. |
| D749,014 | S | 2/2016 | Valentino et al. |
| 9,248,062 | B2 | 2/2016 | Valentino et al. |
| D751,000 | S | 3/2016 | Dietz et al. |
| 9,456,938 | B2 | 10/2016 | Blickensderfer et al. |
| 2002/0056162 | A1 | 5/2002 | Flynn et al. |
| 2002/0174486 | A1 | 11/2002 | Heuvel et al. |
| 2003/0025378 | A1 | 2/2003 | Lin |
| 2003/0172459 | A1 | 9/2003 | Roussy |
| 2004/0088792 | A1 | 5/2004 | O'Kangley et al. |
| 2004/0111798 | A1 | 6/2004 | Matunaga et al. |
| 2005/0126835 | A1 | 6/2005 | Lenkman |
| 2005/0283911 | A1 | 12/2005 | Roussy |
| 2006/0017263 | A1 | 1/2006 | Chen et al. |
| 2006/0075558 | A1 | 4/2006 | Lambarth et al. |
| 2006/0082176 | A1 | 4/2006 | Broadley et al. |
| 2006/0096029 | A1 | 5/2006 | Osborne et al. |
| 2006/0225203 | A1 | 10/2006 | Hosoya et al. |
| 2006/0265807 | A1 | 11/2006 | Choy et al. |
| 2007/0163044 | A1 | 7/2007 | Arnold et al. |
| 2007/0163045 | A1 | 7/2007 | Becker et al. |
| 2007/0165044 | A1 | 7/2007 | Wells et al. |
| 2008/0128571 | A1 | 6/2008 | Dostaler et al. |
| 2008/0211248 | A1 | 9/2008 | Lambarth |
| 2009/0165208 | A1 | 7/2009 | Reed et al. |
| 2009/0172883 | A1 | 7/2009 | Benedict et al. |
| 2009/0222988 | A1 | 9/2009 | Reed et al. |
| 2009/0313758 | A1 | 12/2009 | Menkedick et al. |
| 2010/0306921 | A1 | 12/2010 | Kramer |
| 2011/0080016 | A1 | 4/2011 | Lambarth et al. |
| 2011/0087416 | A1 | 4/2011 | Patmore |
| 2011/0260417 | A1 | 10/2011 | Bitzer et al. |
| 2011/0265262 | A1 | 11/2011 | Di Lauro et al. |
| 2011/0266821 | A1 | 11/2011 | Goto et al. |
| 2011/0277773 | A1 | 11/2011 | Sullivan et al. |
| 2012/0275896 | A1 | 11/2012 | Magill et al. |
| 2013/0168987 | A1 | 7/2013 | Valentino et al. |
| 2014/0059768 | A1 | 3/2014 | Lemire et al. |
| 2014/0276269 | A1 | 9/2014 | Illindala |

FOREIGN PATENT DOCUMENTS

| | | | |
|---|---|---|---|
| CN | 102781392 | A | 11/2012 |
| DE | 29721734 | U1 | 3/1998 |
| EP | 1698314 | A1 | 9/2006 |
| EP | 2412355 | A1 | 2/2012 |
| FR | 2695553 | A1 | 3/1994 |
| GB | 2351439 | A | 1/2001 |
| JP | 02200262 | A | 8/1990 |
| JP | 2001197962 | A | 7/2001 |
| JP | 2002543927 | A | 12/2002 |
| JP | 2006208887 | A | 8/2006 |

(56) References Cited

FOREIGN PATENT DOCUMENTS

| | | | |
|---|---|---|---|
| NL | 8901747 | A | 2/1991 |
| WO | 0069386 | A2 | 11/2000 |
| WO | 2005049607 | A1 | 6/2005 |
| WO | 2007128744 | A2 | 11/2007 |
| WO | 2011088169 | A1 | 7/2011 |

OTHER PUBLICATIONS

Timing Belt Idler, Dec. 8, 2016, from Repair Pal (5 pages) http://repairpal.com/timing-belt-idler.
Tensioner from Wikipedia, Dec. 8, 2016 (4 pages). https://en.wikipedia.org/wiki/Tensioner.
"Timing Belt Tensioner", Automotive Care Wayback Machine—Internet Archive: archived from Dec. 29, 2014 http://web.archive.org/web/20141229221712/http://www.automotivecare.com/your-engine-101/belts-and-tensioners/.
Non-Final Office Action dated Jan. 31, 2017, pertaining to U.S. Appl. No. 14/770,126, 43 pages.
Australian Examination Report for Registration No. 353436 dated Jul. 30, 2015.
Australian Examination Report for Registration No. 354687 dated Oct. 2, 2014.
Canadian Examiner's Report pertaining to Design Patent Application 154348 dated May 13, 2014.
Canadian Examiner's Report pertaining to Design Patent Application 154349 dated May 13, 2014.
Canadian Examiner's Report pertaining to Design Patent Application 154350 dated May 13, 2014.
Canadian Examiner's Report pertaining to Design Patent Application 154351 dated May 13, 2014.
Canadian Office Action pertaining to Application No. 2,786,442 dated Nov. 3, 2015.
Chinese Office Action pertaining to Application No. 201180011448.8 dated Aug. 14, 2014.
Chinese Office Action pertaining to Application No. 201180011448.8 dated Jun. 30, 2015.
Election/Restriction Requirement pertaining to U.S. Appl. No. 13/520,627 dated Nov. 3, 2014.
Election/Restriction Requirement pertaining to U.S. Appl. No. 29/458,151 dated May 6, 2015.
European Extended Search Report pertaining to Application No. 11733348.4 dated Feb. 17, 2015.
European Search Report pertaining to Application No. 13860406.1 dated Jun. 14, 2016.
Final Rejection pertaining to U.S. Appl. No. 29/442,947 dated Apr. 22, 2015.
International Search Report and Written Opinion pertaining to PCT/US2013/073005 dated Apr. 28, 2014.
International Search Report and Written Opinion pertaining to PCT/US2011/021069 dated May 25, 2011.
International Search Report and Written Opinion pertaining to PCT/US2013/051271 dated Jan. 14, 2014.
Invitation to Pay Additional Fees pertaining to International Patent Application No. PCT/US2014/065649 dated Feb. 26, 2015.
Japanese Examination Report pertaining to Application No. 2012-549057 dated Oct. 28, 2014.
Japanese Office Action pertaining to Application No. 2015-091551 dated Feb. 4, 2016.
Korean Preliminary Rejection pertaining to Design Application No. 30-2013-0063154 dated Sep. 2, 2014.
Korean Preliminary Rejection pertaining to Design Application No. 30-2013-0063155 dated Sep. 2, 2014.
Korean Preliminary Rejection pertaining to Design Application No. 30-2013-0063157 dated Sep. 2, 2014.
Notice of Allowance pertaining to U.S. Appl. No. 29/442,947 dated Jul. 16, 2015.
Notice of Allowance pertaining to U.S. Appl. No. 13/520,627 dated Jul. 16, 2015.
Notice of Allowance pertaining to U.S. Appl. No. 13/520,627 dated Sep. 15, 2015.
Notice of Allowance pertaining to U.S. Appl. No. 14/414,812 dated Aug. 4, 2015.
Notice of Allowance pertaining to U.S. Appl. No. 14/414,812 dated Oct. 7, 2015.
Office Action pertaining to U.S. Appl. No. 29/442,947 dated Oct. 1, 2014.
Office Action pertaining to U.S. Appl. No. 13/520,627 dated Feb. 11, 2015.
Office Action pertaining to U.S. Appl. No. 14/245,107 dated Nov. 13, 2015.
Office Action pertaining to U.S. Appl. No. 14/649,260 dated Feb. 9, 2016.
Search Report pertaining to International Patent Application No. PCT/US2014/065649 dated May 22, 2015.
Written Opinion of International Preliminary Exam pertaining to International Patent Application No. PCT/US2014/065649 dated Jan. 18, 2016.
International Preliminary Report on Patentability pertaining to International Patent Application No. PCT/US2014/065649 dated Jun. 13, 2016.
Office Action pertaining to Chinese Application No. 201380070062.3, filed Dec. 4, 2013, 8 pages.
U.S. Non-Final Office Action dated Nov. 14, 2017 pertaining to U.S. Appl. No. 14/955,816, filed Dec. 1, 2015, 65 Pages.

* cited by examiner

SELF-ACTUATING COTS

CROSS-REFERENCE TO RELATED APPLICATIONS

This application claims the benefit of U.S. Provisional Application No. 61/904,694, filed Nov. 15, 2013, and U.S. Provisional Application No. 61/904,805, filed Nov. 15, 2013.

TECHNICAL FIELD

The present disclosure is generally related to cots, and is specifically directed to self-actuating cots having hydraulic actuators.

BACKGROUND

There are a variety of emergency cots in use today. Such emergency cots may be designed to transport and load bariatric patients into an ambulance.

For example, the PROFlexX® cot, by Ferno-Washington, Inc. of Wilmington, Ohio U.S.A., is a manually actuated cot that may provide stability and support for loads of about 700 pounds (about 317.5 kg). The PROFlexX® cot includes a patient support portion that is attached to a wheeled undercarriage. The wheeled under carriage includes an X-frame geometry that can be transitioned between nine selectable positions. One recognized advantage of such a cot design is that the X-frame provides minimal flex and a low center of gravity at all of the selectable positions. Another recognized advantage of such a cot design is that the selectable positions may provide better leverage for manually lifting and loading bariatric patients.

Another example of a cot designed for bariatric patients, is the POWERFlexx+ Powered Cot, by Ferno-Washington, Inc. The POWERFlexx+ Powered Cot includes a battery powered actuator that may provide sufficient power to lift loads of about 700 pounds (about 317.5 kg). One recognized advantage of such a cot design is that the cot may lift a bariatric patient up from a low position to a higher position, i.e., an operator may have reduced situations that require lifting the patient.

A further variety is a multipurpose roll-in emergency cot having a patient support stretcher that is removably attached to a wheeled undercarriage or transporter. The patient support stretcher when removed for separate use from the transporter may be shuttled around horizontally upon an included set of wheels. One recognized advantage of such a cot design is that the stretcher may be separately rolled into an emergency vehicle such as station wagons, vans, modular ambulances, aircrafts, or helicopters, where space and reducing weight is a premium.

Another advantage of such a cot design is that the separated stretcher may be more easily carried over uneven terrain and out of locations where it is impractical to use a complete cot to transfer a patient. Example of such cots can be found in U.S. Pat. Nos. 4,037,871, 4,921,295, and International Publication No. WO2001/070161.

Although the foregoing multipurpose roll-in emergency cots have been generally adequate for their intended purposes, they have not been satisfactory in all aspects. For example, the foregoing emergency cots are loaded into ambulances according to loading processes that require at least one operator to support the load of the cot for a portion of the respective loading process.

SUMMARY

The embodiments described herein are directed to hydraulic actuators for versatile multipurpose roll-in emergency cots which may provide improved management of the cot weight, improved balance, and/or easier loading at any cot height, while being rollable into various types of rescue vehicles, such as ambulances, vans, station wagons, aircrafts and helicopters.

In one embodiment, a self-actuating cot can include a support frame, a pair of legs, and a hydraulic actuator. The support frame can extend from a front end to a back end. The pair of legs can be in movable engagement with the support frame. The hydraulic actuator can be in movable engagement with the pair of legs and the support frame. The hydraulic actuator can and extend and retract the pair of legs with respect to the support frame. The hydraulic actuator can include a cylinder housing, a rod, and a sliding guide member. The cylinder housing can define a hydraulic cylinder aligned with a motive direction of the rod. The sliding guide member can be in sliding engagement with the cylinder housing and can be in rigid engagement with the rod. The sliding guide member can slide along a sliding direction with respect to the cylinder housing as the rod extends and retracts from the cylinder housing along the motive direction.

In another embodiment, a self-actuating cot can include a leg, a support frame, and an actuator. The leg can be in slidable and rotatable engagement with the support frame at a first link location. The actuator can be in fixed and rotatable engagement with the leg at a second link location. The actuator can be in rotatable engagement with the support frame at a third link location. The actuator can be configured to extend and retract. When the actuator extends or retracts, the first link location can travel along a linear path, and the second link location can travel along a curved path.

In another embodiment, a self-actuating cot can include a support frame, a pair of legs, and a hydraulic actuator. The support frame can extend from a front end to a back end. The pair of legs is can be in movable engagement with the support frame. The hydraulic actuator can be in movable engagement with the pair of legs and the support frame, and extends and retracts the pair of legs with respect to the support frame. The hydraulic actuator can include a hydraulic cylinder in fluidic communication with an extending fluid path and a retracting fluid path, a piston confined within the hydraulic cylinder and a regeneration fluid path in fluidic communication with the extending fluid path and the retracting fluid path. The piston can travel in an extending direction when hydraulic fluid is supplied with greater pressure at the extending fluid path than the retracting fluid path. The piston can travel in a retracting direction when the hydraulic fluid is supplied with greater pressure at the retracting fluid path than the extending fluid path. The regeneration fluid path can be configured to selectively allow the hydraulic fluid to flow directly from the retracting fluid path to the extending fluid path.

In another embodiment, a self-actuating cot can include a support frame, a pair of front legs, a pair of back legs, and a cot actuation system. The support frame can include a front end and a back end. The pair of front legs can be slidingly coupled to the support frame. The pair of back legs can be slidingly coupled to the support frame. The cot actuation system can include a front actuator that moves the front legs and a back actuator that moves the back legs. The cot actuation system can be configured to automatically actuate to a seated loading position such that the support frame forms a seated loading angle between the support frame and a substantially level surface. The seated loading angle can be acute.

In another embodiment, a self-actuating cot can include a support frame, a pair of front legs, a pair of back legs, and a cot actuation system. The support frame can include a front end and a back end. The pair of front legs can be slidingly coupled to the support frame. The pair of back legs can be slidingly coupled to the support frame. The cot actuation system can include a front actuator that moves the front legs and a back actuator that moves the back legs and a centralized hydraulic circuit configured to direct hydraulic fluid to the front actuator and the back actuator In another embodiment, a leg actuation system for a patient transport cot includes a telescoping hydraulic cylinder having a piston and a cylinder housing, the telescoping hydraulic cylinder having an extending fluid path and a retracting fluid path. The leg actuation system also includes a hydraulic pressure source in fluid communication with the cylinder housing and providing pressurized hydraulic fluid to the telescoping hydraulic cylinder and a carriage coupled to the telescoping hydraulic cylinder, an amplification rail, and a transmission assembly coupled to the amplification rail, the transmission assembly applying forces to the amplification to translate the amplification rail away from the carriage a distance that is generally proportional to an extension distance of the piston relative to the cylinder housing.

In another embodiment, a leg actuation system for a patient transport cot includes a telescoping hydraulic cylinder having a piston and a cylinder housing, a hydraulic pressure source in fluid communication with the cylinder housing and providing pressurized hydraulic fluid to the cylinder housing, and a carriage coupled to the telescoping hydraulic cylinder. The carriage includes a pair of pinions, a continuous force transmission member rotationally coupled to the pair of pinions and coupled to the cylinder housing of the telescoping hydraulic cylinder, and an amplification rail coupled to the continuous force transmission member. The amplification rail translates from the carriage a distance that is generally proportional to an extension distance of the piston relative to the cylinder housing.

In another embodiment, a patient transport cot includes a support frame comprising a front end and a back end, a pair of front legs pivotally coupled to the support frame, where each front leg comprises at least one front wheel, a pair of back legs pivotally coupled to the support frame, where each back leg comprises at least one back wheel, and a leg actuation system. The leg actuation system includes a telescoping hydraulic cylinder having a piston and a cylinder housing, a hydraulic pressure source in fluid communication with the cylinder housing, and a carriage coupled to the telescoping hydraulic cylinder, the carriage comprising an amplification rail and a transmission assembly coupled to the amplification rail, the transmission assembly applying forces to the amplification to translate the amplification rail away from the carriage a distance that is generally proportional to an extension distance of the piston relative to the cylinder housing.

According to any of the self-actuating cots, patient transport cots, or leg actuation systems described herein, the hydraulic actuator can include a transverse support platen coupled to the rod and the sliding guide member. Alternatively or additionally, any of the self-actuating cots, patient transport cots, or leg actuation systems described herein can include a second sliding guide member that is in sliding engagement with the cylinder housing and is coupled to the transverse support platen. The rod can be coupled to the transverse support platen between the rod and the second sliding guide member. Alternatively or additionally, the transverse support platen of the hydraulic actuator can be in movable engagement with the pair of legs. Alternatively or additionally, the transverse support platen of the hydraulic actuator can be in movable engagement with the support frame.

According to any of the self-actuating cots, patient transport cots, or leg actuation systems described herein, the sliding guide member can include a rod side that faces the rod and an outer side that is opposite the rod side. The rod side can be substantially straight and the outer side can include an arcuate portion.

According to any of the self-actuating cots, patient transport cots, or leg actuation systems described herein, the hydraulic actuator can include a second rod and a second sliding guide member. The second sliding guide member can be in sliding engagement with the cylinder housing, and in rigid engagement with the second rod. Alternatively or additionally, the hydraulic actuator can be configured to operate in a self-balancing manner that allows the rod and the second rod to extend and retract at different rates. Alternatively or additionally, the sliding guide member can travel along an upper course and the second sliding guide member travels along a lower course. Alternatively or additionally, the upper course and the lower course can be offset. Alternatively or additionally, the upper course and the lower course can be substantially parallel. Alternatively or additionally, the rod can be substantially aligned with the lower course and the second rod can be substantially aligned with the upper course.

Any of the self-actuating cots, patient transport cots, or leg actuation systems described herein can include a hinge member. The hinge member can be in rotatable engagement with the support frame at a fourth link location. The hinge member can be in rotatable engagement with the leg at a fifth link location. When the actuator extends or retracts, the fifth link location can travel along a second curved path. Alternatively or additionally, the hinge member can maintain a substantially fixed length. Alternatively or additionally, the hinge member can be in fixed and rotatable engagement at the fourth link location and the fifth link location.

According to any of the self-actuating cots, patient transport cots, or leg actuation systems described herein, the leg can include a cross member and the second link location can be formed at the cross member.

According to any of the self-actuating cots, patient transport cots, or leg actuation systems described herein, the regeneration fluid path can be configured to prevent the hydraulic fluid from flowing from the retracting fluid path to the extending fluid path.

According to any of the self-actuating cots, patient transport cots, or leg actuation systems described herein, the regeneration fluid path can selectively allow the hydraulic fluid to flow directly from the retracting fluid path to the extending fluid path, when the piston travels in the extending direction.

Any of the self-actuating cots, patient transport cots, or leg actuation systems described herein can include a patient support member coupled to the support frame and operable to articulate with respect to the support frame. The patient support member can include a foot supporting portion that can rotate away from the support frame and can define a foot offset angle with respect to the support frame. Alternatively or additionally, the foot offset angle can be limited to a maximum angle that is acute. Alternatively or additionally, the seated loading angle can be about equal to the foot offset angle. Alternatively or additionally, the patient support member can include a head supporting portion that can rotate away from the support frame and can define a head offset angle with respect to the support frame.

According to any of the self-actuating cots, patient transport cots, or leg actuation systems described herein, the amplification rail can be a substantially cylindrically shaped body and comprises a threaded portion.

According to any of the self-actuating cots, patient transport cots, or leg actuation systems described herein, the transmission assembly can include a translating support member that can translate with respect to the cylinder housing, static support members that can be static with respect to the cylinder housing, and force transmission members that can be in rotatable engagement with the translating support member and are in threaded engagement with the static support members.

According to any of the self-actuating cots, patient transport cots, or leg actuation systems described herein, each of the force transmission members can be a tubular body having an interior and an exterior. The interior can include an internally threaded portion and the exterior can include an externally threaded portion.

According to any of the self-actuating cots, patient transport cots, or leg actuation systems described herein, the amplification rail can be in threaded engagement with one of the force transmission members.

According to any of the self-actuating cots, patient transport cots, or leg actuation systems described herein, rotation of the force transmission members can be synchronized.

According to any of the self-actuating cots, patient transport cots, or leg actuation systems described herein, the transmission assembly can include a pair of pinions and a force transmission member rotationally coupled to the pair of pinions and coupled to the cylinder housing of the telescoping hydraulic cylinder. Alternatively or additionally, a distance between the pair of pinions can be maintained at a fixed distance throughout operation of the leg actuation system.

According to any of the self-actuating cots, patient transport cots, or leg actuation systems described herein, the transmission assembly can include a plurality of pinions.

According to any of the self-actuating cots, patient transport cots, or leg actuation systems described herein, the amplification rail can translate from the cylinder housing a distance that is generally equivalent to the extension distance of the piston relative to the cylinder housing.

According to any of the self-actuating cots, patient transport cots, or leg actuation systems described herein, the carriage can include a linear bearing that supports the amplification rail thereby allowing the amplification rail to translate away from the carriage.

Any of the self-actuating cots, patient transport cots, or leg actuation systems described herein can include a force-direction switch that indicates the direction of force applied to the leg actuation system.

According to any of the self-actuating cots, patient transport cots, or leg actuation systems described herein, the telescoping hydraulic cylinder can include an extending fluid path and a retracting fluid path.

According to any of the self-actuating cots, patient transport cots, or leg actuation systems described herein, the force transmission member can be a chain.

According to any of the self-actuating cots, patient transport cots, or leg actuation systems described herein, the force transmission member can be a belt.

According to any of the self-actuating cots, patient transport cots, or leg actuation systems described herein, the amplification rail can translate from the cylinder housing a distance that is generally equivalent to the extension distance of the piston relative to the cylinder housing.

According to any of the self-actuating cots, patient transport cots, or leg actuation systems described herein, the carriage can include a linear bearing that supports the amplification rail thereby allowing the amplification rail to translate away from the cylinder housing.

According to any of the self-actuating cots, patient transport cots, or leg actuation systems described herein, a distance between the pair of pinions can be maintained at a fixed distance throughout operation of the leg actuation system.

According to any of the self-actuating cots, patient transport cots, or leg actuation systems described herein, the transmission assembly can include a pair of pinions and a force transmission member rotationally coupled to the pair of pinions and coupled to the cylinder housing of the telescoping hydraulic cylinder. Alternatively or additionally, a distance between the pair of pinions can be maintained at a fixed distance throughout operation of the leg actuation system.

According to any of the self-actuating cots, patient transport cots, or leg actuation systems described herein, the front actuator and the back actuator can be supplied with the hydraulic fluid from a single fluid reservoir.

According to any of the self-actuating cots, patient transport cots, or leg actuation systems described herein, the cot actuation system can include a single pump motor configured to actuate both the front actuator and the back actuator with the hydraulic fluid.

According to any of the self-actuating cots, patient transport cots, or leg actuation systems described herein, the cot actuation system can include a flow control valve or an electronic switching valve in fluidic communication with the front actuator and the back actuator.

These and additional features provided by the embodiments of the present disclosure will be more fully understood in view of the following detailed description, in conjunction with the drawings.

BRIEF DESCRIPTION OF THE DRAWINGS

The following detailed description of specific embodiments of the present disclosures can be best understood when read in conjunction with the following drawings, where like structure is indicated with like reference numerals and in which.

Figure 1:
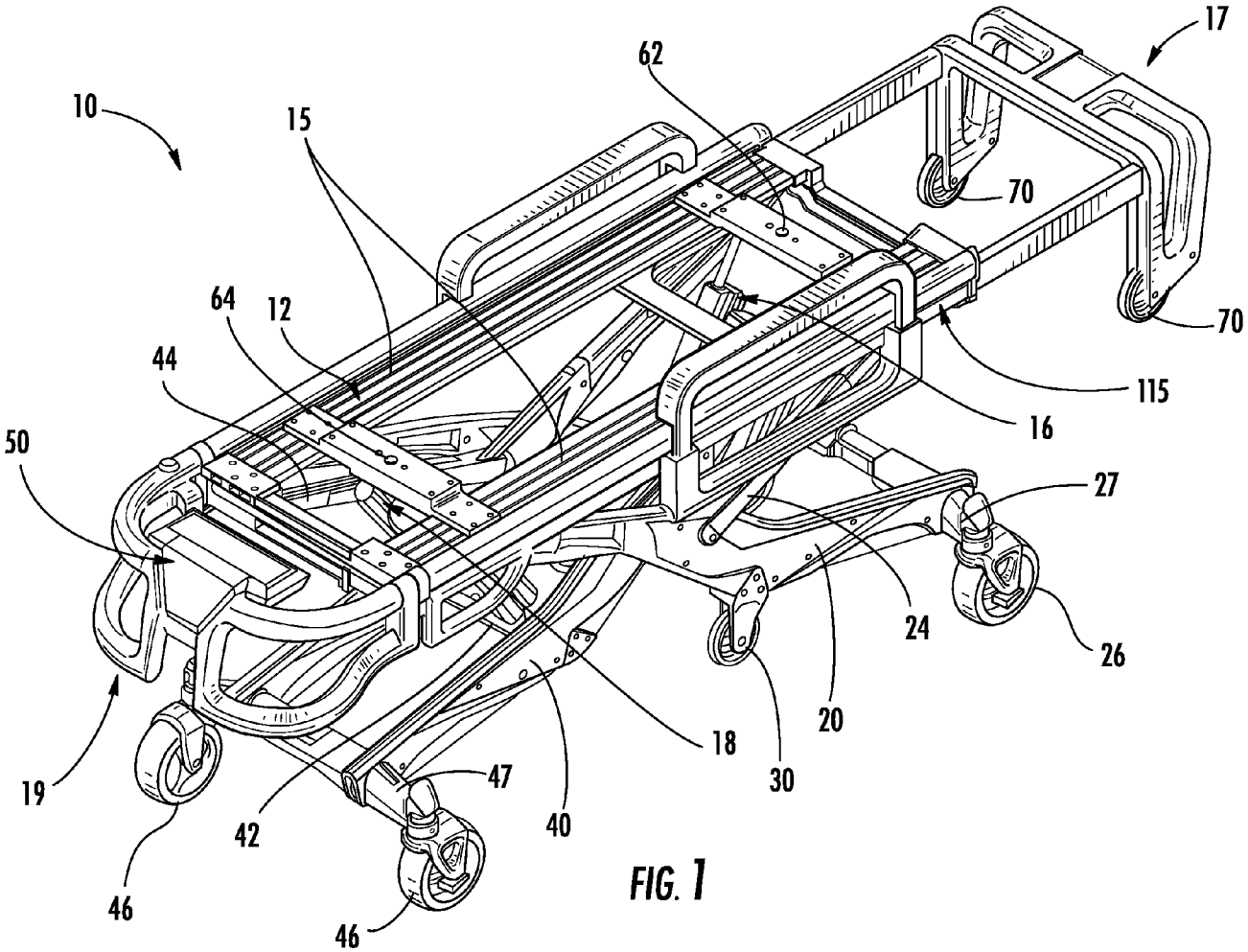
FIG. 1 is a perspective view depicting a cot according to one or more embodiments described herein.

The embodiments set forth in the drawings are illustrative in nature and not intended to be limiting of the embodiments described herein. Moreover, individual features of the drawings and embodiments will be more fully apparent and understood in view of the detailed description.

DETAILED DESCRIPTION

Referring to FIG. 1, a self-actuating cot 10 for transport and loading is shown. The self-actuating cot 10 comprises a support frame 12 comprising a front end 17, and a back end 19. As used herein, the front end 17 is synonymous with the loading end, i.e., the end of the self-actuating cot 10 which is loaded first onto a loading surface. Conversely, as used herein, the back end 19 is the end of the self-actuating cot 10 which is loaded last onto a loading surface. Additionally it is noted, that when the self-actuating cot 10 is loaded with a patient, the head of the patient may be oriented nearest to the front end 17 and the feet of the patient may be oriented nearest to the back end 19. Thus, the phrase "head end" may be used interchangeably with the phrase "front end," and the phrase "foot end" may be used interchangeably with the phrase "back end." Furthermore, it is noted that the phrases "front end" and "back end" are interchangeable. Thus, while the phrases are used consistently throughout for clarity, the embodiments described herein may be reversed without departing from the scope of the present disclosure. Generally, as used herein, the term "patient" refers to any living thing or formerly living thing such as, for example, a human, an animal, a corpse and the like.

Figure 2:
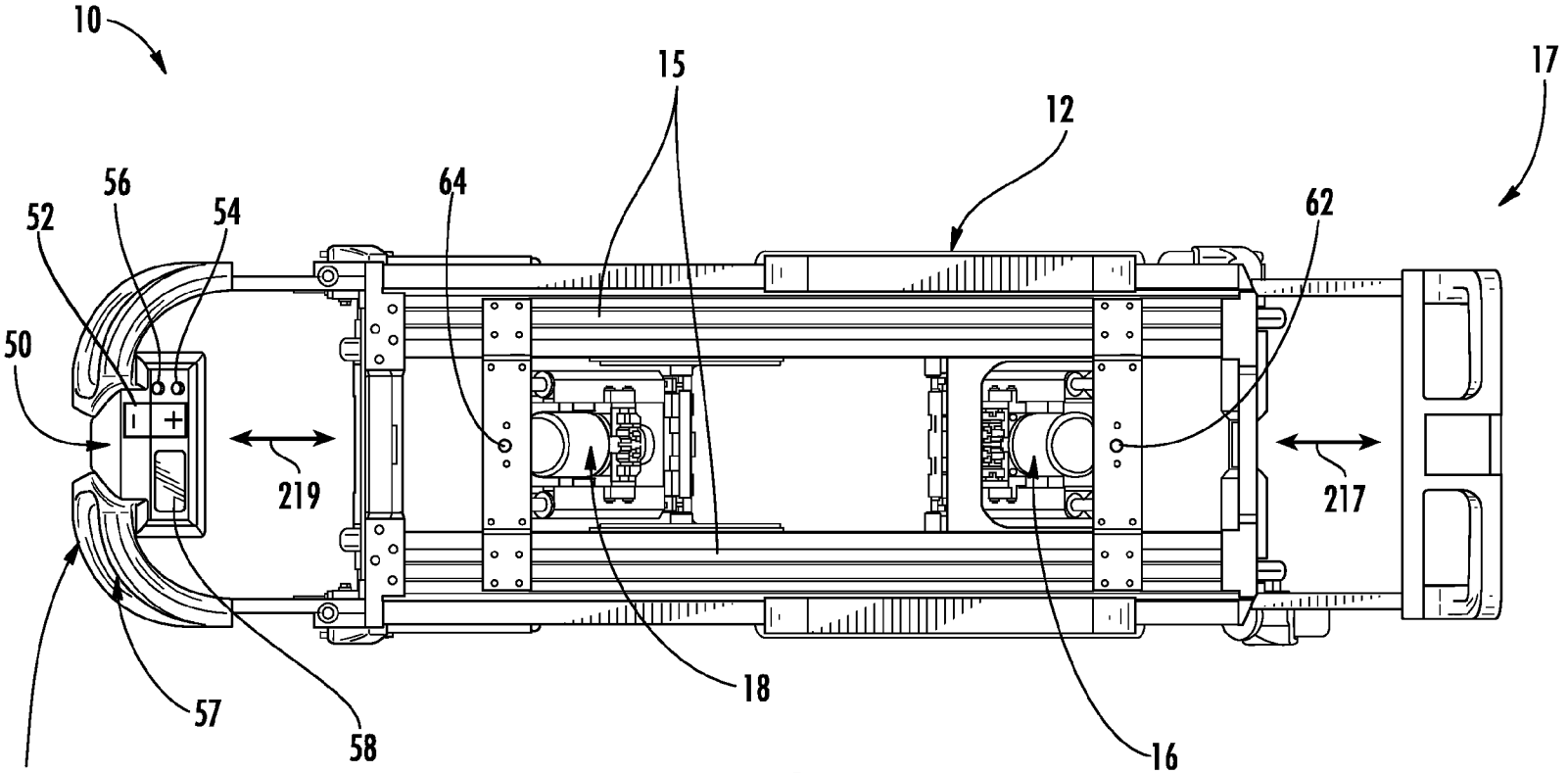
FIG. 2 is a top view depicting a cot according to one or more embodiments described herein.

Referring to FIG. 2, the front end 17 and/or the back end 19 may be telescoping. In one embodiment, the front end 17 may be extended and/or retracted (generally indicated in FIG. 2 by arrow 217). In another embodiment, the back end 19 may be extended and/or retracted (generally indicated in FIG. 2 by arrow 219). Thus, the total length between the front end 17 and the back end 19 may be increased and/or decreased to accommodate various sized patients.

Referring collectively to FIGS. 1 and 2, the support frame 12 may comprise a pair of substantially parallel lateral side members 15 extending between the front end 17 and the back end 19. Various structures for the lateral side members 15 are contemplated. In one embodiment, the lateral side members 15 may be a pair of spaced metal tracks. In another embodiment, the lateral side members 15 comprise an undercut portion 115 that is engageable with an accessory clamp (not depicted). Such accessory clamps may be utilized to removably couple patient care accessories such as a pole for an IV drip to the undercut portion 115. The undercut portion 115 may be provided along the entire length of the lateral side members to allow accessories to be removably clamped to many different locations on the self-actuating cot 10.

Referring again to FIG. 1, the self-actuating cot 10 also comprises a pair of retractable and extendible front legs 20 coupled to the support frame 12, and a pair of retractable and extendible back legs 40 coupled to the support frame 12. The self-actuating cot 10 may comprise any rigid material such as, for example, metal structures or composite structures. Specifically, the support frame 12, the front legs 20, the back legs 40, or combinations thereof may comprise a carbon fiber and resin structure. As is described in greater detail herein, the self-actuating cot 10 may be raised to multiple heights by extending the front legs 20 and/or the back legs 40, or the self-actuating cot 10 may be lowered to multiple heights by retracting the front legs 20 and/or the back legs 40. It is noted that terms such as "raise," "lower," "above," "below," and "height" are used herein to indicate the distance relationship between objects measured along a line parallel to gravity using a reference (e.g. a surface supporting the cot).

In specific embodiments, the front legs 20 and the back legs 40 may each be coupled to the lateral side members 15.

As shown in FIGS. 3A-4E, the front legs 20 and the back legs 40 may cross each other, when viewing the cot from a side, specifically at respective locations where the front legs 20 and the back legs 40 are coupled to the support frame 12 (e.g., the lateral side members 15 (FIGS. 1-2)). As shown in the embodiment of FIG. 1, the back legs 40 may be disposed inwardly of the front legs 20, i.e., the front legs 20 may be spaced further apart from one another than the back legs 40 are spaced from one another such that the back legs 40 are each located between the front legs 20. Additionally, the front legs 20 and the back legs 40 may comprise front wheels 26 and back wheels 46 which enable the self-actuating cot 10 to roll.

In one embodiment, the front wheels 26 and back wheels 46 may be swivel caster wheels or swivel locked wheels. As the self-actuating cot 10 is raised and/or lowered, the front wheels 26 and back wheels 46 may be synchronized to ensure that the plane of the lateral side members 15 of the self-actuating cot 10 and the plane of the wheels 26, 46 are substantially parallel.

Referring again to FIG. 1, the self-actuating cot 10 may also comprise a cot actuation system 14 comprising a front actuator 16 configured to move the front legs 20 and a back actuator 18 configured to move the back legs 40. The cot actuation system 14 may comprise one unit (e.g., a centralized motor and pump) configured to control both the front actuator 16 and the back actuator 18. For example, the cot actuation system 14 may comprise one housing with one motor capable to drive the front actuator 16, the back actuator 18, or both utilizing valves, control logic and the like. Alternatively or additionally, the cot actuation system 14 can comprise a single reservoir in fluidic communication with one or motors and one or more pumps that are configured to drive the front actuator 16, the back actuator 18, or both utilizing valves, control logic and the like. Alternatively, as depicted in FIG. 1, the cot actuation system may comprise separate units configured to control the front actuator 16 and the back actuator 18 individually. In this embodiment, the front actuator 16 and the back actuator 18 may each include separate housings with individual motors to drive each of the front actuator 16 and the back actuator 18.

Referring to FIG. 1, the front actuator 16 is coupled to the support frame 12 and configured to actuate the front legs 20 and raise and/or lower the front end 17 of the self-actuating cot 10. Additionally, the back actuator 18 is coupled to the support frame 12 and configured to actuate the back legs 40 and raise and/or lower the back end 19 of the self-actuating cot 10. The self-actuating cot 10 may be powered by any suitable power source. For example, the self-actuating cot 10 may comprise a battery capable of supplying a voltage for its power source such as, for example, about 24 V nominal in one embodiment, about 32 V nominal in another embodiment, or about 36 V nominal in a further embodiment.

The front actuator 16 and the back actuator 18 are operable to actuate the front legs 20 and back legs 40, simultaneously or independently. As shown in FIGS. 3A-4E, simultaneous and/or independent actuation allows the self-actuating cot 10 to be set to various heights. The actuators described herein may be capable of providing a dynamic force of at least about 350 pounds (about 158.8 kg) and a static force of at least about 500 pounds (about 226.8 kg). Furthermore, the front actuator 16 and the back actuator 18 may be operated by a centralized motor system, a centralized reservoir system, multiple independent motor systems, or combinations thereof.

Figure 5A:
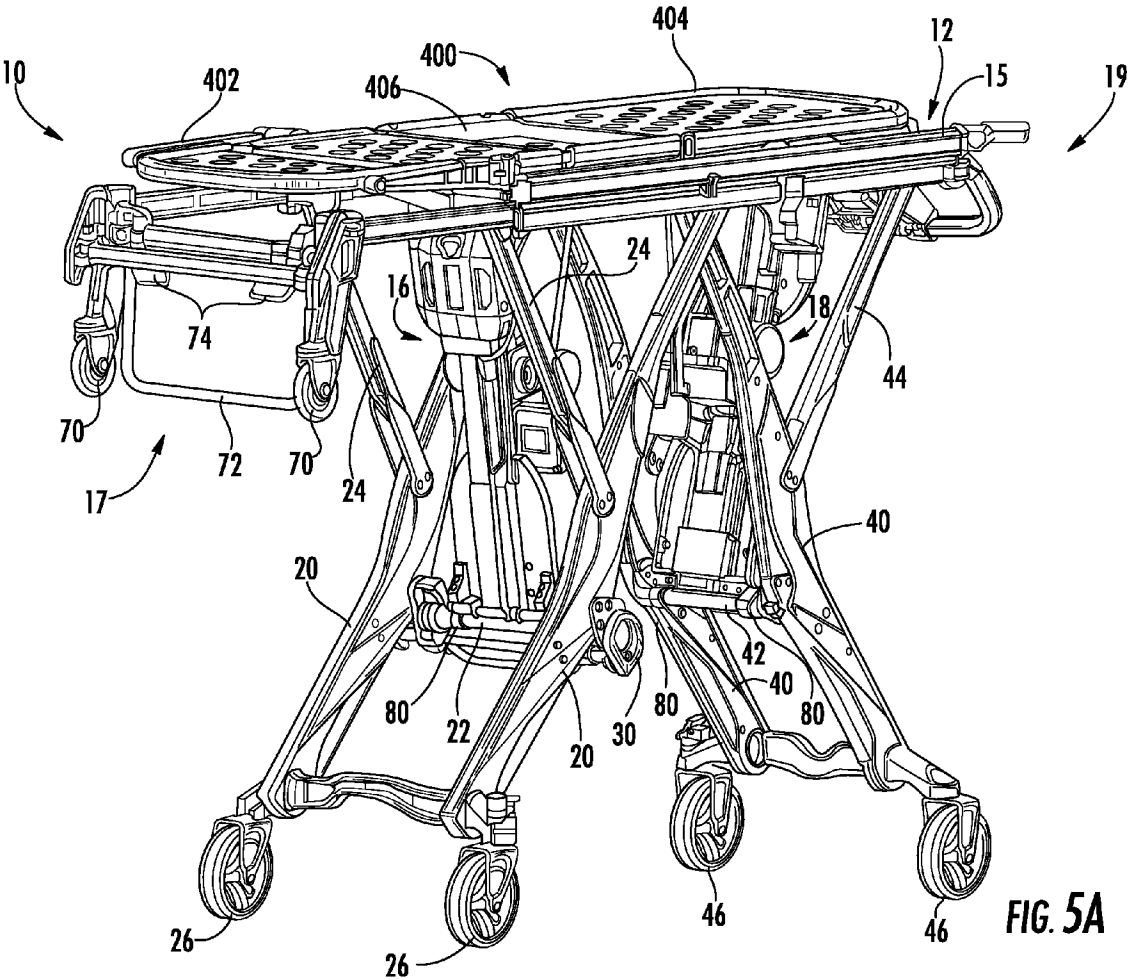
FIG. 5A is a perspective view depicting a cot in an extended state according to one or more embodiments described herein.
Figure 5B:
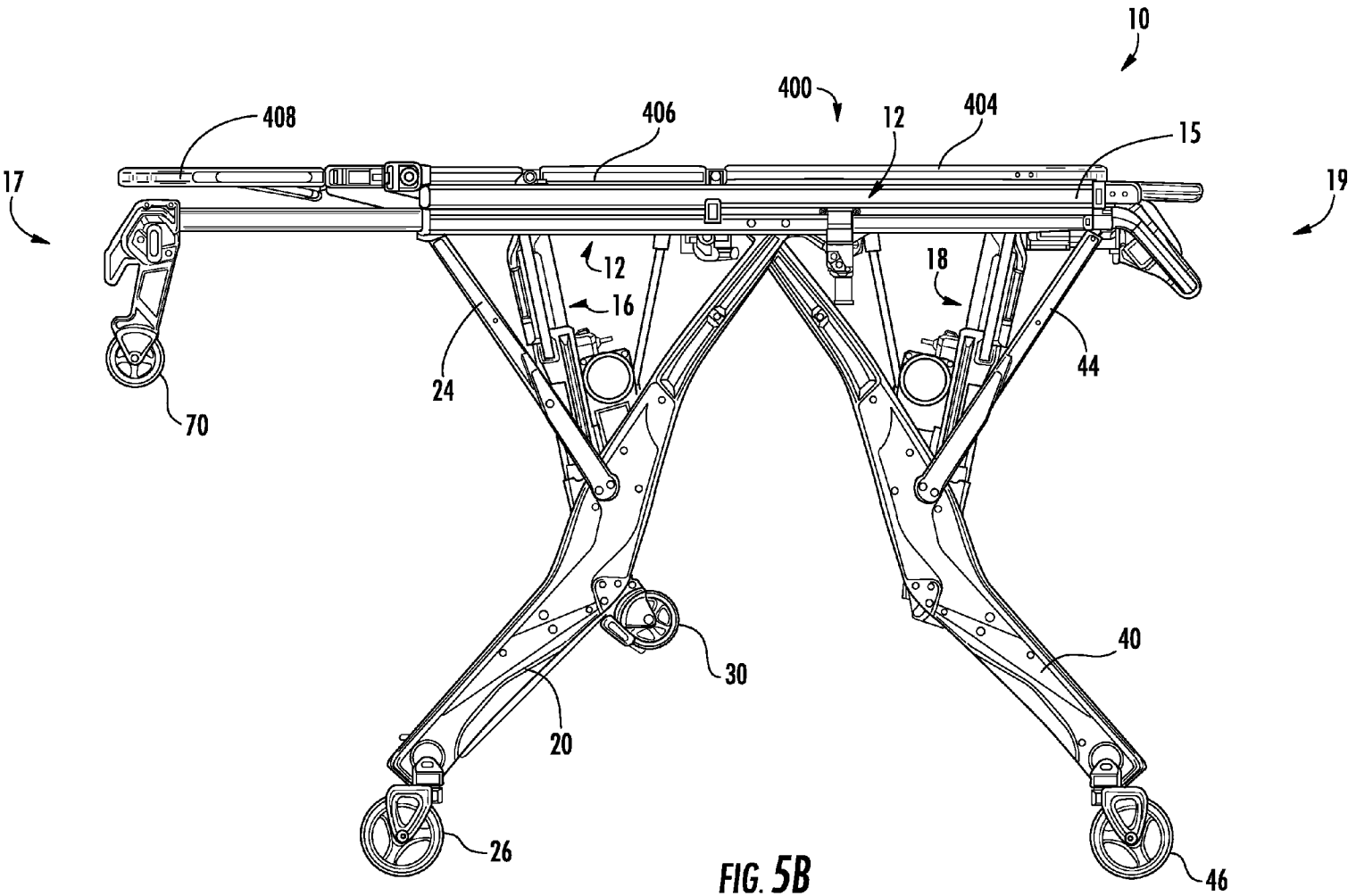
FIG. 5B is a side view depicting the cot of FIG. 5A in an extended state according to one or more embodiments described herein.
Figure 6:
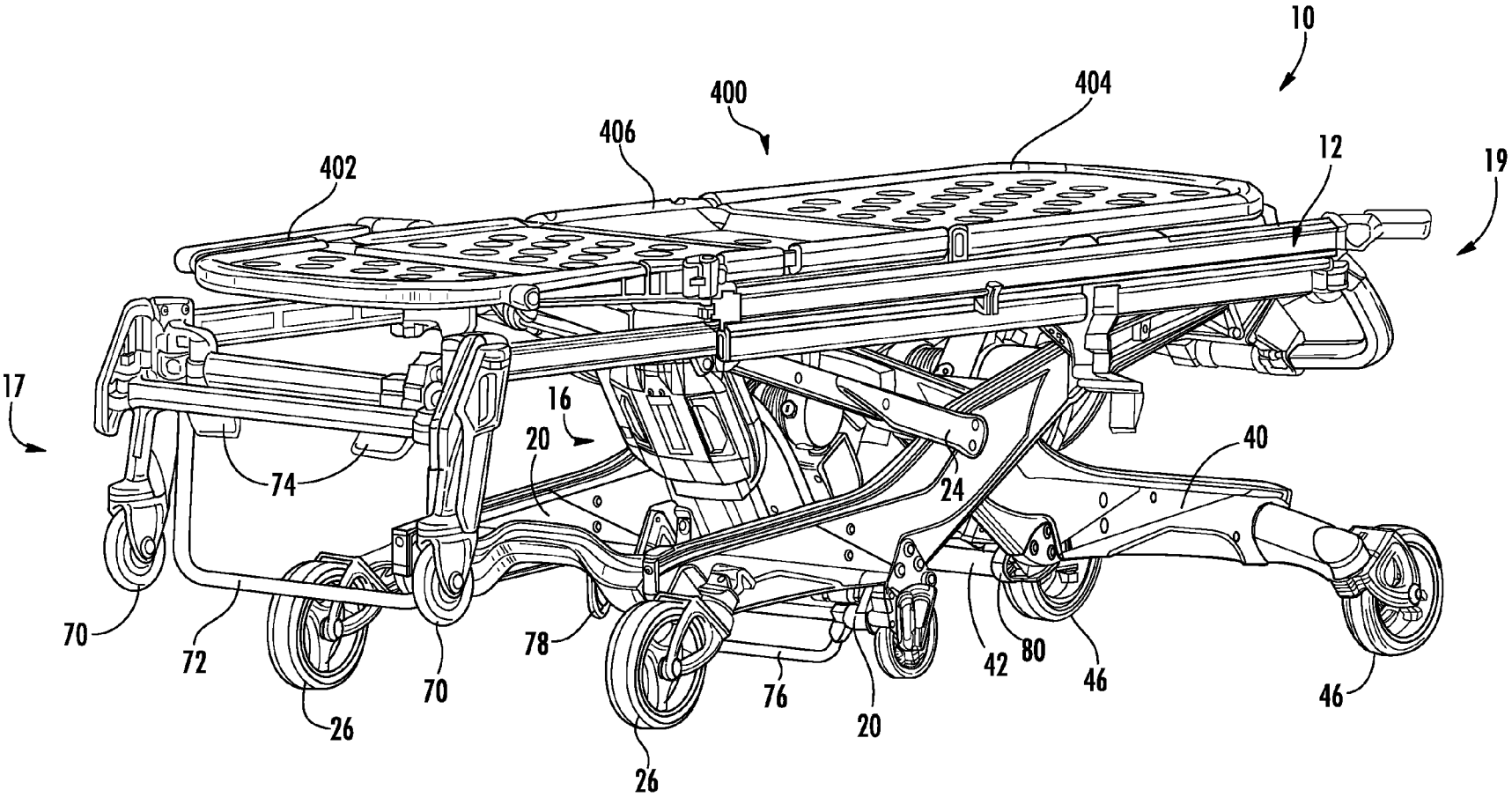
FIG. 6 is a perspective view depicting the cot of FIG. 5A in a retracted state according to one or more embodiments described herein.

In one embodiment, schematically depicted in FIGS. 5A, 5B, and 6, the front actuator 16 and the back actuator 18 can comprise a hydraulic actuator 120 (FIGS. 7A-9C) for actuating the self-actuating cot 10. The front actuator 16 can be in moveable engagement with each of the support frame 12 and the front legs 20. Accordingly, the front actuator 16 can be configured for relative rotation with respect to the front legs 20 as the front actuator 16 extends, retracts, or both. Specifically, the front actuator 16 can comprise one or more rotational couplings 80 such as, for example, a coupling comprising a rolling element bearing or the like, that are in rotatable engagement with the front cross beam 22. Similarly, although not depicted, the front actuator 16 can be in rotatable engagement with the support frame 12 and can be configured for relative rotation with respect to the support frame 12. In a manner analogous to the front actuator 16, the back actuator 18 can be in moveable engagement with each of the support frame 12 and the back legs 40. Accordingly, the back actuator 18 can be configured for relative rotation with respect to each of the support frame 12 and the back legs 40 as the front actuator 16 extends, retracts, or both.

Figure 7:
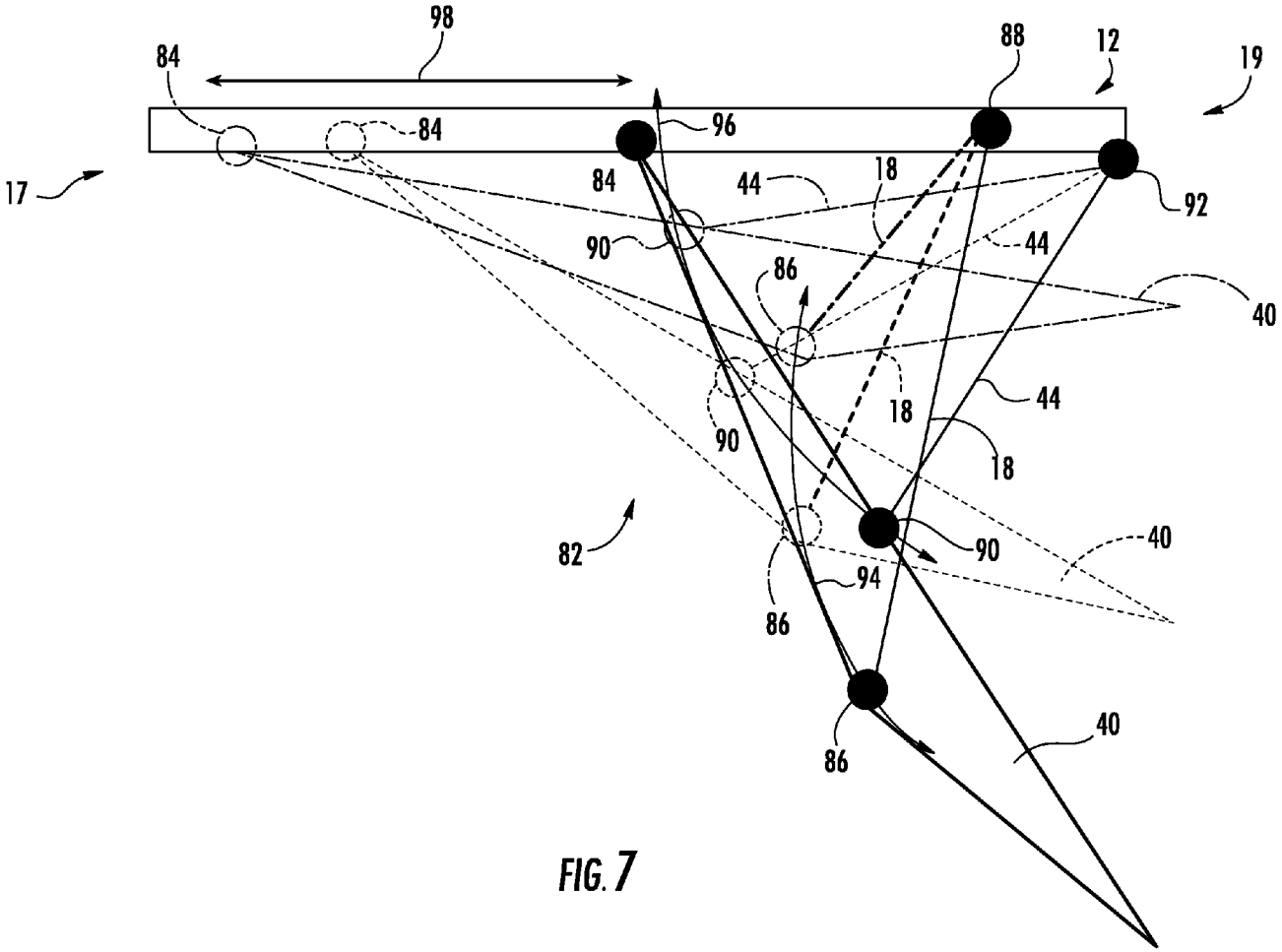
FIG. 7 schematically depicts a leg linkage according to one or more embodiments described herein.
Figure 8A:
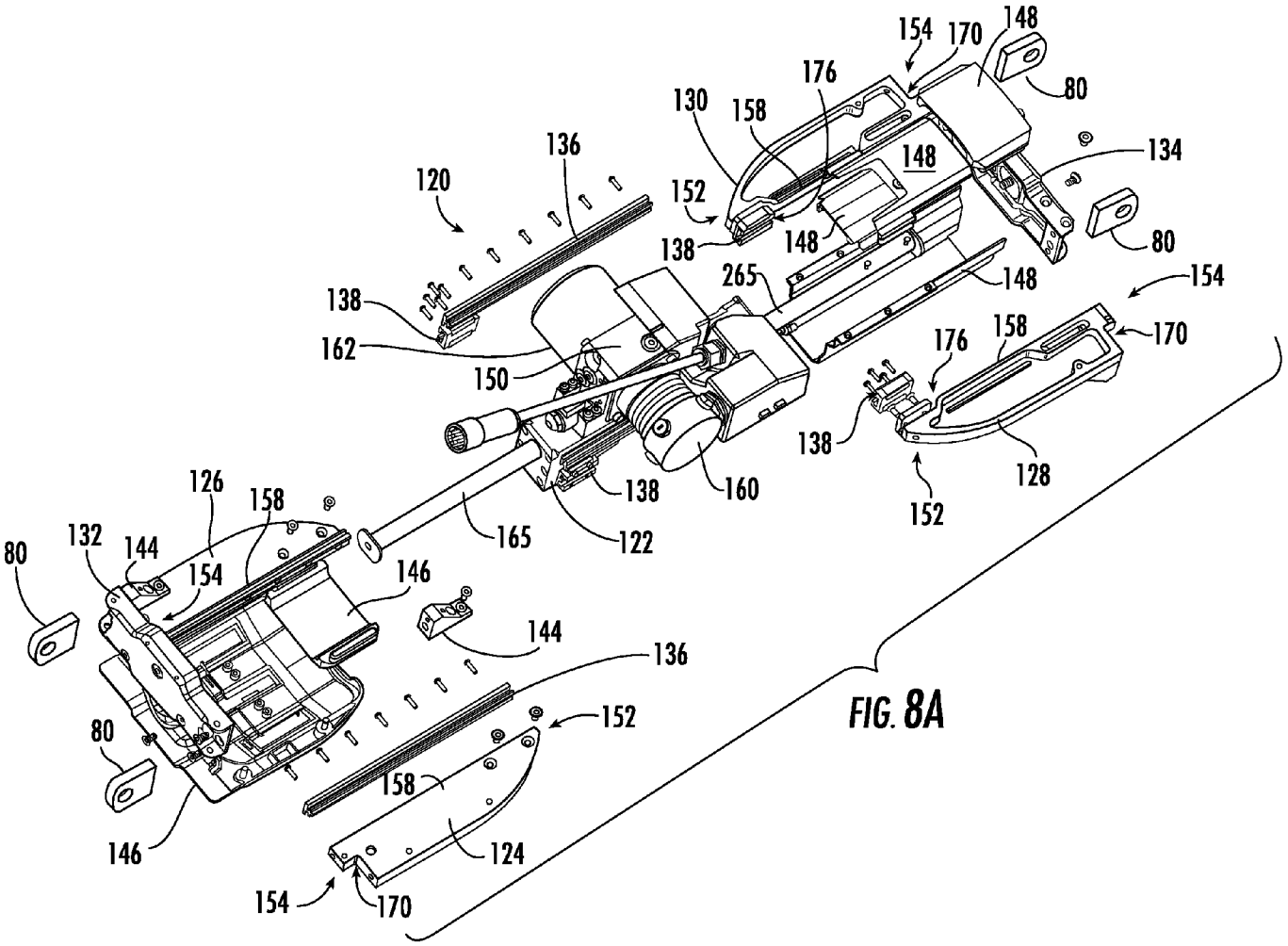
FIGS. 8A and 8B schematically depict an exploded view of a hydraulic actuator according to one or more embodiments described herein.
Figure 8B:
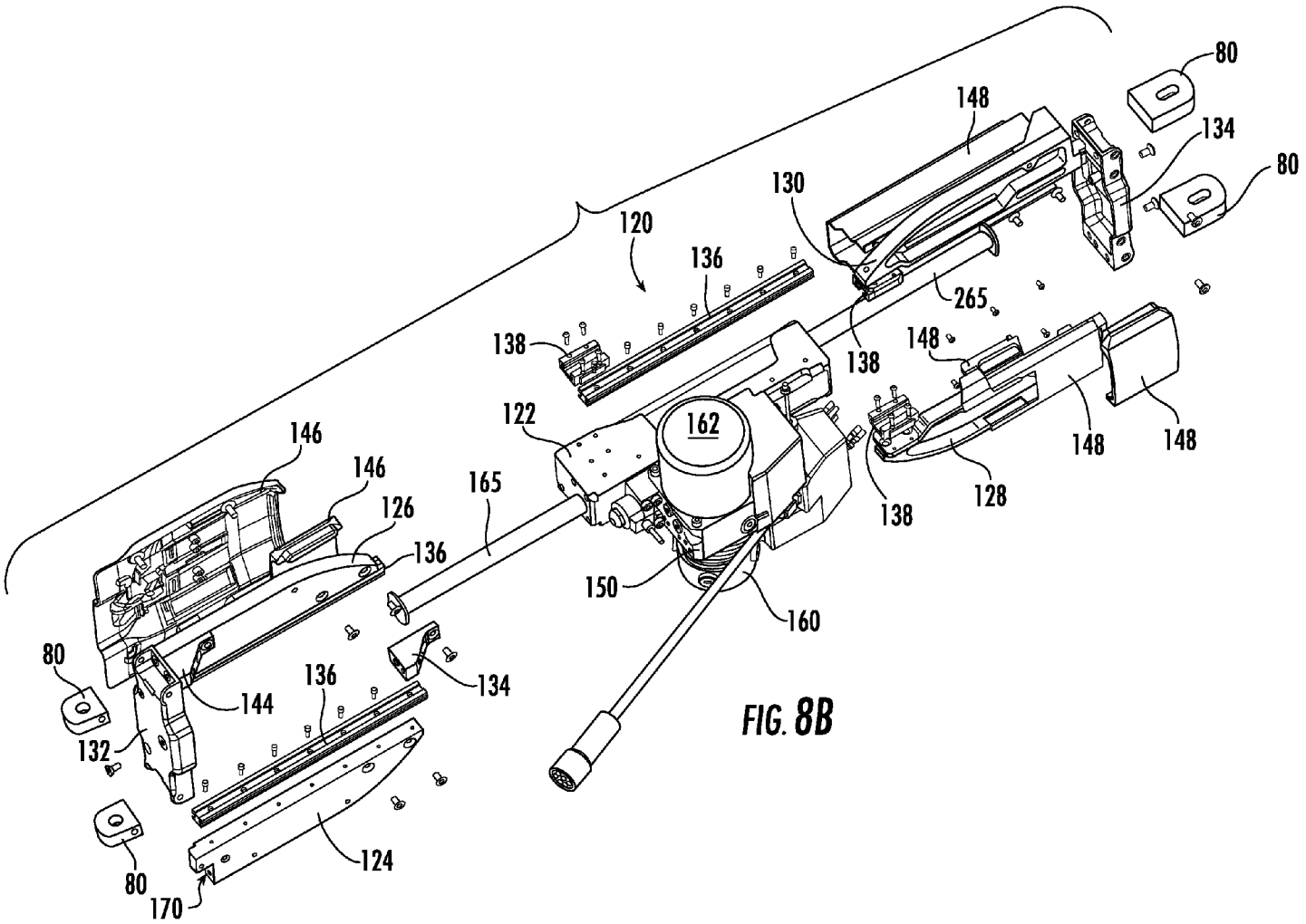
Figure 9A:
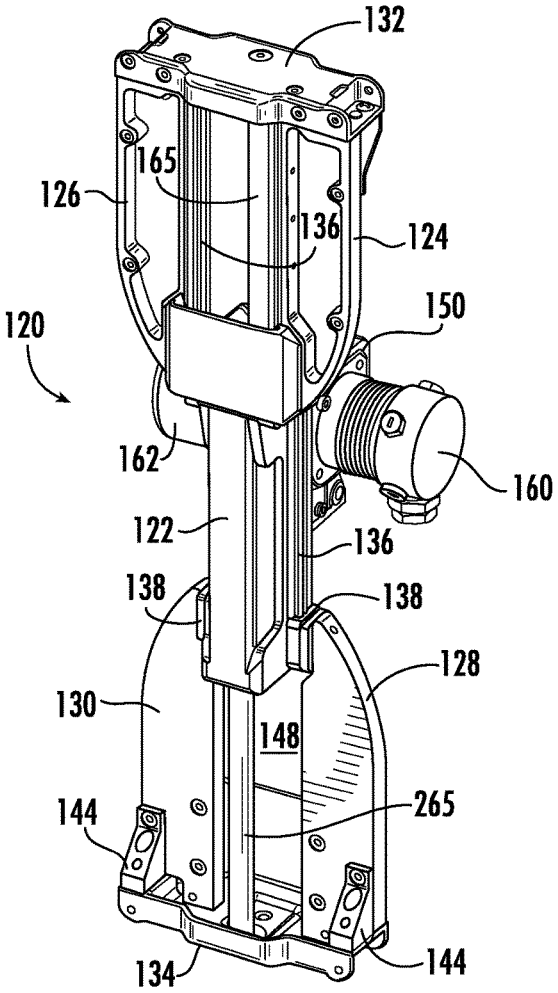
FIGS. 9A and 9B schematically depict a front and back perspective view of a hydraulic actuator in an extended state according to one or more embodiments described herein.
Figure 9B:
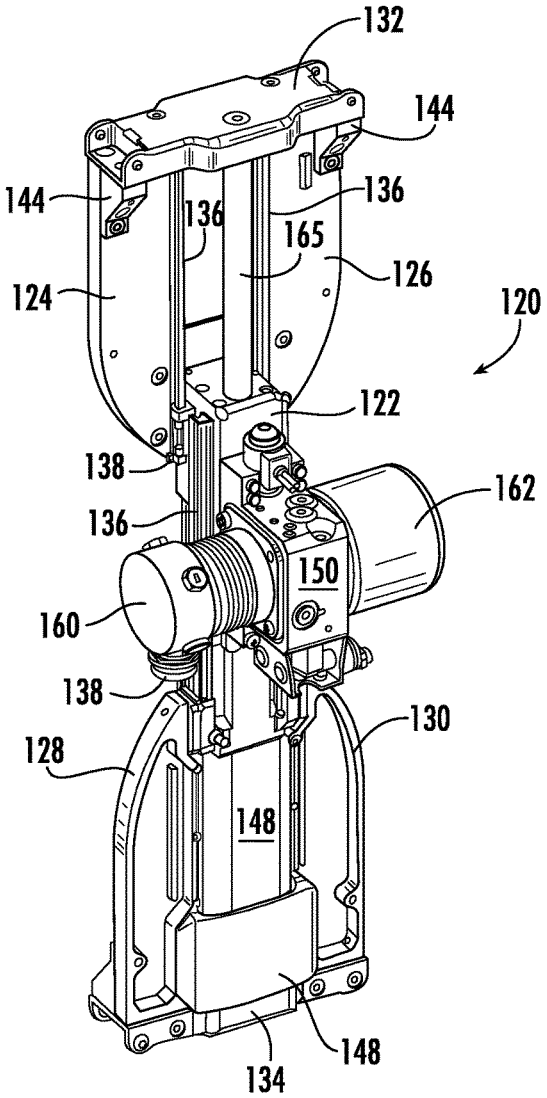

Referring now to FIG. 7, the support frame 12, the back actuator 18, the back legs 40, and the back hinge member 44 can cooperate to form a leg linkage 82. Alternatively or additionally, although not depicted in FIG. 7, the support frame 12, the front actuator 16, the front legs 20, and the front hinge member 24 can cooperate to form a leg linkage substantially similar to the leg linkage 82. The leg linkage 82 can comprise link location 84, link location 86, link location 88, link location 90 and link location 92 that constrain the motion of the back legs 40 and the back actuator 18. Specifically, the back leg 40 can be in slidable and rotatable engagement with the support frame at link location 84. The back actuator 18 can be in fixed and rotatable engagement with the back leg 40 at link location 86. For example, the back actuator 18 can be in rotatable engagement with the back cross beam 42. Additionally, the back actuator 18 can be in fixed and rotatable engagement with the support frame 12. The back hinge member 44 can be in fixed and rotatable engagement with the back leg 40 at link location 90. Additionally, the back hinge member 44 can be in fixed and rotatable engagement with the support frame 22 at link location 92. For the purpose of describing and defining the present disclosure, it is noted that the phrase "fixed and rotatable engagement" can mean that the axis of rotation of the rotatable engagement is substantially fixed.

In some embodiments, the back hinge member 44 can maintain a substantially fixed length, i.e., the span between link location 90 and link location 92. As is noted above, the back leg 40 can be actuated by extending or retracting the back actuator 18. Specifically, as the back actuator 18 extends, i.e., increases the span between link location 86 and link location 88, the back leg 40 extends away from the support frame 12. Conversely, as the back actuator 18 retracts, i.e., decreases the span between link location 86 and link location 88, the back leg 40 retracts towards the support frame 12. During such extension and retraction, the back actuator 18 is free to rotate around each of the link location 86 and the link location 88. The back hinge member 44 is free to rotate around each of the link location 90 and the link location 92. The back leg 40 is free to rotate around each of the link location 84, the link location 86, and the link location 90.

Accordingly, when constrained by the leg linkage 82, the back actuator 18 causes the link location 86 to travel along a curved path 94 as the back actuator 18 rotates with respect to link location 88. Contemporaneously, the back actuator 18 causes the link location 90 to travel along curved path 96 as the back hinge member 44 rotates around the link location 92. Contemporaneously, with the motion of the back actuator 18, the back actuator 18 causes the link location 84 to travel along linear path 98 as the back leg 40 rotates around the link location 84. Accordingly, because the back leg 40 comprises at least a portion of the link location 84, the link location 86, and the link location 90, the back leg 40 can be retracted and collapsed towards the support frame 12 by retraction of the back actuator 18.

Referring collectively to FIGS. 8A-10C, as is noted above the back actuator 18 and the front actuator 16 can each comprise a hydraulic actuator 120. The hydraulic actuator 120 can comprise a cylinder housing 122, one or more rods, and one or more sliding guide members. The cylinder housing 122 can be a structural member configured to be coupled with a plurality of components of the hydraulic actuator 120. Additionally, the cylinder housing can define one or more cylinders for holding hydraulic fluid under pressure. Accordingly, the cylinder housing 122 can be formed out of any rigid material that can be manufactured into a structure having precise interior dimensions. Specifically, the cylinders within the cylinder housing 122 can be machined or cast from metal such as, for example, aluminum or the like. As is explained in further detail below, the hydraulic actuator 120 can comprise an upper rod 165 and a lower rod 265 that can be operable to move with respect to the cylinder housing 122. Specifically, each of the upper rod 165 and the lower rod 265 can extend and retract with respect to cylinders formed within the cylinder housing 122.

The hydraulic actuator 120 can comprise one or more sliding guide members configured to provide transverse support to each rod. Accordingly, the sliding guide members described herein can be formed from rigid material. In the depicted embodiment, the hydraulic actuator 120 comprises an upper sliding guide member 124, an upper sliding guide member 126, a lower sliding guide member 128, and a lower sliding guide member 130. In some embodiments, the hydraulic actuator 120 can comprise one or more covers 148 for protecting the motive portions of the hydraulic actuator 120 from dirt and debris infiltration. It is noted that, while the embodiments depicted in FIGS. 8A to 10C comprise four sliding guide members, embodiments of the present disclosure can comprise any number of sliding guide members. In some embodiments, each of the upper sliding guide member 124, the upper sliding guide member 126, the lower sliding guide member 128, and the lower sliding guide member 130 can be substantially similarly shaped.

Figures 11A, 11B:
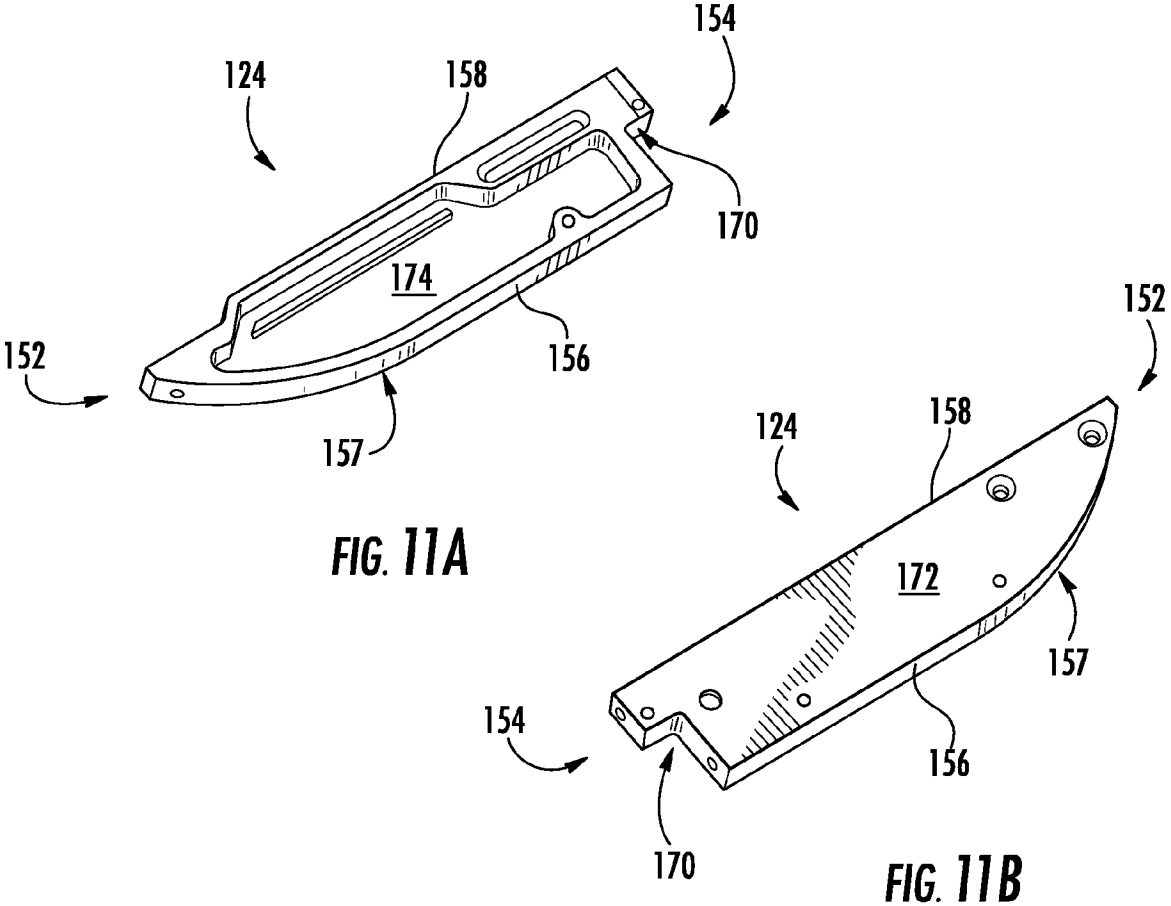
FIGS. 11A and 11B schematically depict perspective views of a sliding guide member according to one or more embodiments described herein.

Referring collectively to FIGS. 11A and 11B, the upper sliding guide member 124 is depicted in isolation. The upper sliding guide member 124 can comprise an outer side 156 and a rod side 158 that each extend from a piston end 152 to a platen end 154 of the sliding guide member 124. The rod side 158 of the upper sliding guide member 124 can be substantially straight along a span between the piston end 152 to the platen end 154 of the sliding guide member 124. In some embodiments, the outer side 156 of the upper sliding guide member 124 can comprise an arcuate portion 157. The outer side 156 can curve gradually throughout the arcuate portion 157. Specifically, the width of the upper sliding guide member 124, measured between the outer side 156 and the rod side 158, can gradually increase from the piston end 152 through the arcuate portion 157. Accordingly, the width of the upper sliding guide member 124 at the piston end 152 can be smaller than the width of the upper sliding guide member 124 at the platen end 154.

The upper sliding guide member 124 can comprise an interface surface 172 and an outer surface 174 with a thickness of the upper sliding guide member 124 formed there between. In some embodiments, the interface surface 172 can be substantially flat to provide a flat surface for facing an opposing sliding guide member. Alternatively or additionally, the outer surface 174 can have a relief formed therein such that a portion of the thickness of the upper sliding guide member 124 is removed for weight reduction. In further embodiments, a protruding member 170 can be formed in the platen end 154 of the upper sliding guide member 124 to accommodate mating with additional components. Specifically, the protruding member 170 can be a tenon-like object extending from a shoulder portion of the platen end 154. It is noted that while the sliding guide members 124, 126, 128, and 130 are depicted in FIGS. 8A-10C as having substantially the same geometry, each of the sliding guide members 124, 126, 128, and 130 can be formed in any shape suitable to provide transverse support to an associated rod.

Referring again to FIGS. 8A-10C, the hydraulic actuator 120 can comprise the upper sliding guide member 124 and the upper sliding guide member 126. Each of the upper sliding guide member 124 and the upper sliding guide member 126 can be in sliding engagement with cylinder housing 122. In some embodiments, the upper sliding guide member 124 and the upper sliding guide member 126 can be configured to move in concert with the upper rod 165. Accordingly, the upper sliding guide member 124 and the upper sliding guide member 126 can be configured to provide transverse support to the upper rod 165 throughout an extending stroke, a returning stroke, or both of the upper rod 165.

Figure 10C:
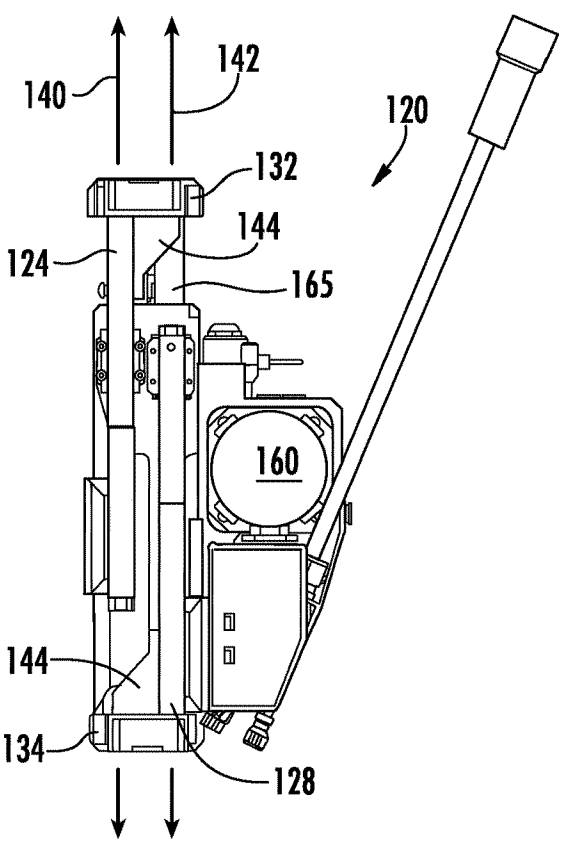
FIGS. 10A-10C schematically depict a back, a front and a side view of the hydraulic actuator of FIGS. 9A and 9B in a retracted state according to one or more embodiments described herein.
Figure 10B:
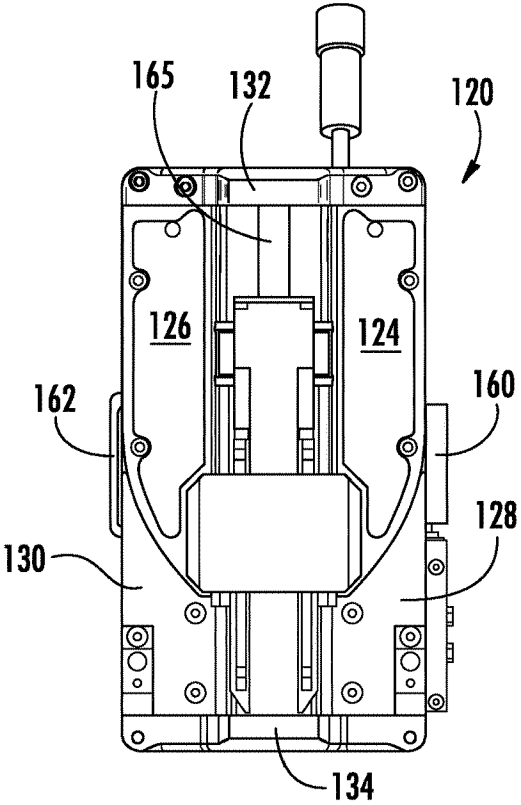
Figure 10A:
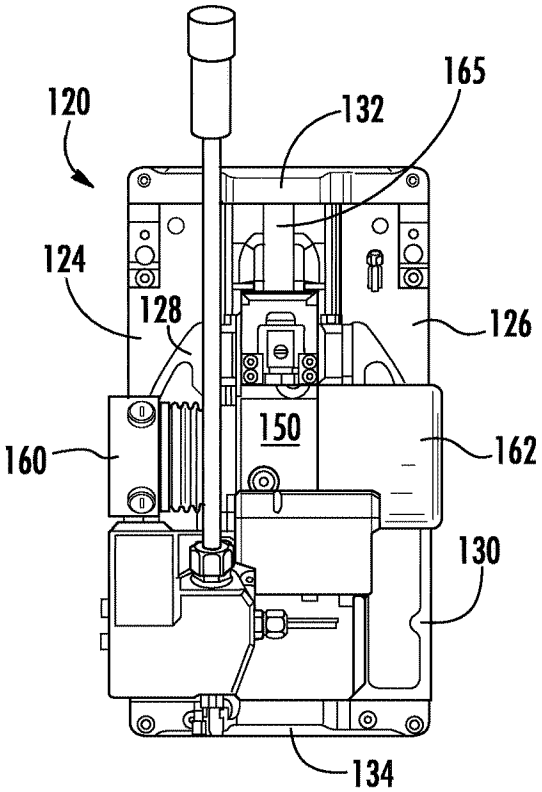

Specifically, the rod side 158 of each of the upper sliding guide member 124 and the upper sliding guide member 126 can be coupled to a course defining member 136. The course defining member 136 can be any object configured to cooperate with a bearing to constrain sliding motion such as, for example, a rail or the like. Linear bearings 138 can be coupled to the cylinder housing 122. The linear bearing 138 can interact with the course defining member 136 to constrain the motion of the upper sliding guide member 124 and the upper sliding guide member 126 to the upper course 140 (FIG. 10C).

Alternatively or additionally, the hydraulic actuator 120 can comprise the lower sliding guide member 128 and the lower sliding guide member 130. Each of the lower sliding guide member 128 and the lower sliding guide member 130 can be in sliding engagement with cylinder housing 122. In some embodiments, the lower sliding guide member 128 and the lower sliding guide member 130 can be configured to move in concert with the lower rod 265. Accordingly, the lower sliding guide member 128 and the lower sliding guide member 130 can be configured to provide transverse support to the lower rod 265 throughout an extending stroke, a returning stroke, or both of the lower rod 265.

Specifically, the piston end 152 of each of the lower sliding guide member 128 and the lower sliding guide member 130 can be coupled to a linear bearing 138. Course defining members 136 can be coupled to the cylinder housing 122. The linear bearings 138 of the lower sliding guide member 128 and the lower sliding guide member 130 can interact with the course defining members 136 to constrain the motion of the lower sliding guide member 128 and the lower sliding guide member 130 to the lower course 142 (FIG. 10C). In some embodiments, a bearing alignment portion 176 can be defined on the rod side 158 of each of the lower sliding guide member 128 and the lower sliding guide member 130 to provide clearance between the course defining members 136 and the rod side 158 of each of the lower sliding guide member 128 and the lower sliding guide member 130.

According to the embodiments described herein, the upper sliding guide member 124 and the upper sliding guide member 126 can travel along the upper course 140. The lower sliding guide member 128 and the lower sliding guide member 130 can travel along the lower course 142. In some embodiments, the upper course 140 and the lower course 142 can be offset. In further embodiments, the upper course 140 and the lower course 142 can be substantially parallel. In still further embodiments, the upper rod 165 can be substantially aligned with the lower course 142 and the lower rod 265 can be substantially aligned with the upper course 140. Accordingly, the upper rod 165 can be offset or substantially parallel with the upper course 140 and the lower rod 265 can be offset or substantially parallel with the lower course 142.

As is noted above, the upper sliding guide member 124 and the upper sliding guide member 126 can be configured to provide transverse support to the upper rod 165. In some embodiments, the hydraulic actuator 120 can comprise an upper transverse support platen 132 for adding additional rigidity with respect to transverse loading of the upper rod 165. Specifically, the upper transverse support platen 132 can be coupled to the platen end 154 of each of the upper sliding guide member 124 and the upper sliding guide member 126 and span the transverse distance there between. Additionally, the upper transverse support platen 132 can be coupled to the upper rod 165. For example, the upper rod 165 can be coupled to the upper transverse support platen 132 between the upper sliding guide member 124 and the upper sliding guide member 126 with respect to the transverse direction of the hydraulic actuator 120.

Similarly, in some embodiments, the hydraulic actuator 120 can comprise a lower transverse support platen 134 for adding additional rigidity with respect to transverse loading of the lower rod 265. For example, the lower transverse support platen 134 can be coupled to the platen end 154 of each of the lower sliding guide member 128 and the lower sliding guide member 130 and span the transverse distance there between. Additionally, the lower transverse support platen 134 can be coupled to the lower rod 265. As with the example above, the lower rod 265 can be coupled to the lower transverse support platen 134 between the lower sliding guide member 128 and the lower sliding guide member 130 with respect to the transverse direction of the hydraulic actuator 120.

Referring collectively to FIGS. 7-9C, the upper transverse support platen 132 and the lower transverse support platen 134 can form a portion of the leg linkage 82. Specifically, the upper transverse support platen 132 can form a portion of the link location 88 of the leg linkage 82. The lower transverse support platen 134 can form a portion of the link location 86 of the leg linkage 82. In some embodiments, each of the upper transverse support platen 132 and the lower transverse support platen 134 can be coupled to rotational couplings 80 that can comprise bearings for providing constrained rotational motion.

Referring collectively to FIGS. 8A-10C, in embodiments having the upper course 140 substantially parallel to the lower course 142, the upper rod 165 and the lower rod 265 can be retracted into an overlapping position. When in an overlapping position (FIGS. 10A-10C), the interface surface 172 of the upper sliding guide member 124 is aligned with and covers at least a portion of the interface surface 172 of the lower sliding guide member 128. Additionally, when in the overlapping position, the interface surface 172 of the upper sliding guide member 124 is aligned with and covers at least a portion of the interface surface 172 of the lower sliding guide member 128. In some embodiments, the amount of coverage can be proportional to the amount of retraction of the hydraulic actuator 120, i.e., the more the upper rod 165 and the lower rod 265 are retracted, the greater the amount of overlap. Furthermore, the amount of coverage can be inversely proportional to the amount of extension of the hydraulic actuator 120, i.e., the more the upper rod 165 and the lower rod 265 are extended, the lesser the amount of overlap. In some embodiments, when the hydraulic actuator 120 is fully extended (FIGS. 9A and 9B), the upper sliding guide members 124, 126 can have no overlap with the lower sliding guide members 128, 130.

In some embodiments, each of the transverse support platens 132, 134 can be formed into a shape that complements the protruding member 170 of the respective sliding guide member. In some embodiments, the protruding member 170 can form a joint with the one of the transverse support platens 132, 134 that is configured to resist transverse motion that separates respective sliding guide members from one another. Specifically, the protruding member 170 of each of the upper sliding guide member 124 and the upper sliding guide member 126 can be received within the upper transverse support platen 132 to form the joint. The joint can be resistant to transverse forces tending to separate the respective platen ends 154 of the upper sliding guide member 124 and the upper sliding guide member 126 apart. Such a joint can also be formed between the protruding member 170 of each of the lower sliding guide member 128 and the lower sliding guide member 130 and the lower transverse support platen 134.

The respective connections between the sliding guide members 124, 126, 128, 130 and the transverse support platens 132, 134 can be strengthened with wedge blocks 144. Specifically, each wedge block 144 can be substantially wedge shaped or shaped substantially like a right triangle. The wedge block 144 can have relatively large contact surfaces that are united by a sloping surface. The interface surface 172 of each of the sliding guide members 124, 126, 128, 130 can be coupled to one of the wedge blocks 144. The wedge blocks 144 can also be coupled to the transverse support platens 132, 134. Accordingly, the hydraulic actuator 120 can be substantially rigid and resist twisting or transverse motion during actuation. Additionally, it is noted that the sloping surface of the wedge blocks 144 can provide additional clearance for actuation of the hydraulic actuator 120.

Referring still to FIGS. 8A-10C, the hydraulic actuator 120 can comprise a hydraulic circuit housing 150 in fluid communication with the hydraulic actuator 120 for directing hydraulic fluid to the cylinder housing 122 to actuate the upper rod 165 and the lower rod 265. Additionally, the hydraulic circuit housing 150 can be in fluid communication with a pump motor 160 and a fluid reservoir 162 which can store a reserve amount of hydraulic fluid that can utilized when needed. The pump motor 160 can be configured to urge fluid throughout the hydraulic circuit housing 150 and the cylinder housing 122. In some embodiments, the hydraulic fluid can be urged to or from the fluid reservoir 162. The pump motor 160 can be any type of machine capable of directing hydraulic fluid throughout the cylinder housing 122 and the hydraulic circuit housing 150 such as, for example, an electric motor, or the like. In some embodiments, the pump motor 160 can be a brushed bi-rotational electric motor with a peak output of about 1400 watts.

The cylinder housing 122, the hydraulic circuit housing 150, the pump motor 160, and the fluid reservoir 162 can be assembled as a single unit. In some embodiments, the cylinder housing 122 can be coupled to the hydraulic circuit housing 150. The pump motor 160 and the fluid reservoir 162 can be coupled to the hydraulic circuit housing 150. When assembled as a single unit, the components of the hydraulic actuator 120 that move hydraulic fluid can be placed adjacent to one another.

Referring now to FIGS. 12A-12D, the cylinder housing 122 can comprise an upper cylinder 168 and a lower cylinder 268. An upper piston 164 can be confined within the upper cylinder 168 and configured to travel throughout the upper piston 164 when acted upon by hydraulic fluid. The upper rod 165 can be coupled to the upper piston 164 and move with the upper piston 164. The upper cylinder 168 can be in fluidic communication with a rod extending fluid path 312 and a rod retracting fluid path 322 on opposing sides of the upper piston 164. Accordingly, when the hydraulic fluid is supplied with greater pressure via the rod extending fluid path 312 than the rod retracting fluid path 322, the upper piston 164 can extend and can urge fluid out of the upper piston 164 via the rod retracting fluid path 322. When the hydraulic fluid is supplied with greater pressure via the rod retracting fluid path 322 than the rod extending fluid path 312, the upper piston 164 can retract and can urge fluid out of the upper piston 164 via the rod extending fluid path 312.

Similarly, a lower piston 264 can be confined within the lower cylinder 268 and can be configured to travel throughout the lower piston 264 when acted upon by hydraulic fluid. The lower rod 265 can be coupled to the lower piston 264 and move with the lower piston 264. The lower cylinder 268 can be in fluidic communication with a rod extending fluid path 314 and a rod retracting fluid path 324 on opposing sides of the lower piston 264. Accordingly, when the hydraulic fluid is supplied with greater pressure via the rod extending fluid path 314 than the rod retracting fluid path 324, the lower piston 264 can extend and can urge fluid out of the lower piston 264 via the rod retracting fluid path 324. When the hydraulic fluid is supplied with greater pressure via the rod retracting fluid path 324 than the rod extending fluid path 314, the lower piston 264 can retract and can urge fluid out of the lower piston 264 via the rod extending fluid path 314.

In some embodiments, the hydraulic actuator 120 actuates the upper rod 165 and the lower rod 265 in a self-balancing manner to allow the upper rod 165 and the lower rod 265 to extend and retract at different rates. It has been discovered by the applicants that the hydraulic actuator 120 can extend and retract with greater reliability and speed when the upper rod 165 and the lower rod 265 self-balance. Without being bound to theory, it is believed that the differential rate of actuation of the upper rod 165 and the lower rod 265 allows the hydraulic actuator 120 to respond dynamically to a variety of loading conditions. For example, the rod extending fluid path 312 and the rod extending fluid path 314 can be in direct fluid communication with one another without any pressure regulating device disposed there between. Similarly, the rod retracting fluid path 322 and the rod retracting fluid path 324 can be in direct fluid communication with one another without any pressure regulating device disposed there between. Accordingly, when hydraulic fluid is urged through the rod extending fluid path 312 and the rod extending fluid path 314, contemporaneously, the upper rod 165 and the lower rod 265 can extend differentially depending upon difference in the resistive forces acting upon each of the upper rod 165 and the lower rod 265 such as, for example, applied load, displaced volume, linkage motion, or the like. Similarly, when hydraulic fluid is urged through the rod retracting fluid path 322 and the rod retracting fluid path 324, contemporaneously, the upper rod 165 and the lower rod 265 can retract differentially depending upon the difference in resistive forces acting upon each the upper rod 165 and the lower rod 265.

Referring still to FIGS. 12A-12D, the hydraulic circuit housing 150 can form a hydraulic circuit 300 for transmitting fluid through the extending fluid path 310 and the retracting fluid path 320. In some embodiments, the hydraulic circuit 300 can be configured such that selective operation of the pump motor 160 can push or pull hydraulic fluid at each of the extending fluid path 310 and the retracting fluid path 320. Specifically, the pump motor 160 can be in fluidic communication with the fluid reservoir 162 via a fluid supply path 304. The pump motor 160 can also be in fluidic communication with the extending fluid path 310 via a pump extend fluid path 326 and the retracting fluid path 320 via a pump retract fluid path 316. Accordingly, the pump motor 160 can pull hydraulic fluid from the fluid reservoir 162 and urge the hydraulic fluid through the pump extend fluid path 326 or the pump retract fluid path 316 to extend or retract the hydraulic actuator 120. It is noted that, while the embodiments of the hydraulic circuit 300 described herein with respect to FIGS. 12A-12D detail the use of certain types of components such as solenoid valves, check valves, counter balance valves, manual valves, or flow regulators, the embodiments described herein are not restricted to the use of any particular component. Indeed the components described with respect to the hydraulic circuit 300 can be replaced with equivalents which in combination perform the function of the hydraulic circuit 300 described herein.

Figure 12A:
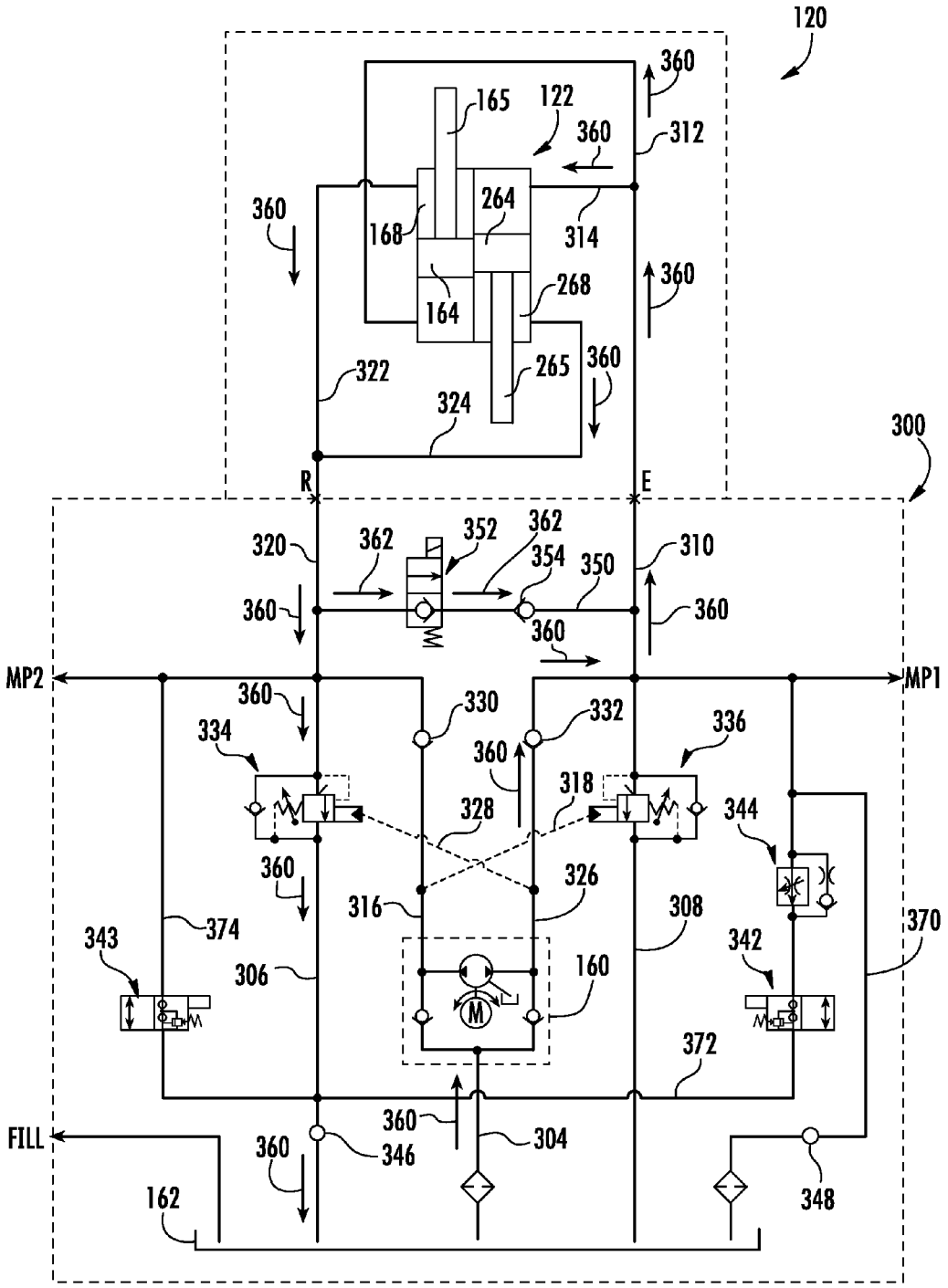
FIGS. 12A-12D schematically depict a hydraulic circuit according to one or more embodiments described herein.

Referring to FIG. 12A, the pump motor 160 can urge hydraulic fluid along the extending route 360 (generally indicated by arrows) to extend the upper rod 165 and the lower rod 265. In some embodiments, the extending fluid path 310 can be in fluid communication with the rod extending fluid path 312 and the rod extending fluid path 314. The retracting fluid path 320 can be in fluid communication with the rod retracting fluid path 322 and the rod retracting fluid path 324. The pump motor 160 can pull hydraulic fluid from the fluid reservoir 162 via the fluid supply path. Hydraulic fluid can be urged towards the extending fluid path 310 via the pump extend fluid path 326.

The pump extend fluid path 326 can comprise a check valve 332 that is configured to prevent hydraulic fluid from flowing from the extending fluid path 310 to the pump motor 160 and allow hydraulic fluid to flow from the pump motor 160 to the extending fluid path 310. Accordingly, the pump motor 160 can urge hydraulic fluid through the extending path into the rod extending fluid path 312 and the rod extending fluid path 314. Hydraulic fluid can flow along the extending route 360 into the upper cylinder 168 and the lower cylinder 268. Hydraulic fluid flowing into the upper cylinder 168 and the lower cylinder 268 can cause hydraulic fluid to flow into the rod retracting fluid path 322 and the rod retracting fluid path 324 as the upper rod 165 and the lower rod 265 extend. Hydraulic fluid can then flow along the extending route 360 into the retracting fluid path 320.

The hydraulic circuit 300 can further comprise an extending return fluid path 306 in fluidic communication with each of the retracting fluid path 320 and the fluid reservoir 162. In some embodiments, the extending return fluid path 306 can comprise a counterbalance valve 334 configured to allow hydraulic fluid to flow from the fluid reservoir 162 to the retracting fluid path 320, and prevent hydraulic fluid from flowing from the retracting fluid path 320 to the fluid reservoir 162, unless an appropriate pressure is received via a pilot line 328. The pilot line 328 can be in fluidic communication with both the pump extend fluid path 326 and the counterbalance valve 334. Accordingly, when the pump motor 160 pumps hydraulic fluid through pump extend fluid path 326, the pilot line 328 can cause the counterbalance valve 334 to modulate and allow hydraulic fluid to flow from the retracting fluid path 320 to the fluid reservoir 162.

Optionally, the extending return fluid path 306 can comprise a check valve 346 that is configured to prevent hydraulic fluid from flowing from the fluid reservoir 162 to the retracting fluid path 320 and allow hydraulic fluid to flow from the extending return fluid path 306 to the fluid reservoir 162. Accordingly, the pump motor 160 can urge hydraulic fluid through the retracting fluid path 320 to the fluid reservoir 162. In some embodiments, a relatively large amount of pressure can be required to open the check valve 332 compared to the relatively low amount of pressure required to open the check valve 346. In further embodiments, the relatively large amount of pressure required to open the check valve 332 can be more than about double the relatively low amount of pressure required to open the check valve 346 such as, for example, about 3 times the pressure or more in another embodiment, or about 5 times the pressure or more in yet another embodiment.

In some embodiments, the hydraulic circuit 300 can further comprise a regeneration fluid path 350 that is configured to allow hydraulic fluid to flow directly from the retracting fluid path 320 to the extending fluid path 310. Accordingly, the regeneration fluid path 350 can allow hydraulic fluid supplied from the rod retracting fluid path 322 and the rod retracting fluid path 324 to flow along a regeneration route 362 towards the rod extending fluid path 312 and the rod extending fluid path 314. In further embodiments, the regeneration fluid path 350 can comprise a logical valve 352 that is configured to selectively allow hydraulic fluid to travel along the regeneration route 362. The logical valve 352 can be communicatively coupled to a processor or sensor and configured to open when the self-actuating cot is in a predetermined state. For example, when the hydraulic actuator 120 is associated with a leg that is detected as being in a second position, which, as described herein, can indicate an unloaded state, the logical valve 352 can be opened. It can be desirable to open the logical valve 352 during the extension of the hydraulic actuator 120 to increase the speed of extension. The regeneration fluid path 350 can further comprise a check valve 354 that is configured to prevent hydraulic fluid from flowing from the retracting fluid path 320 to the extending fluid path 310. In some embodiments, the amount of pressure required to open the check valve 332 is about the same as the amount of pressure required to open the check valve 354.

Figure 12B:
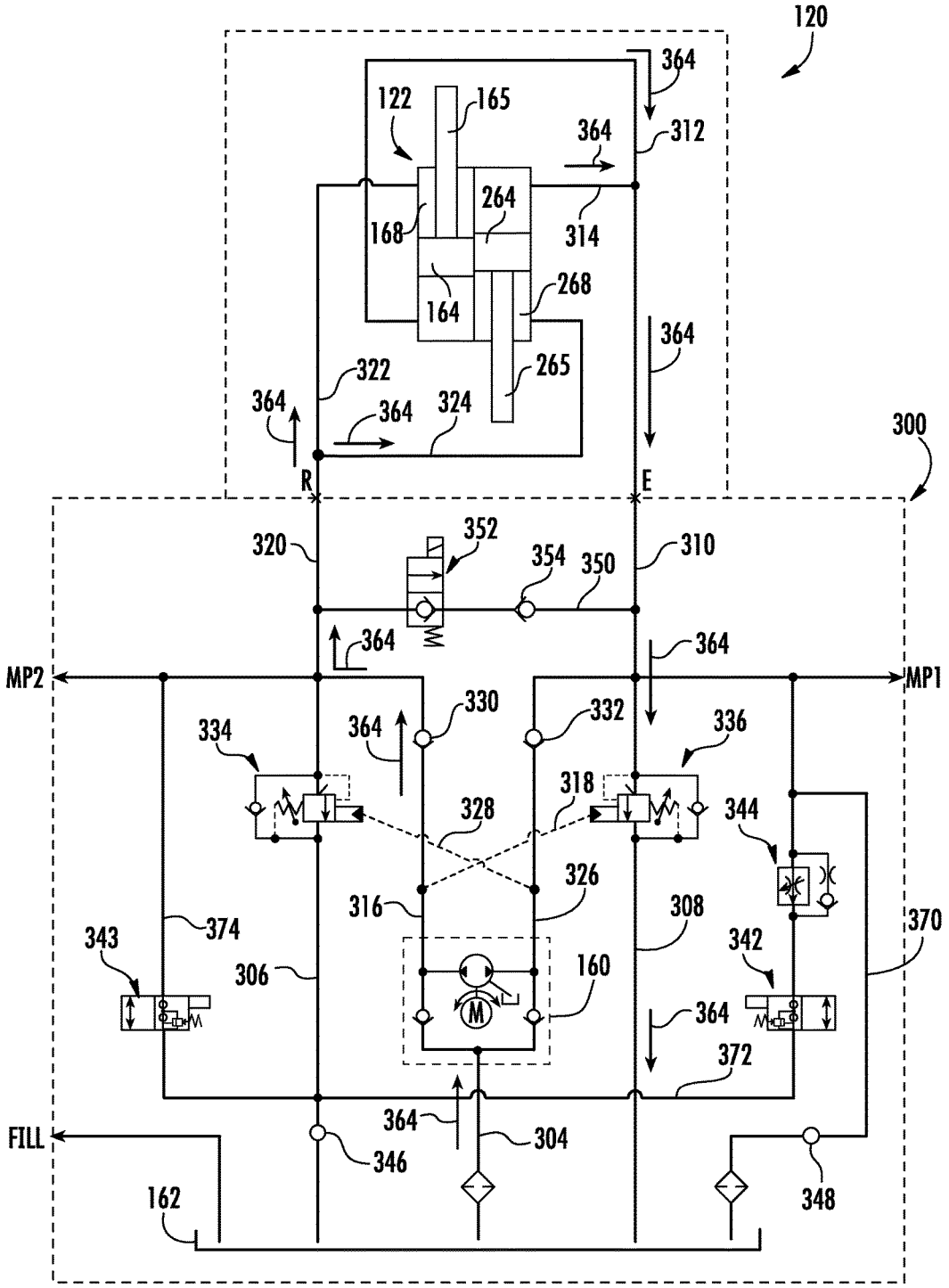

Referring to FIG. 12B, the pump motor 160 can urge hydraulic fluid along the retracting route 364 (generally indicated by arrows) to retract the upper rod 165 and the lower rod 265. The pump motor 160 can pull hydraulic fluid from the fluid reservoir 162 via the fluid supply path 304. Hydraulic fluid can be urged towards the retracting fluid path 320 via the pump retract fluid path 316. The pump retract fluid path 316 can comprise a check valve 330 that is configured to prevent hydraulic fluid from flowing from the retracting fluid path 320 to the pump motor 160 and allow hydraulic fluid to flow from the pump motor 160 to the retracting fluid path 320. Accordingly, the pump motor 160 can urge hydraulic fluid through the retracting fluid path 320 into the rod retracting fluid path 322 and the rod retracting fluid path 324.

Hydraulic fluid can flow along the retracting route 364 into the upper cylinder 168 and the lower cylinder 268. Hydraulic fluid flowing into the upper cylinder 168 and the lower cylinder 268 can cause hydraulic fluid to flow into the rod extending fluid path 312 and the rod extending fluid path 314 as the upper rod 165 and the lower rod 265 retract. Hydraulic fluid can then flow along the retracting route 364 into the extending fluid path 310.

The hydraulic circuit 300 can further comprise a retracting return fluid path 308 in fluidic communication with each of the extending fluid path 310 and the fluid reservoir 162. In some embodiments, the retracting return fluid path 308 can comprise a counterbalance valve 336 configured to allow hydraulic fluid to flow from the fluid reservoir 162 to the extending fluid path 310, and prevent hydraulic fluid from flowing from the extending fluid path 310 to the fluid reservoir 162, unless an appropriate pressure is received via a pilot line 318. The pilot line 318 can be in fluidic communication with both the pump retract fluid path 316 and the counterbalance valve 336. Accordingly, when the pump motor 160 pumps hydraulic fluid through the pump retract fluid path 316, the pilot line 318 can cause the counterbalance valve 336 to modulate and allow hydraulic fluid to flow from the extending fluid path 310 to the fluid reservoir 162.

Referring collectively to FIGS. 12A-12D, while the hydraulic actuator 120 is typically powered by the pump motor 160, the hydraulic actuator 120 can be actuated manually after bypassing the pump motor 160. Specifically, the hydraulic circuit 300 can comprise a manual supply fluid path 370, a manual retract return fluid path 372, and a manual extend return fluid path 374. The manual supply fluid path 370 can be configured for supplying fluid to the upper cylinder 168 and the lower cylinder 268. In some embodiments, the manual supply fluid path 370 can be in fluidic communication with the fluid reservoir 162 and the extending fluid path 310. In further embodiments, the manual supply fluid path 370 can comprise a check valve 348 that is configured to prevent hydraulic fluid from flowing from the manual supply fluid path 370 to the fluid reservoir 162 and allow hydraulic fluid to flow from the fluid reservoir 162 to the extending fluid path 310. Accordingly, manual manipulation of the upper piston 164 and the lower piston 264 can cause hydraulic fluid to flow through the check valve 348. In some embodiments, a relatively low amount of pressure can be required to open the check valve 348 compared to a relatively large amount of pressure required to open the check valve 346. In further embodiments, the relatively low amount of pressure required to open the check valve 348 can be less than or equal to about ½ of the relatively large amount of pressure required to open the check valve 346 such as, for example, less than or equal to about ⅕ in another embodiment, or less than or equal to about 1/10 in yet another embodiment.

The manual retract return fluid path 372 can be configured to return hydraulic fluid from the upper cylinder and the lower cylinder 268 to the fluid reservoir 162, back to the upper cylinder 168 and the lower cylinder 268, or both. In some embodiments, the manual retract return fluid path 372 can be in fluidic communication with the extending fluid path 310 and the extending return fluid path 306. The manual retract return fluid path 372 can comprise a manual valve 342 that can be actuated from a normally closed position to an open position and a flow regulator 344 configured to limit the amount of hydraulic fluid that can flow through the manual retract return fluid path 372, i.e., volume per unit time. Accordingly, the flow regulator 344 can be utilized to provide a controlled descent of the self-actuating cot 10. It is noted that, while the flow regulator 344 is depicted in FIGS. 12A-12D as being located between the manual valve 342 and the extending fluid path 310, the flow regulator 344 can be located in any position throughout the hydraulic circuit 300 suitable for limiting the rate the upper rod 165, the lower rod 265, or both can retract.

The manual extend return fluid path 374 can be configured to return hydraulic fluid from the upper cylinder 168 and the lower cylinder 268 to the fluid reservoir 162, back to the upper cylinder 168 and the lower cylinder 268, or both. In some embodiments, the manual extend return fluid path 374 can be in fluidic communication with the retracting fluid path 320, the manual retract return fluid path 372 and the extending return fluid path 306. The manual extend return fluid path 374 can comprise a manual valve 343 that can be actuated from a normally closed position to an open position.

In some embodiments, the hydraulic circuit 300 can also comprise a manual release component (e.g., a button, tension member, switch, linkage or lever) that actuates the manual valve 342 and manual valve 343 to allow the upper rod 165 and the lower rod 265 to extend and retract without the use of the pump motor 160. Referring to the embodiments of FIG. 12C, the manual valve 342 and the manual valve 343 can be opened, e.g., via the manual release component. A force can act upon the hydraulic circuit 300 to extend the upper rod 165 and the lower rod 265 such as, for example, gravity or manual articulation of the upper rod 165 and the lower rod 265. With the manual valve 342 and the manual valve 343 opened, hydraulic fluid can flow along the manual extend route 366 to facilitate extension of the upper rod 165 and the lower rod 265. Specifically, as the upper rod 165 and the lower rod 265 are extended hydraulic fluid can be displaced from the upper cylinder 168 and the lower cylinder 268 into the rod retracting fluid path 322 and the rod retracting fluid path 324. Hydraulic fluid can travel from the rod retracting fluid path 322 and the rod retracting fluid path 324 into the retracting fluid path 320.

Hydraulic fluid can also travel through the manual extend return fluid path 374 towards the extending return fluid path 306 and the manual retract return fluid path 372. Depending upon the rate of extension of the upper rod 165 and the lower rod 265, or applied force, hydraulic fluid can flow through the extending return fluid path 306, beyond the check valve 346 and into the fluid reservoir 162. Hydraulic fluid can also flow through the manual retract return fluid path 372 towards the extending fluid path 310. Hydraulic fluid can also be supplied from the fluid reservoir 162 via the manual supply fluid path 370 to the extending fluid path 310, i.e., when the manual operation generates sufficient pressure for the hydraulic fluid to flow beyond check valve 348. Hydraulic fluid at the extending fluid path 310 can flow to the rod extending fluid path 312 and the rod extending fluid path 314. The manual extension of the upper rod 165 and the lower rod 265 can cause hydraulic fluid to flow into the upper cylinder 168 and the lower cylinder 268 from the rod extending fluid path 312 and the rod extending fluid path 314.

Referring again to FIG. 12D, when the manual valve 342 and the manual valve 343 are opened, hydraulic fluid can flow along the manual retract route 368 to facilitate retraction of the upper rod 165 and the lower rod 265. Specifically, as the upper rod 165 and the lower rod 265 are retracted, hydraulic fluid can be displaced from the upper cylinder 168 and the lower cylinder 268 into the rod extending fluid path 312 and the rod extending fluid path 314. Hydraulic fluid can travel from the rod extending fluid path 312 and the rod extending fluid path 314 into the extending fluid path 310.

Hydraulic fluid can also travel through the manual retract return fluid path 372 towards the flow regulator 344, which operates to limit the rate at which the hydraulic fluid can flow and the rate at which the upper rod 165 and the lower rod 265 can retract. Hydraulic fluid can then flow towards the manual extend return fluid path 374. The hydraulic fluid can then flow through the manual extend return fluid path 374 and into the retracting fluid path 320. Depending upon the rate of retraction of the upper rod 165 and the lower rod 265 and the permissible flow rate of the flow regulator 344, some hydraulic fluid may leak beyond the check valve 346 and into the fluid reservoir 162. In some embodiments, the rate of permissible flow rate of the flow regulator 344 and the opening pressure of the check valve 346 can be configured to substantially prevent hydraulic fluid from flowing beyond the check valve 346 during manual retraction. It has been discovered by the applicants that prohibiting flow beyond the check valve 346 can ensure that the upper cylinder 168 and the lower cylinder 268 remain primed with reduced air infiltration during manual retraction.

Figure 12C:
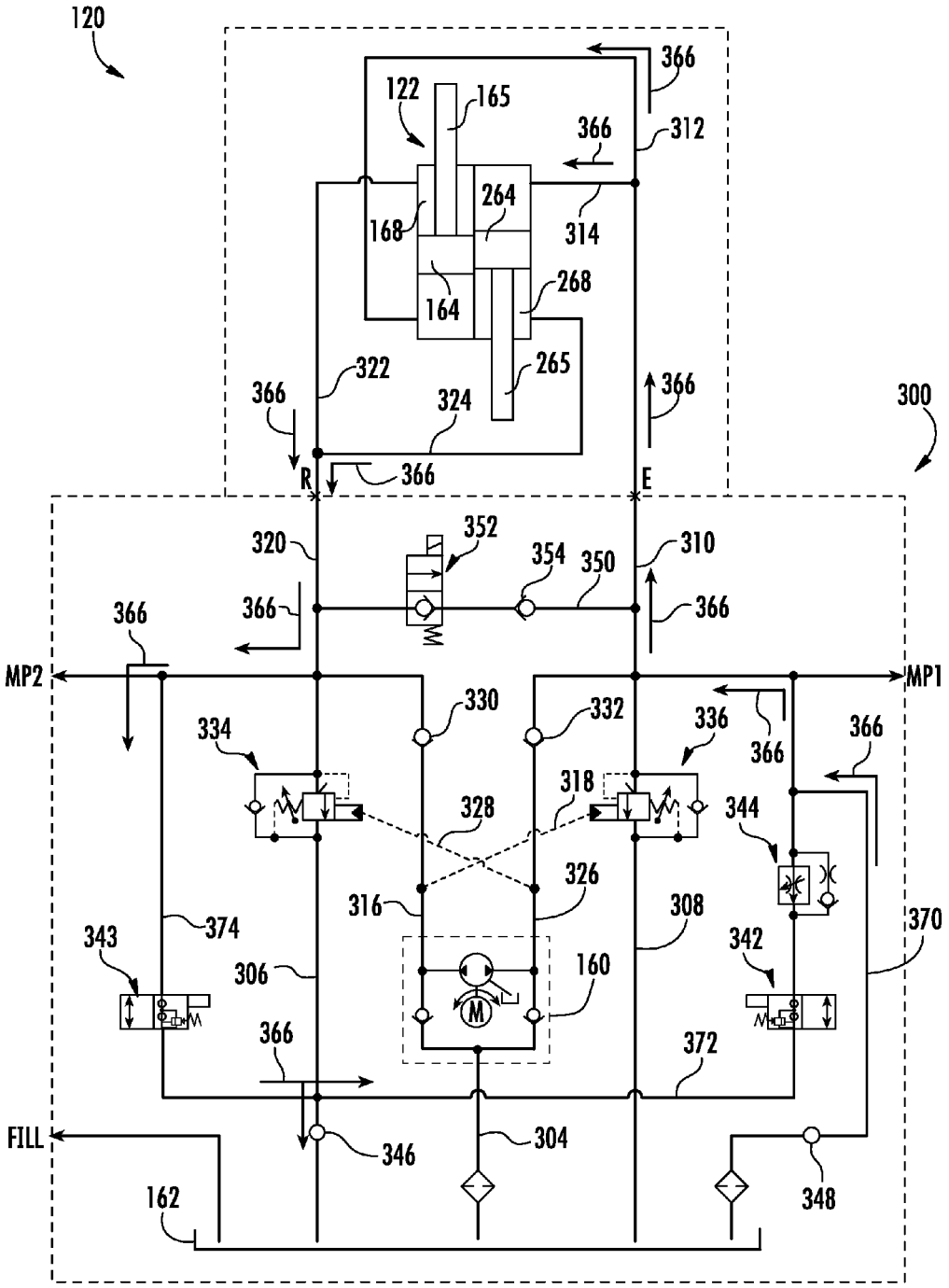
Figure 12D:
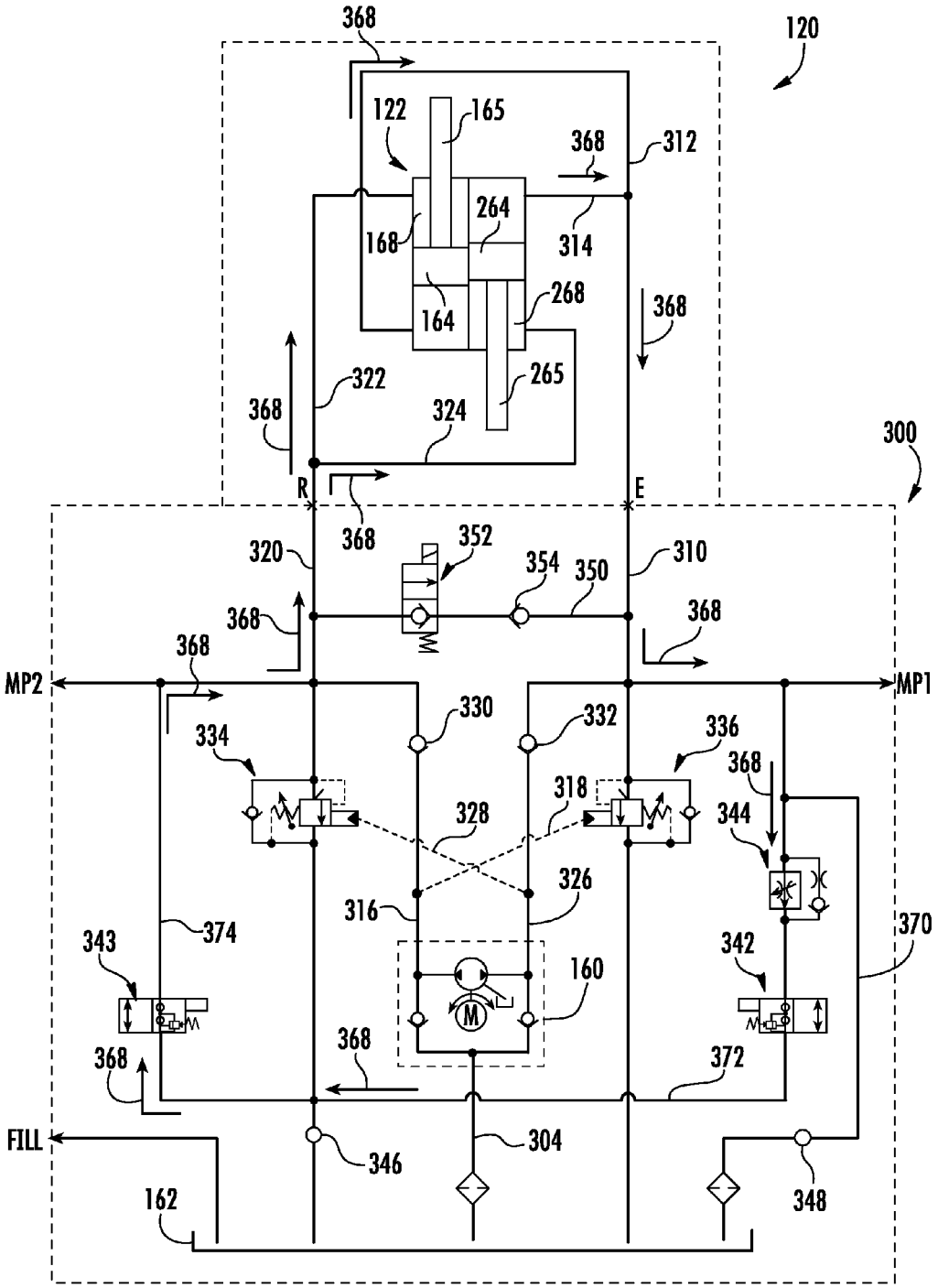

Hydraulic fluid at the retracting fluid path 320 can flow to the rod retracting fluid path 322 and the rod retracting fluid path 324. The manual retraction of the upper rod 165 and the lower rod 265 can cause hydraulic fluid to flow into the upper cylinder 168 and the lower cylinder 268 from the rod retracting fluid path 322 and the rod retracting fluid path 324. It is noted that, while the manual embodiments described with respect to FIGS. 12C and 12D depict extension and retraction as separate operations, it is contemplated that manual extension and manual retraction can be performed within a single operation. For example, upon opening the manual valve 342 and the manual valve 343, the upper rod 165 and the lower rod 265 can extend, retract, or both sequentially in response to an applied force.

Referring collectively to FIGS. 13-18, as is noted above the back actuator 18 and the front actuator 16 may each include a leg actuation system 420. The leg actuation system 420 may include a telescoping hydraulic cylinder 424 having a cylinder housing 122 and a piston 465 that extends and retracts relative to the cylinder housing 122, and a carriage 430. The cylinder housing 122 defines a cylindrical opening within which the piston 465 translates when pressurized hydraulic fluid is delivered to the cylinder housing 122. As conventionally known, the pressurized hydraulic fluid is directed at an elevated pressure to one side of the piston 465 at a time. The magnitude of the pressure of the hydraulic fluid and the diameter of the piston 465 is proportional to the force applied to the piston 465 and the extension or retraction speed of the piston 465 relative to the cylinder housing 122. The direction of the application of pressure that is applied to the piston 465 may be reversed to reverse the direction of translation of the piston 465 relative to the cylinder housing 122.

The leg actuation system 420 includes a carriage 430 that is coupled to one of the back leg 40 at link location 86 or is in fixed and rotatable engagement with the support frame 12, as schematically depicted in FIG. 7. The carriage 430 is also coupled to the cylinder housing 122 and the piston 465 of the telescoping hydraulic cylinder 424. In the embodiment depicted in FIGS. 13-18, the carriage 430 amplifies the translation of the leg actuation system 420 relative to the telescoping hydraulic cylinder 424, such that the extension distance of the leg actuation system 420 by the carriage 430 is greater than the stroke distance of the piston 465 relative to the cylinder housing 122. The carriage 430 also distributes the load away from the being solely transferred along the telescoping hydraulic cylinder 424, such that the load applied to the leg actuation system 420 is distributed at positions across the width of the cot 10. Distributing the load across the width of the cot 10 may reduce tendency of the cot 10 to twist when an uneven load is applied to the support frame 12, particularly when the support frame 12 is in an elevated position.

Figure 13:
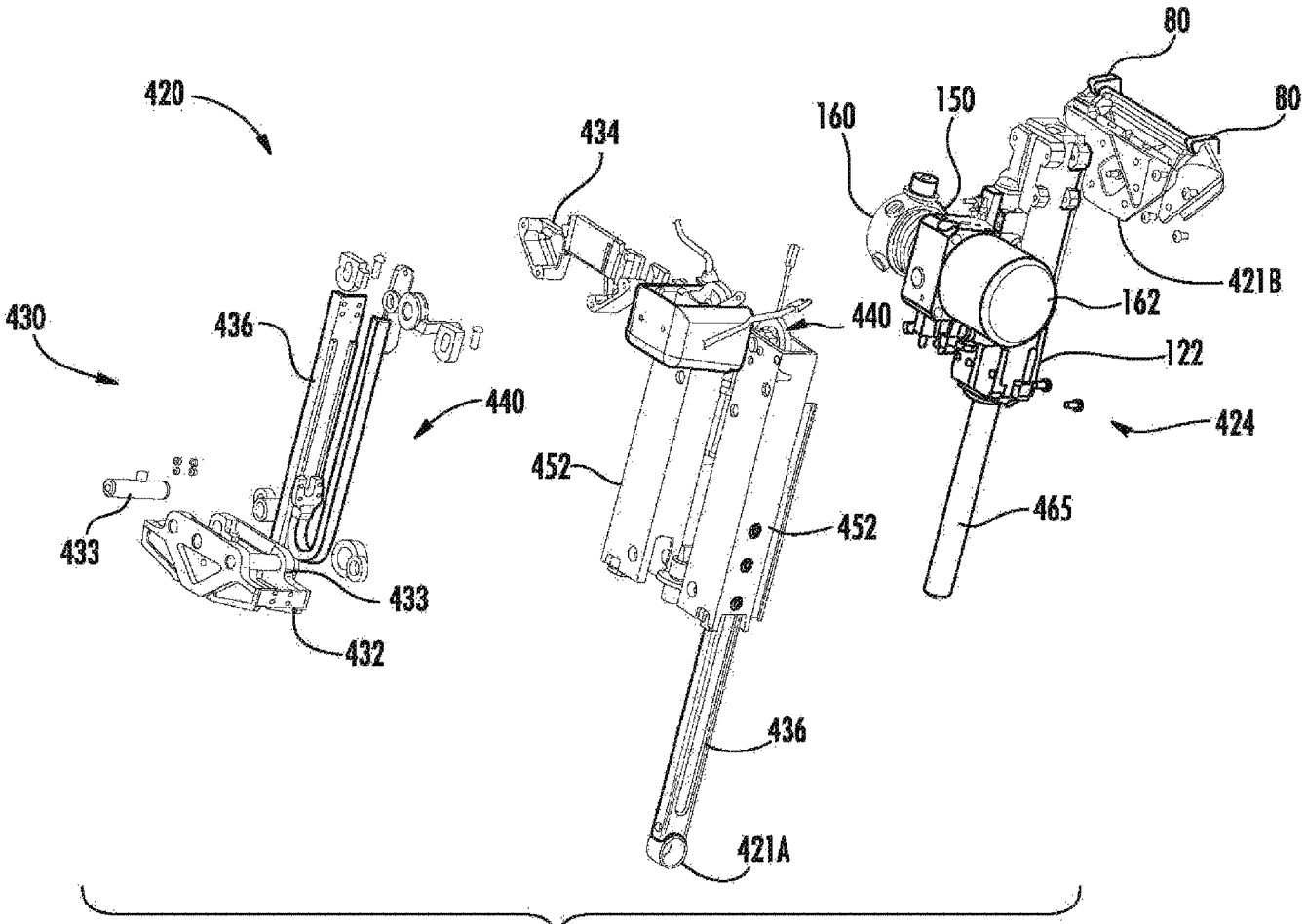
FIG. 13 schematically depicts an exploded view of a hydraulic actuator according to one or more embodiments described herein.

The carriage 430 includes components that extend and retract upon translation of the piston 465 in the cylinder housing 122. Components of the carriage 430 increase the extension of the leg actuation system 420 beyond the stroke of the piston 465 in the cylinder housing 122. The carriage 430 includes a transmission assembly 440 that is coupled to the telescoping hydraulic cylinder 424 and amplification rails 436. The amplification rails 436 translate from the carriage 430 housing a distance that is proportional to the distance the piston 465 translates along the cylinder housing 122. As depicted in detail in FIGS. 15A-15B, the transmission assembly 440 includes two pairs of pinions 448A, 448B that are held in a generally fixed position relative to one another in sidewall enclosures 452 (as depicted in FIGS. 13-14D). A force transmission member 442, for example, a chain, a threaded member, a belt, or the like, is engaged around the pairs of pinions 448A, 448B such that the rotation of the pinions 448A, 448B in the pair is synchronized.

Each of the pinions 448A, 448B in the pair are supported by support structure that maintains the relative positioning between the pairs of pinions 448A, 448B, translates with respect to the cylinder housing 122, and induces translation of the amplification rails 436. In the embodiment depicted in FIGS. 13-18, the support structure includes a lower yoke 432 and an upper yoke 434. Each of the lower yoke 432 and the upper yoke 434 include bearing surfaces 433 to which the pinions 448A, 448B are coupled. The pinions 448A, 448B are adapted to rotate about the bearing surfaces 433 of the lower yoke 432 and the upper yoke 434. The lower yoke 432 and the upper yoke 434 are coupled to one another by the support structure, in the depicted embodiment, the sidewall enclosures 452. The sidewall enclosures 452 are rigidly coupled to the lower yoke 432 and the upper yoke 434, thereby maintaining the relative positioning of the lower yoke 432 and the upper yoke 434, and therefore maintaining the spacing between the pinions 448A, 448B coupled to the bearing surfaces 433 of the lower yoke 432 and the upper yoke 434. In the depicted embodiment, the lower yoke 432 is coupled to the piston 465. Translation of the piston 465 relative to the cylinder housing 122 causes equivalent translation of the lower yoke 432 relative to the cylinder housing 122. The lower yoke 432 may be fastened to the piston 465 to minimize translational and rotational misalignment between the lower yoke 432 and the piston 465.

Figure 14B:
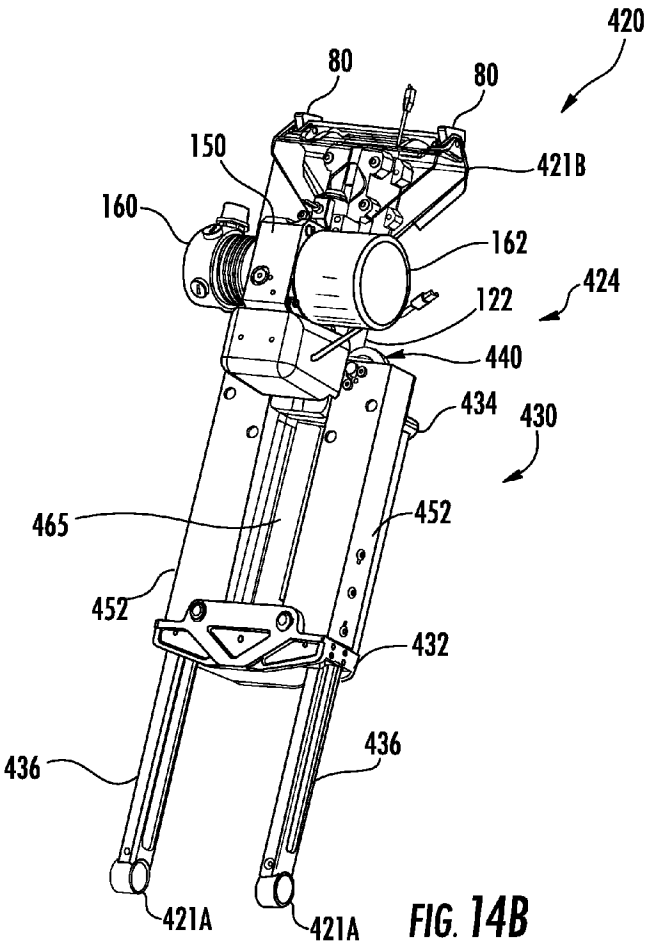
FIGS. 14A-14D schematically depict front and back perspective views of a hydraulic actuator in an extended state and a retracted state according to one or more embodiments described herein.
Figure 14A:
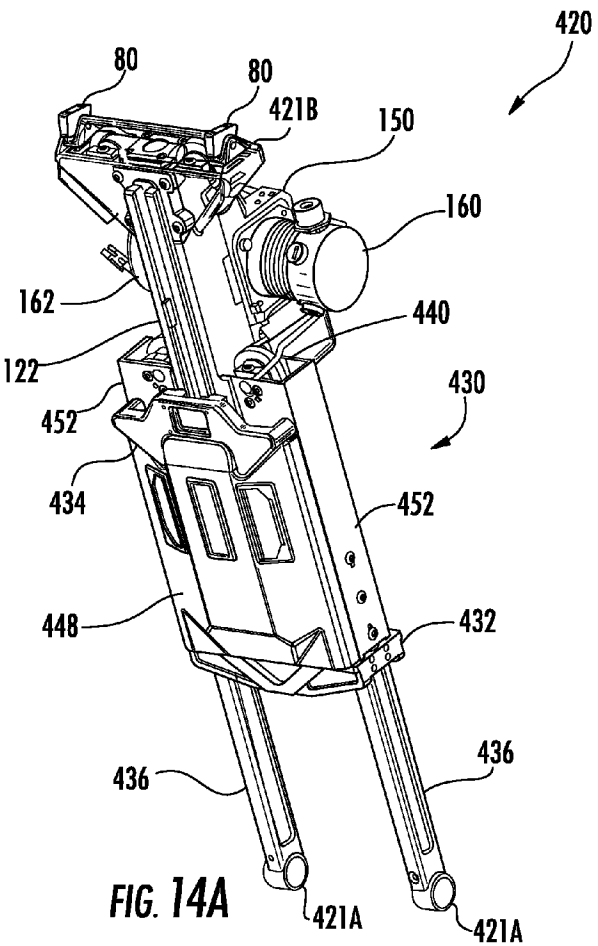
Figure 14D:
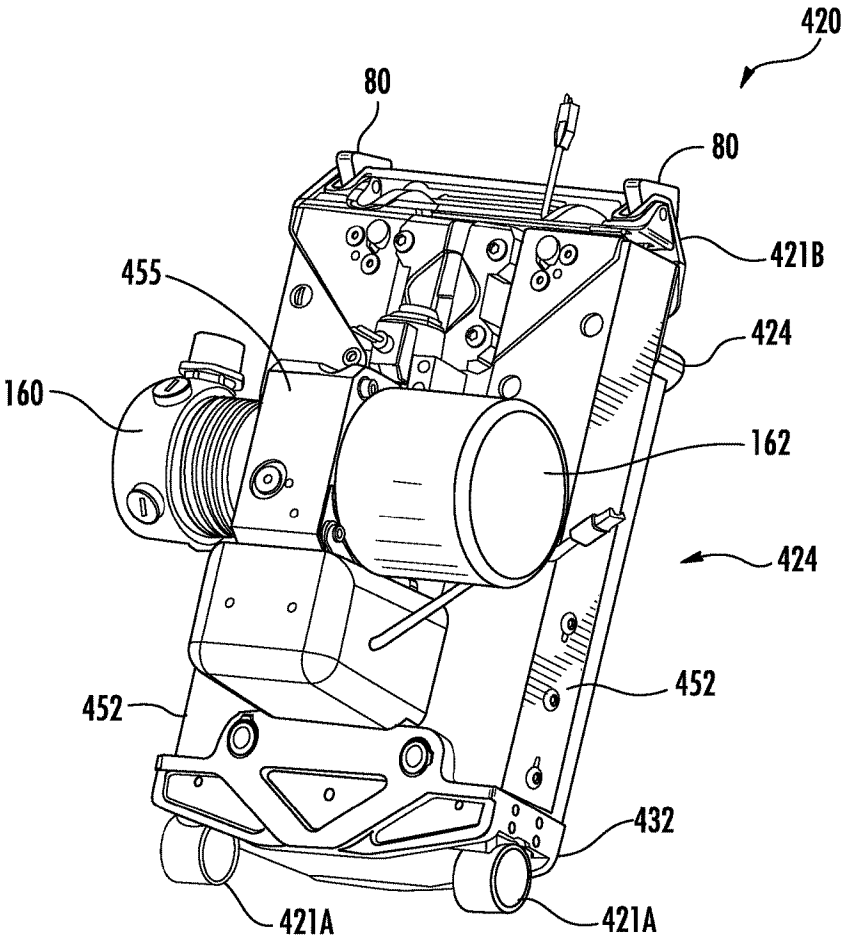
Figure 14C:
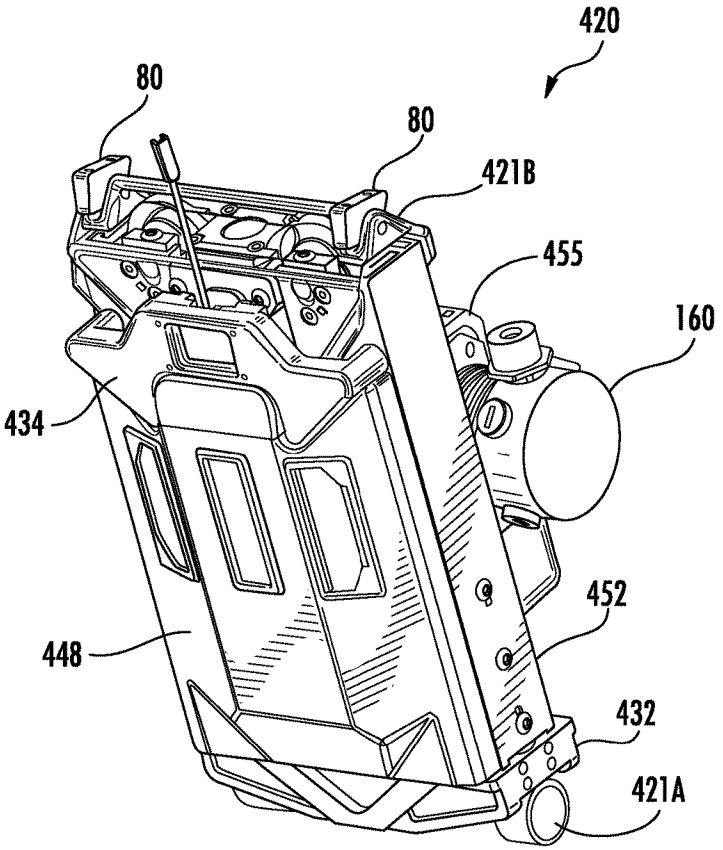
Figure 15B:
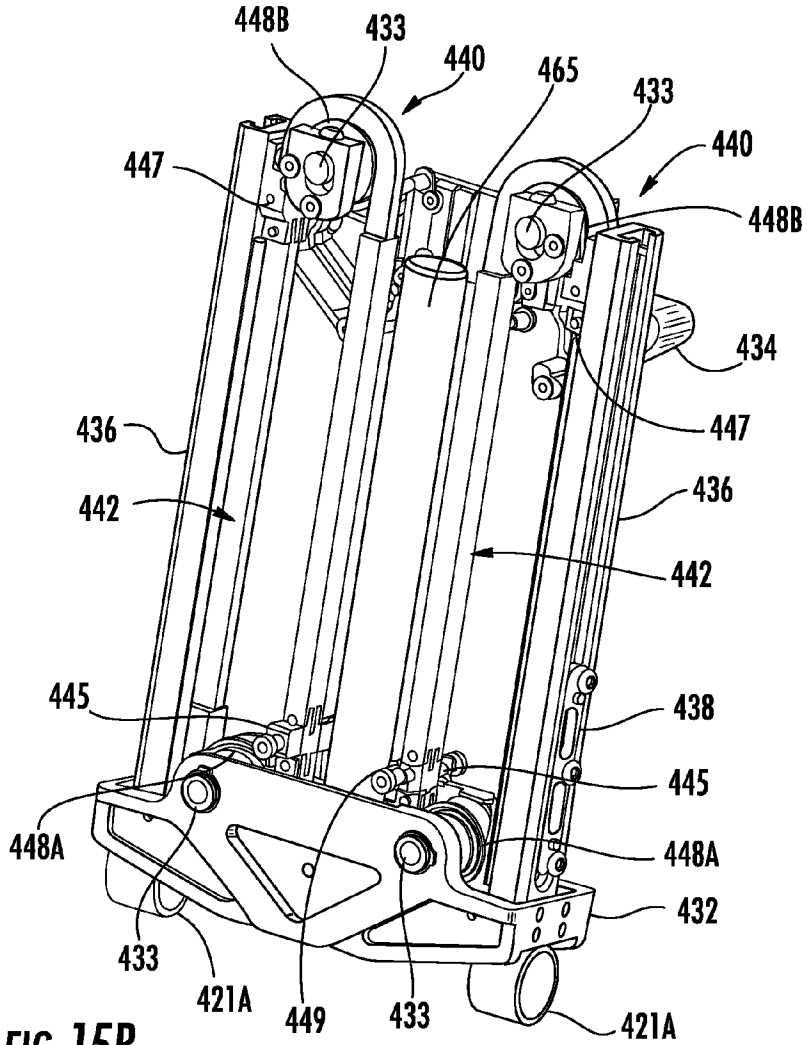
FIGS. 15A-15B schematically depict detailed front isometric views of the hydraulic actuator of FIGS. 14A-14D in an extended state and a retracted state according to one or more embodiments described herein.
Figure 15A:
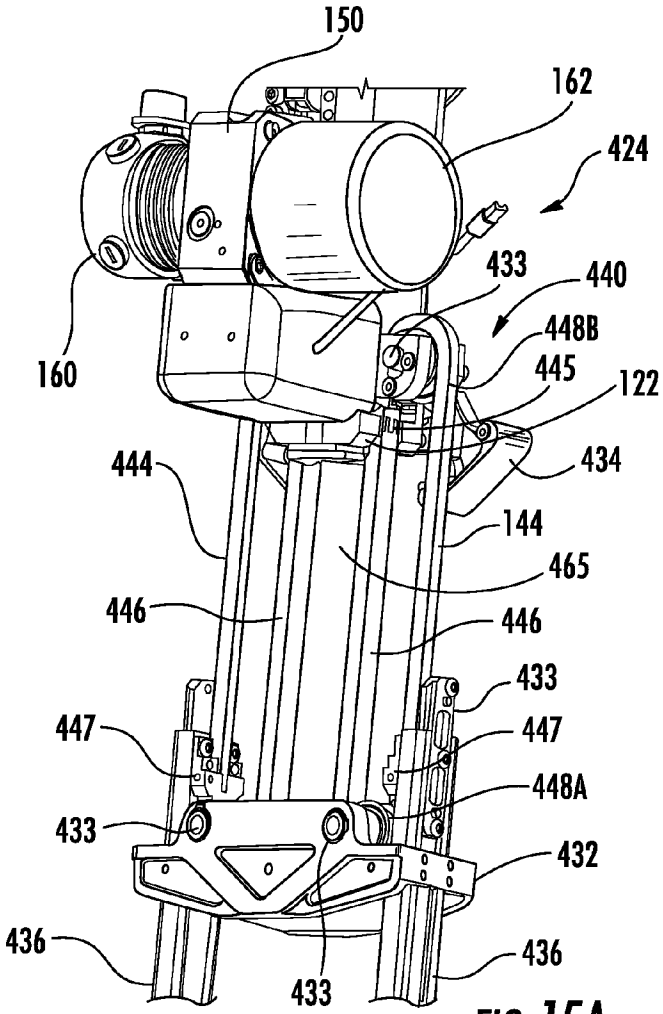
Figure 16:
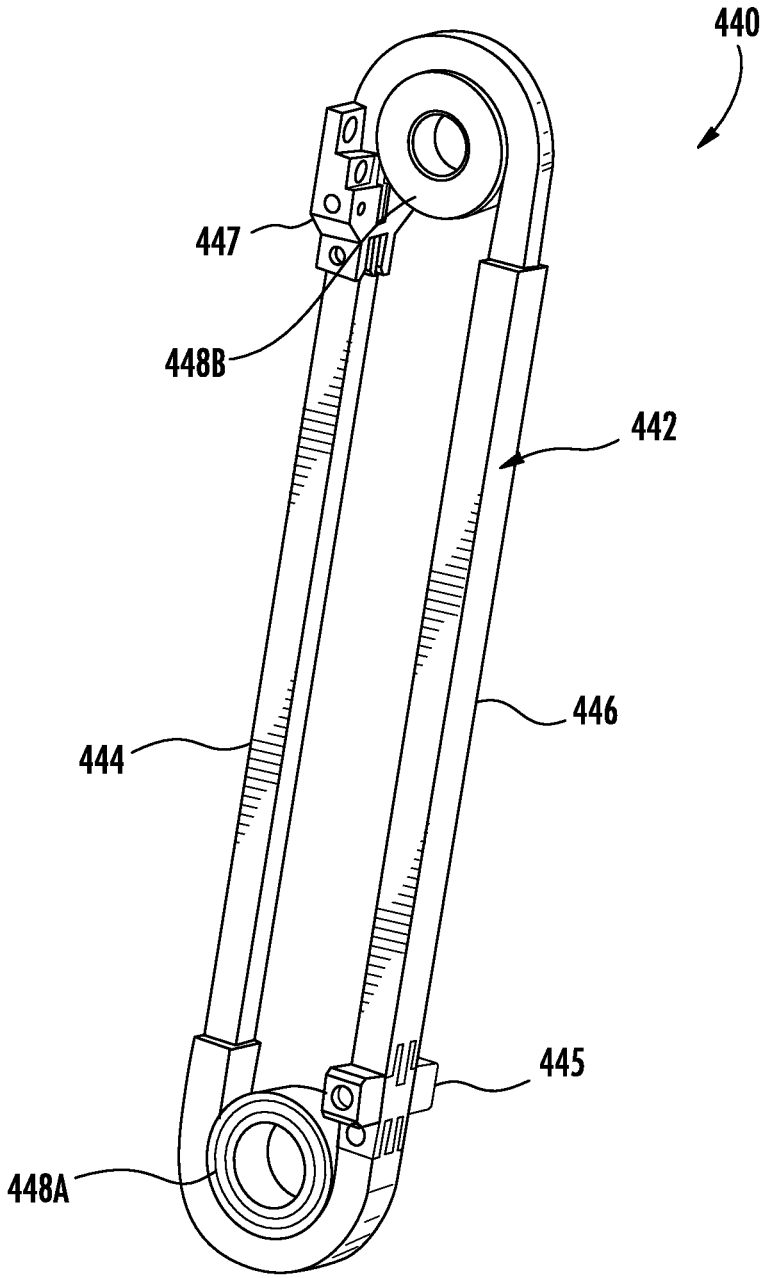
FIG. 16 schematically depicts a perspective view of a transmission assembly according to one or more embodiments described herein.

In the embodiment depicted in FIGS. 13-18, the transmission assembly 440 includes a force transmission member 442 that is engaged around a pair of pinions 448A, 448B. The force transmission member 442, which is depicted in FIGS. 13-18 as a chain, is coupled to upper yoke 434, so that a portion of the force transmission member 442 is secured in position relative to the cylinder housing 122. As depicted in FIGS. 15A-16, the force transmission member 442 is coupled to the cylinder housing 122 with an intermediate link 445. The intermediate link 445 is coupled to the cylinder housing 122 with a plurality of fasteners that limit the translation of the intermediate link 445 relative to the cylinder housing 122. The force transmission member 442 is also coupled to one of the amplification rails 436. In the depicted embodiment, a force application link 447 integrated into the force transmission member 442 is coupled to the amplification rail 436. The force application link 447 is coupled to the amplification rail 436 so that the relative position between the force application link 447 and the amplification rail 436 are held constant.

The force transmission member 442 of the embodiment depicted in FIGS. 15A-16 may be defined into two portions: a compression portion 446 that is generally loaded when the legs 20, 40 of the cot 10 are in compression and a tension portion 444 that is generally loaded with the legs 20, 40 of the cot 10 are in tension. When a load is applied to the cot 10, for example, when a patient is positioned on the cot 10, the legs 20, 40 of the cot 10 are generally in compression, thereby applying a load to the compression portion 446 of the force transmission member 442. When load is off of the legs 20, 40, for example, when the legs 20, 40 are suspended off of the ground and the legs 20, 40 are undergoing a retraction operation, the load of the legs 20, 40 is applied to the tension portion 444 of the force transmission member 442. In the depicted embodiment, the compression portion 446 of the force transmission member 442 is positioned along the portions of the force transmission member 442 that are proximate to the intermediate link 445, which is coupled to the cylinder housing 122. The tension portion 444 of the force transmission member 442 is positioned along the portions of the force transmission member 442 that are spaced apart from the intermediate link 445 and are positioned proximate to the force application link 447, which is coupled to the amplification rail 436.

In some embodiments, the carriage 430 may also include a force-direction switch 449 that provides an electrical signal indicative of the direction of force applied to the force transmission member 442. In one embodiment, one of the intermediate link 445 or the force application link 447 may be coupled to the surrounding structure (i.e., the cylinder housing 122 or the sidewall enclosures 452, respectively) in a shuffle configuration that allows the intermediate link 445 or the force application link 447 to translate within a limited range of motion. The intermediate link 445 or the force application link 447 moves in a pre-determined direction based on the direction of force applied to the legs 20, 40 of the cot 10, and therefore to the force transmission member 442. Translating through the range of motion, the intermediate link 445 or the force application link 447 may actuate a switch, which is electrically coupled to a control box 50, as discussed in greater detail below. The force-direction switch 449 may be used to determine the operating scheme in which the leg actuation system 420 operates.

Referring now to FIGS. 14A and 14C, the leg actuation system 420 may include one or more covers 448 for protecting the motive portions of the leg actuation system 420 from dirt and debris infiltration. In some embodiments, the covers 448 may incorporate illumination so that areas of the cot 10 that are otherwise shielded are visible. The cover 448 may include an illumination system available from GROTE of Madison, Ind., USA. The leg actuation system 420 may include a variety of shielding devices to protect electrical leads and hydraulic fittings of the leg actuation system 420 from coming into undesired contact during operation. Accordingly, such shielding devices may prevent damage to electrical and hydraulic components throughout the operating range of the leg actuation system 420.

Figure 17:
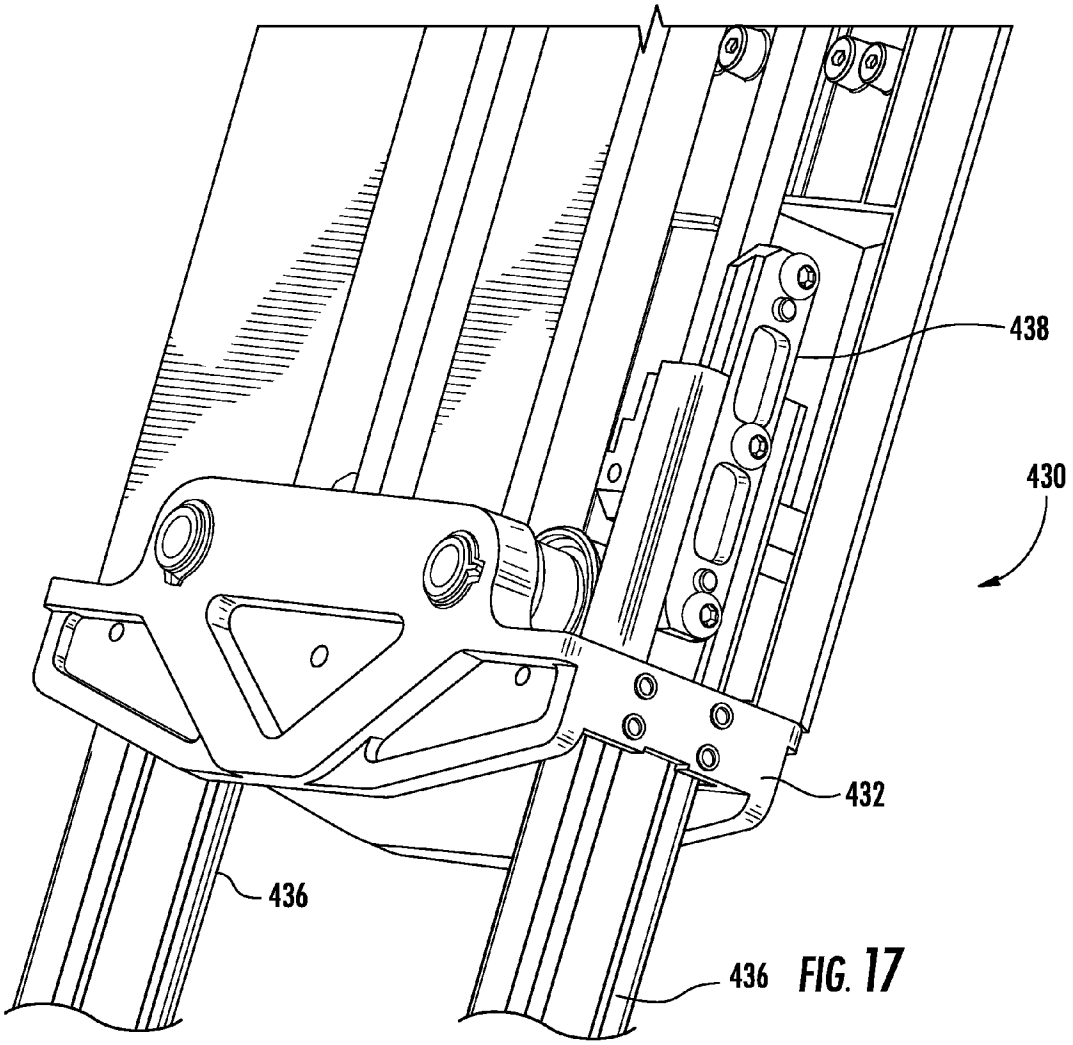
FIG. 17 schematically depicts a front isometric views of the hydraulic actuator of FIGS. 14A-14D according to one or more embodiments described herein.

Referring now to FIG. 17, in the depicted embodiment, the carriage 430 includes linear bearings 438 that are coupled to the sidewall enclosures 452. The linear bearings 438 provide support to the amplification rails 436 by maintaining the position and the orientation of the amplification rails 436 relative to the lower yoke 432 as the amplification rails 436 translate between the retracted position and the deployed position. The linear bearings 438 may be coupled to the sidewall enclosures 452 and/or the lower yoke 432. In the depicted embodiment, the linear bearings 438 are coupled to the sidewall enclosures 452 and are adapted to allow the amplification rails 436 to slide along the linear bearings 438, providing support to prevent splaying of the amplification rails 436 away from normal and to prevent twisting of the amplification rails 436.

Figure 18:
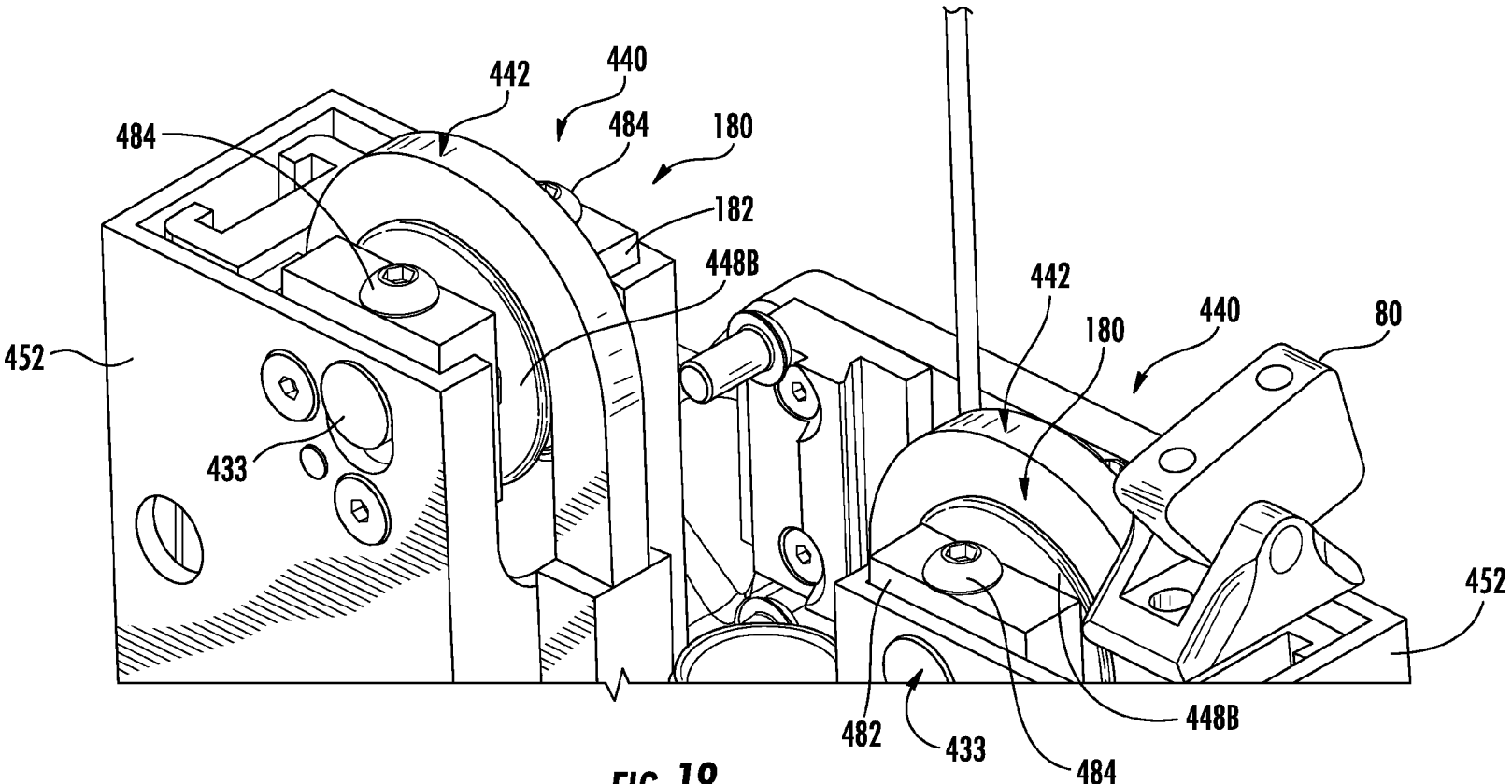
FIG. 18 schematically depicts a front isometric views of the hydraulic actuator of FIGS. 14A-14D according to one or more embodiments described herein.

Referring to FIG. 18, the carriage 430 may also include tensioners 180 that adjust the tension in the force transmission member 442 that is engaged around the pairs of pinions 448A, 448B. In the depicted embodiment, the tensioners 180 include a tensioner block 182 that is coupled to the sidewall enclosure 452. Adjustment mechanisms 184 modify the position of repositionable bearing surfaces 433, about which the pinions 448B rotate, relative to the tensioner block 182. By selectively increasing or decreasing the distance between the pinions 448A, 448B in a pair, the tension of the force transmission member 442 that surrounds those pinions 448A, 448B can be modified.

The components of the leg actuation system 420 may be commanded to extend or retract, thereby extending or retracting the legs 20, 40 of the cot 10 to which the leg actuation system 420 is coupled. Referring again to FIGS. 15A and 15B, embodiments of the leg actuation system 420 according to the present disclosure amplify the stroke of the hydraulic cylinder 424 so that the stroke of the leg actuation system 420 is greater than and proportional to the stroke of the piston 465 in the cylinder housing 122. The piston 465, which is coupled to the lower yoke 432, translates the lower yoke 432 at the same rate that the piston 465 translates from the cylinder housing 122. Because the upper yoke 434 is coupled to the lower yoke 432 through the sidewall enclosures 452, the upper yoke 434 translates at the same rate as the lower yoke 432.

Additionally, the force transmission member 442 is coupled to the cylinder housing 122 through attachment of the intermediate link 445. As the lower yoke 432 is translated away from the cylinder housing 122, the force transmission member 442 is unfurled around the pinions 448A, 448B. Because the force transmission member 442 is coupled to the cylinder housing 122, unfurling the force transmission member 442 around the pinions 448A, 448B tends translate the force application link 447 relative to the pinions 448A, 448B. Because the force application link 447 is coupled to one of the amplification rails 436, unfurling the force transmission member 442 around the pinions 448A, 448B tends to apply a force to the amplification rail 436. The force transmission member 442, therefore, simultaneously applies a force to the amplification rail 436 to extend the amplification rail 436 through the lower yoke 432 as the lower yoke 432 is extending from the cylinder housing 122. Because the amplification rails 436 extend through the lower yoke 432 simultaneously with the lower yoke 432 extending from the cylinder housing 122, the rate of extension of the leg actuation system 420, evaluated from the upper attachment mount 421B to the lower attachment mount 421A, is greater than and proportional to the rate of extension of the piston 465 from the cylinder housing 122.

As discussed above, as the piston 465 of the hydraulic cylinder 424 extends from the cylinder housing 122, the lower yoke 432 is drawn away from the cylinder housing 122. Because the upper yoke 434 and the lower yoke 432 are coupled to one another through the sidewall enclosures 452, the upper yoke 434 and the lower yoke 432 will tend to extend from the cylinder housing 122 at the same rate as the piston 465. Because the intermediate link 445 is coupled to the cylinder housing 122, the force transmission member 442 will tend to translate and unfurl around the pinion 448A that is coupled to the lower yoke 432. The translation and unfurling of the force transmission member 442 will also tend to simultaneously draw the force transmission member 442 around the pinion 448B that is coupled to the upper yoke 434.

Unfurling the force transmission member 442 around the pinions 448A, 448B of the lower yoke 432 and the upper yoke 434 while the force transmission member 442 is coupled to the cylinder housing 122 will tend to shift the relative positioning of the intermediate link 445 and the force application link 447. Because the force transmission member 442 is coupled to the cylinder housing 122 with the intermediate link 445 and to the amplification rail 436 with the force application link 447, unfurling the force transmission member 442 around the pinions 448A, 448B will tend to draw the force application link 447 in a direction from the pinion 448B coupled to the upper yoke 434 towards the pinion 448A coupled to the lower yoke 432. Drawing the force application link 447 in this direction will tend to apply a force to the amplification rail 436 in a direction that corresponds to extending the amplification rail 436 from the lower yoke 432. Because the amplification rail 436 is permitted to translate with respect to the lower yoke 432, unfurling the force transmission member 442 around the pinions 448A, 448B will therefore tend to translate the amplification rail 436 through the lower yoke 432.

In the embodiment depicted in FIGS. 13-18, the transmission assembly 440 translates the amplification rail 436 through the lower yoke 432 at a rate proportional to the rate at which the piston 465 extends from the hydraulic cylinder 424. Based on the configuration of the depicted embodiment, the transmission assembly 440, therefore, increases the stroke of the leg actuation system 420 such that the stroke of the leg actuation system 420, evaluated from the upper attachment mount 421B to the lower attachment mount 421A, is twice the stroke of the piston 465 translating along the cylinder housing 122. The amplification rails 436, therefore, double the stroke of the leg actuation system 420 as compared to the stroke of the piston 465 from the cylinder housing 122. Similarly, the rate of extension of the leg actuation system 420, evaluated from the upper attachment mount 421B to the lower attachment mount 421A, is twice the rate of extension of the piston 465 of the cylinder housing 122.

While specific mention has been made herein to the application of force that tends to extend the leg actuation system 420, it should be noted that the direction of forces applied to the components of the carriage 430 may be reversed, reversing the direction of translation of the leg actuation system 420. Additionally, while specific mention has been made herein to "upper" and "lower" components, it should be understood that the particular positional arrangement of the components may be modified without departing from the scope of the present disclosure.

The force transmission member 442 includes two portions having differing load capabilities. The compression portion 446 of the force transmission member 442 has an increased load-bearing capacity as compared to the tension portion 444 of the force transmission member 442. In the embodiment depicted in FIGS. 13-18, load applied to the compression portion 446 of the force transmission member 442 is greater than load applied to the tension portion 444 of the force transmission member 442. In one example, the maximum load applied to the compression portion 446 of the force transmission member 442 may be about 1800 lb-f, while the maximum load applied to the tension portion 444 of the force transmission member 442 may be about 1350 lb-f. The variation in loading applied to portions of the force transmission member 442 may be attributed to directionality of load that is applied to the cot 10. For example, loading on the legs 20, 40, and therefore the leg actuation system 420, associated with support a patient on the cot 10 is likely to be greater than loads experience by the legs 20, 40 during extension or retraction events with no patient supported on the wheels 26. Further, loads applied to the leg actuation system 420 when the legs 20, 40 are suspended may be reversed to the loads experienced by the leg actuation system 420 when the legs 20, 40 are loaded.

Referring still to FIGS. 13-18, the leg actuation system 420 may include a hydraulic circuit housing 150 in fluid communication with the leg actuation system 420 for directing hydraulic fluid to the cylinder housing 122 to actuate the piston 465. Additionally, the hydraulic circuit housing 150 may be in fluid communication with a pump motor 160 acting as a hydraulic pressure source and a fluid reservoir 162, which has capacity to store a reserve amount of hydraulic fluid that may utilized when needed. The pump motor 160 is be configured to selectively direct fluid throughout the hydraulic circuit housing 150 and the cylinder housing 122. In some embodiments, the hydraulic fluid may be directed to or from the fluid reservoir 162. The pump motor 160 may be any type of machine capable of directing hydraulic fluid throughout the cylinder housing 122 and the hydraulic circuit housing 150 such as, for example, an electric motor, or the like. In some embodiments, the pump motor 160 may be a brushed bi-rotational electric motor with a peak output of about 1400 watts. In other embodiments, the pump motor 160 may be a brushless bi-rotational electric motor.

The cylinder housing 122, the hydraulic circuit housing 150, the pump motor 160, and the fluid reservoir 162 may be assembled as a single unit. In some embodiments, the cylinder housing 122 may be coupled to the hydraulic circuit housing 150. The pump motor 160 and the fluid reservoir 162 may be coupled to the hydraulic circuit housing 150. When assembled as a single unit, the components of the leg actuation system 420 that move hydraulic fluid may be placed adjacent to one another so that the components may be placed in fluid communication with one another.

In some embodiments, the leg actuation system 420 may include a positioning encoder that evaluates the relative extension distance of the leg actuation system 420. Examples of such positioning encoders include string encoders, LVDTs, and the like. The positioning encoder may provide a signal to the control box 50 that is indicative of the extension position of the leg actuation system 420. Such a signal may be used to evaluate the position of the legs 20, 40 of the cot 10, and to verify that the leg actuation system 420 has performed the requested extension and/or retraction movement.

Figure 19B:
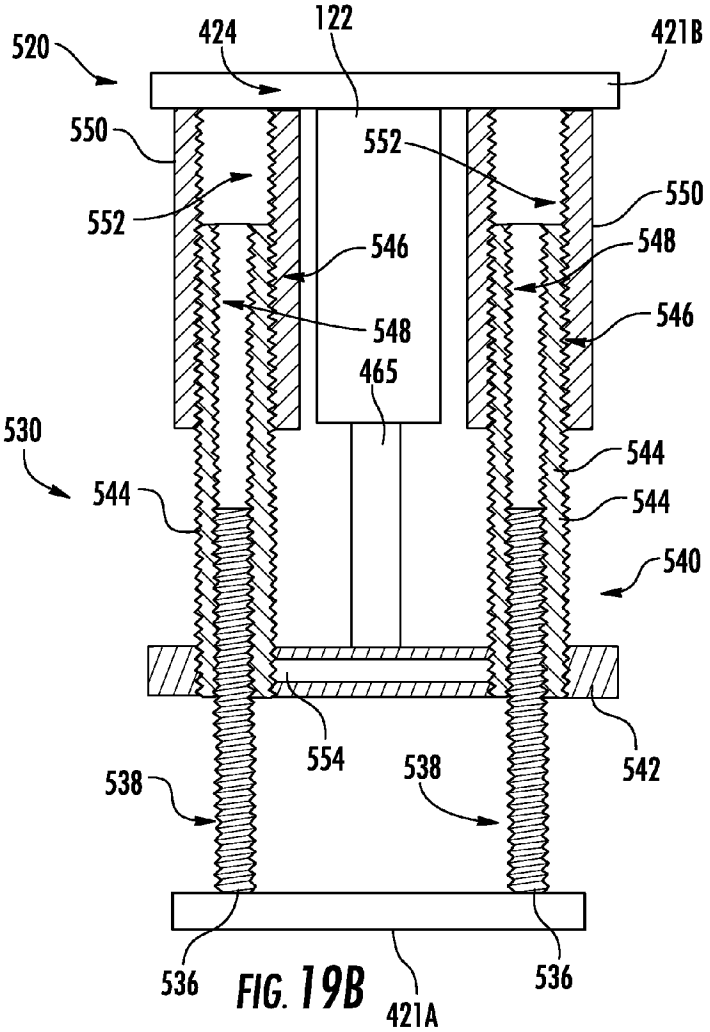
FIGS. 19A and 19B schematically depict a hydraulic actuator according to one or more embodiments described herein.
Figure 19A:
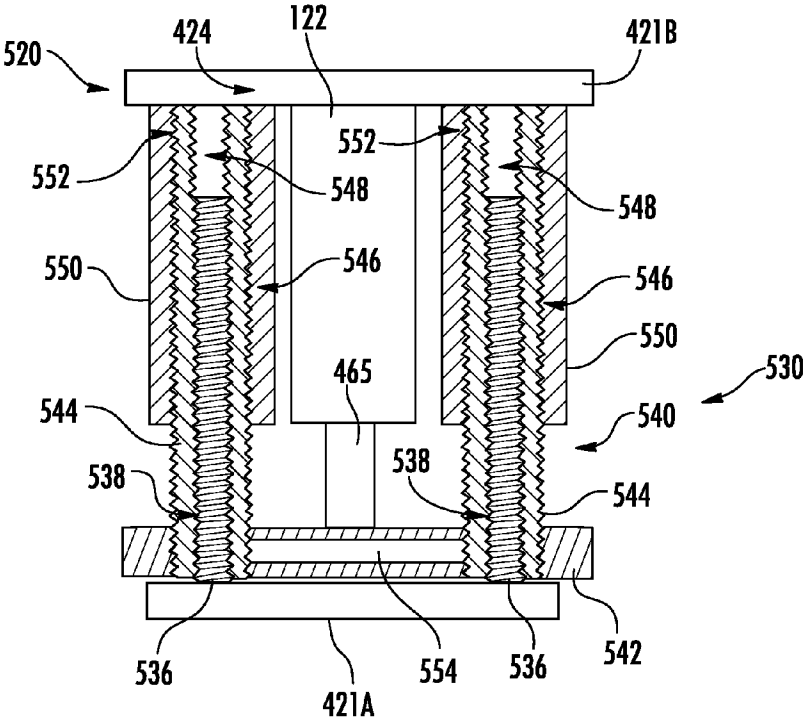

Referring collectively to FIGS. 2, 19A, and 19B, as is noted above the back actuator 18 and the front actuator 16 may each include a leg actuation system 520. The leg actuation system 520 may include a telescoping hydraulic cylinder 424 having a cylinder housing 122 and a piston 465 that extends and retracts relative to the cylinder housing 122, and a carriage 530. The carriage 530 of the leg actuation system 520 can be coupled to one of the back leg 40 at link location 86 or is in fixed and rotatable engagement with the support frame 12, as schematically depicted in FIG. 7. The carriage 530 is also coupled to the cylinder housing 122 and the piston 465 of the telescoping hydraulic cylinder 424. In the embodiment depicted in FIGS. 19A and 19B, the carriage 530 amplifies the translation of the leg actuation system 520 relative to the telescoping hydraulic cylinder 424, such that the extension distance of the leg actuation system 520 by the carriage 430 is greater than the stroke distance of the piston 465 relative to the cylinder housing 122. The carriage 530 also distributes the load away from the being solely transferred along the telescoping hydraulic cylinder 424, such that the load applied to the leg actuation system 420 is distributed at positions across the width of the cot 10.

The carriage 530 includes components that extend and retract upon translation of the piston 465 in the cylinder housing 122. The carriage 530 can comprise a transmission assembly 540 that is coupled to the telescoping hydraulic cylinder 424, and amplification rails 536 that are configured to translate a distance that is proportional to the distance the piston 465 translates along the cylinder housing 122. The transmission assembly 540 can be configured to transform motion of the piston 465 into motion of the amplification rails 536.

In some embodiments, the transmission assembly 540 can receive substantially linear motion from the 465 and generate rotational motion, which can cause the amplification rails 536 to translate. The transmission assembly 540 can comprise force transmission members 544 that are configured to rotate contemporaneous to translation of the piston 465. In the embodiments depicted in FIGS. 19A and 19B, each of the force transmission members 544 can comprise one or more threaded portions that are configured to facilitate rotation of the force transmission members 544. Specifically, each of the force transmission members 544 can be a tubular body formed into substantially cylindrical shape. The force transmission members 544 can comprise an externally threaded portion 546 formed on the exterior and an internally threaded portion 548 formed on the interior.

The transmission assembly 540 of the carriage 530 can comprise one or more components that are configured to cause rotation of the force transmission members 544. In some embodiments, the transmission assembly 540 can comprise a translating support member 542 configured to translate with respect to the cylinder housing 122 and static support members 550 that are configured to be static with respect to the cylinder housing 122. In operation, the translating support member 542 and the static support members 550 can cooperate to cause rotation of the force transmission members 544. In some embodiments, each of the static support members 550 can comprise a threaded portion 552 configured to form a threaded engagement with one of the force transmission members 544. For example, the threaded portion 552 of the static support member 550 can be formed internally and configured to engage with the externally threaded portion of the force transmission member 544.

Furthermore, the force transmission members 544 can be configured to rotate with respect to the translating support member 542. Specifically, the force transmission members 544 can be in rotatable engagement with the translating support member 542. Additionally, the translating support member 542 can be configured to move in concert with the piston 465 as the piston 465 extends and retracts relative to the cylinder housing 122. Specifically, the translating support member 542 can be coupled to the piston 465. Thus, according to the embodiments described herein, the force transmission member 544 can be disposed between the translating support member 542 and the static support member 550. When the force transmission member 544 is in rotatable engagement with the translating support member 542 and in threaded engagement with the static support member 550, translation of the translating support member 542 can cause rotation of the force transmission member 544. Moreover, the threaded engagement formed by the force transmission member 544 and the static support member 550 can be configured such that the force transmission member 544 extends (FIG. 19A to FIG. 19B) and retracts (FIG. 19B to FIG. 19A) with respect to the static support member 550 in concert with extension and retraction of the piston 465.

Referring again to FIGS. 19A and 19B, the amplification rails 536 can be to translate a distance that is proportional to the distance the piston 465 translates along the cylinder housing 122. In some embodiments, the amplification rails 536 can be operably coupled with the force transmission members 544 such that movement of the with the force transmission members 544 causes movement of the amplification rails 536. For example, the amplification rails 536 can be a substantially cylindrically shaped body having a threaded portion 538. Accordingly, the amplification rail 536 can form a threaded engagement with the force transmission member 544. For example, in the depicted embodiments, the threaded portion 538 of the amplification rail 536 can form a threaded engagement with the internally threaded portion 548 of the force transmission member 544.

The amplification rails 536 can be configured to resist rotation and move laterally in response to rotation of the force transmission members 544. In some embodiments, the amplification rails 536 can be coupled to the lower attachment mount 421A. Specifically, the lower attachment mount 421A can be a substantially rigid member that spans between the amplification rails 536. Thus, when the amplification rails 536 are held substantially fixed with respect to the lower attachment mount 421A, rotation of the force transmission member 544 can act upon the amplification rails 536 via the threaded engagement to generate lateral motion. In some embodiments, a thread pitch at the threaded engagement formed by the force transmission member 544 and the amplification rails 536 can be configured such that the movement of the amplification rails 526, the lower attachment mount 421A, or both can be proportional to extension and retraction of the piston 465. For example, the thread pitch can be set such that the extension or retraction of the piston 465 is about doubled by the amplification rails 536, i.e., movement of the piston 465 with respect to the cylinder housing 122 can be substantially equal to movement of the amplification rails 536 with respect to the translating support member 542. It is noted, that the thread pitch can be adjusted to generate any desired ratio of motion of the piston 465 and the amplification rails 536. Accordingly, in some embodiments, the range of motion of the leg actuation system 520, or sections thereof, can be determined by measuring one of the piston 465 or the amplification rails 536. Thus, the complexity and quantity of sensors can be reduced.

The transmission assembly 540 can comprise a timing mechanism 554 for synchronizing rotation of the force transmission members 544. The timing mechanism 554 can be any device suitable to maintain a substantially constant rate of rotation of the force transmission members 544 with respect to one another. Accordingly, the timing mechanism 554 can comprise gears (e.g., worm gears), belts, or the like. In some embodiments, the timing mechanism 554 can be coupled to or disposed within the translating support member 542. Accordingly, the timing mechanism 554 can improve the rigidity of the carriage 530. Specifically, when the rate of rotation of the force transmission members 544 are substantially equivalent, lateral movement of the piston 465, each force transmission member 544, and each amplification rail 536 can be substantially synchronized. Accordingly, during extension and retraction, the carriage 530 can distribute the load away from the being solely transferred along the telescoping hydraulic cylinder 424 such that the load applied to the leg actuation system 520 is distributed at positions across the width of the cot 10. Thus any tendency of the carriage 530 to twist when an uneven load is applied can be reduced, particularly when the support frame 12 is in an elevated position. The reduction in twisting can reduce the amount of drag or friction experienced by the carriage 530, which can result in greater durability, reduced current draw, and improved durability.

Referring collectively to FIGS. 14A, 14B, 19A, and 19B, embodiments of the leg actuation system 420 and the leg actuation system 520 can be configured such that the pump motor 160 and fluid reservoir 162 remain substantially fixed, during actuation, with respect to the upper attachment mount 421B. Accordingly, the complexity of electrical wire routing and the quantity of electrical wire can be reduced. Such a reduction in complexity and amount of wire can reduce current draw by the by the pump motor 160, which can in turn reduce weight.

Referring now to FIGS. 20A-20D, the cylinder housing 122 may include a cylinder 168. At least a portion of the piston 465 may be confined within the cylinder 168 and configured to travel throughout the cylinder 168 between in extension and retraction directions when acted upon by hydraulic fluid. The cylinder 168 may be in fluidic communication with a piston extending fluid path 312 and a piston retracting fluid path 322 on opposing sides of the working diameter 464 of the piston 465. Accordingly, when the hydraulic fluid is supplied with greater pressure via the piston extending fluid path 312 than the piston retracting fluid path 322, the piston 465 may translate along the cylinder 168 in the extension direction and may direct fluid out of the far-side of the cylinder 168 via the piston retracting fluid path 322. When the hydraulic fluid is supplied with greater pressure via the piston retracting fluid path 322 than the piston extending fluid path 312, the piston 465 may retract and may urge fluid out of the near-side of the cylinder 168 via the piston extending fluid path 312.

Referring still to FIGS. 20A-20D, the hydraulic circuit housing 150 may form a hydraulic circuit 300 for transmitting fluid through the extending fluid path 310 and the retracting fluid path 320. In some embodiments, the hydraulic circuit 300 may be configured such that selective operation of the pump motor 160 may direct hydraulic fluid at each of the extending fluid path 310 and the retracting fluid path 320 in a variety of directions based on the induced pressure differential. Specifically, the pump motor 160 may be in fluidic communication with the fluid reservoir 162 via a fluid supply path 304. The pump motor 160 may also be in fluidic communication with the extending fluid path 310 via a pump extend fluid path 326 and the retracting fluid path 320 via a pump retract fluid path 316. Accordingly, the pump motor 160 may draw hydraulic fluid from the fluid reservoir 162 and direct the hydraulic fluid through the pump extend fluid path 326 or the pump retract fluid path 316 to extend or retract the leg actuation system 420. It is noted that, while the embodiments of the hydraulic circuit 300 described herein with respect to FIGS. 20A-20D detail the use of certain types of components such as solenoid valves, check valves, counter balance valves, manual valves, or flow regulators, the embodiments described herein are not restricted to the use of any particular component. Indeed the components described with respect to the hydraulic circuit 300 may be replaced with equivalents which in combination perform the function of the hydraulic circuit 300 described herein.

Figure 20A:
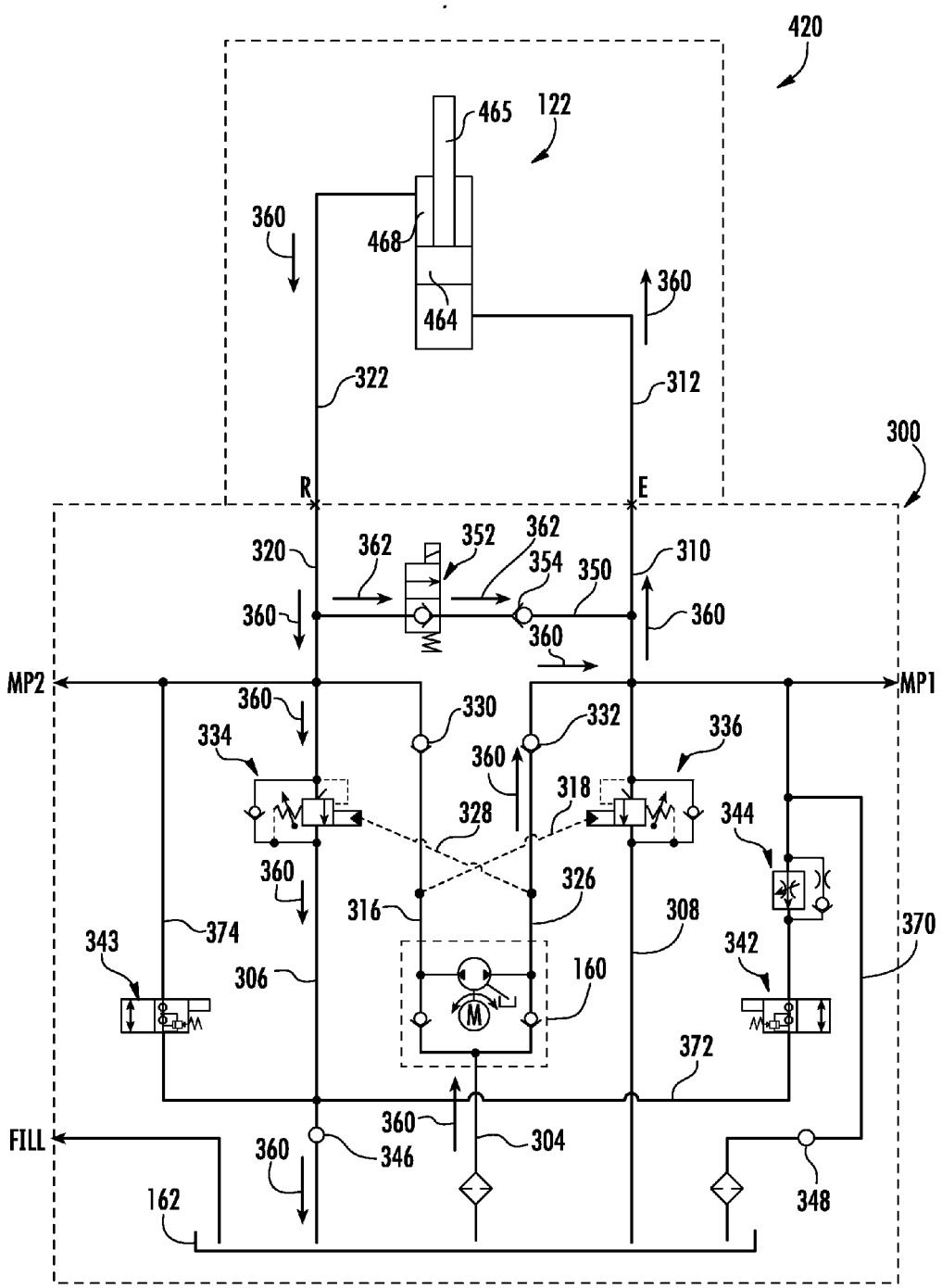
FIGS. 20A-20D schematically depict a hydraulic circuit according to one or more embodiments described herein.

Referring to FIG. 20A, the pump motor 160 may urge hydraulic fluid along the extending route 360 (generally indicated by arrows) to extend the piston 465. In some embodiments, the extending fluid path 310 may be in fluid communication with the piston extending fluid path 312. The retracting fluid path 320 may be in fluid communication with the piston retracting fluid path 322. The pump motor 160 may pull hydraulic fluid from the fluid reservoir 162 via the fluid supply path. Hydraulic fluid may be urged towards the extending fluid path 310 via the pump extend fluid path 326.

The pump extend fluid path 326 may include a check valve 332 that is configured to prevent hydraulic fluid from flowing from the extending fluid path 310 to the pump motor 160 and allow hydraulic fluid to flow from the pump motor 160 to the extending fluid path 310. Accordingly, the pump motor 160 may urge hydraulic fluid through the extending path into the piston extending fluid path 312. Hydraulic fluid may flow along the extending route 360 into the cylinder 168. Hydraulic fluid flowing into the cylinder 168 may cause hydraulic fluid to flow into the piston retracting fluid path 322 as the piston 465. Hydraulic fluid may then flow along the extending route 360 into the retracting fluid path 320.

The hydraulic circuit 300 may further include an extending return fluid path 306 in fluidic communication with each of the retracting fluid path 320 and the fluid reservoir 162. In some embodiments, the extending return fluid path 306 may include a counterbalance valve 334 configured to allow hydraulic fluid to flow from the fluid reservoir 162 to the retracting fluid path 320, and prevent hydraulic fluid from flowing from the retracting fluid path 320 to the fluid reservoir 162, unless an appropriate pressure is received via a pilot line 328. The pilot line 328 may be in fluidic communication with both the pump extend fluid path 326 and the counterbalance valve 334. Accordingly, when the pump motor 160 pumps hydraulic fluid through pump extend fluid path 326, the pilot line 328 may cause the counterbalance valve 334 to modulate and allow hydraulic fluid to flow from the retracting fluid path 320 to the fluid reservoir 162.

Optionally, the extending return fluid path 306 may include a check valve 346 that is configured to prevent hydraulic fluid from flowing from the fluid reservoir 162 to the retracting fluid path 320 and allow hydraulic fluid to flow from the extending return fluid path 306 to the fluid reservoir 162. Accordingly, the pump motor 160 may urge hydraulic fluid through the retracting fluid path 320 to the fluid reservoir 162. In some embodiments, a relatively large amount of pressure may be required to open the check valve 332 compared to the relatively low amount of pressure required to open the check valve 346. In further embodiments, the relatively large amount of pressure required to open the check valve 332 may be more than about double the relatively low amount of pressure required to open the check valve 346 such as, for example, about 3 times the pressure or more in another embodiment, or about 5 times the pressure or more in yet another embodiment.

In some embodiments, the hydraulic circuit 300 may further include a regeneration fluid path 350 that is configured to allow hydraulic fluid to flow directly from the retracting fluid path 320 to the extending fluid path 310. Accordingly, the regeneration fluid path 350 may allow hydraulic fluid supplied from the piston retracting fluid path 322 to flow along a regeneration route 362 towards the piston extending fluid path 312. In further embodiments, the regeneration fluid path 350 may include a logical valve 352 that is configured to selectively allow hydraulic fluid to travel along the regeneration route 362. The logical valve 352 may be communicatively coupled to a processor or sensor and configured to open when the cot is in a predetermined state. For example, when the leg actuation system 420 is associated with a leg that is in tension, which, as described herein, may indicate an unloaded state, the logical valve 352 may be opened. It may be desirable to open the logical valve 352 during the extension of the leg actuation system 420 to increase the speed of extension. The regeneration fluid path 350 may further include a check valve 354 that is configured to prevent hydraulic fluid from flowing from the retracting fluid path 320 to the extending fluid path 310. In some embodiments, the amount of pressure required to open the check valve 332 is about the same as the amount of pressure required to open the check valve 354.

Figure 20B:
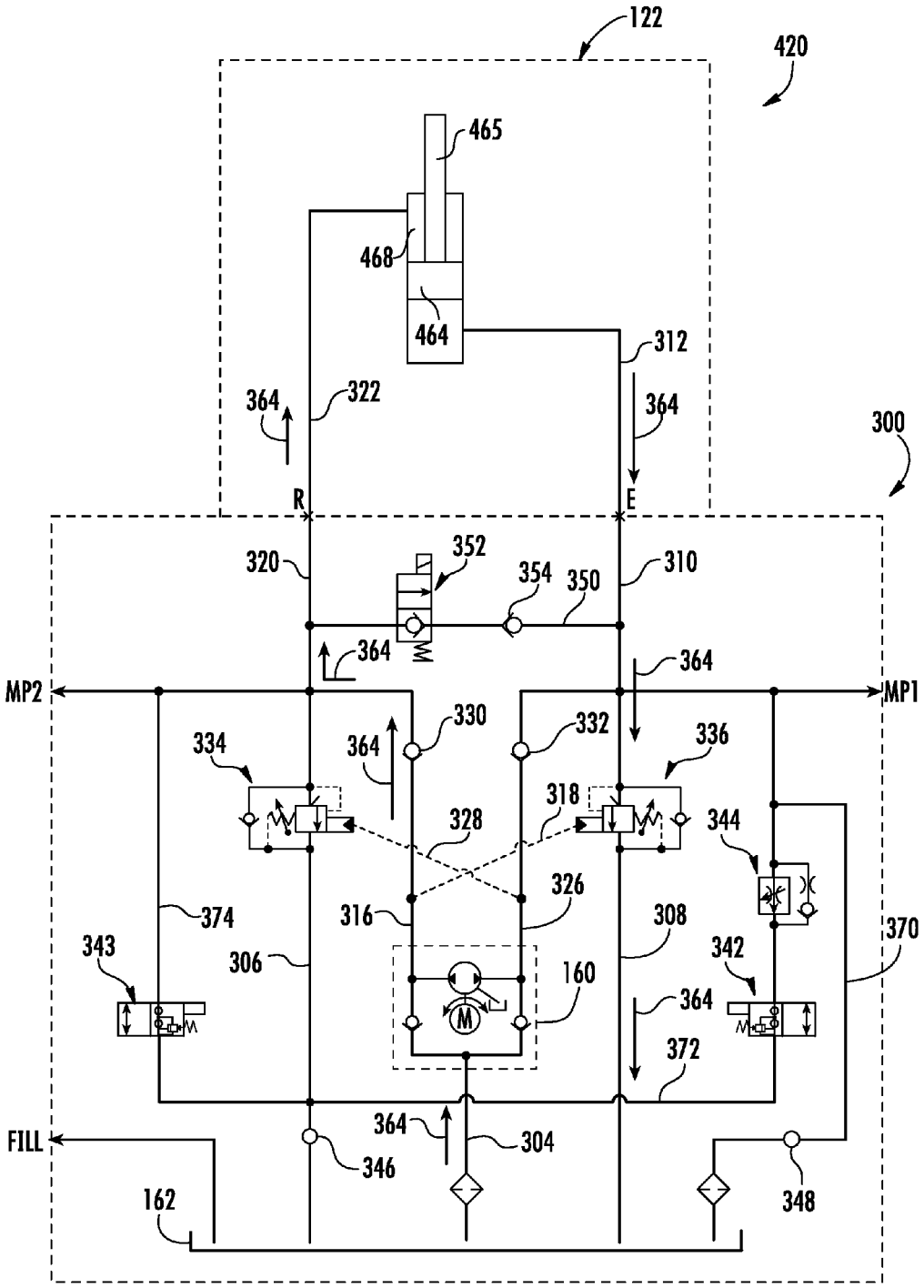

Referring to FIG. 20B, the pump motor 160 may urge hydraulic fluid along the retracting route 364 (generally indicated by arrows) to retract the piston 465. The pump motor 160 may pull hydraulic fluid from the fluid reservoir 162 via the fluid supply path 304. Hydraulic fluid may be urged towards the retracting fluid path 320 via the pump retract fluid path 316. The pump retract fluid path 316 may include a check valve 330 that is configured to prevent hydraulic fluid from flowing from the retracting fluid path 320 to the pump motor 160 and allow hydraulic fluid to flow from the pump motor 160 to the retracting fluid path 320. Accordingly, the pump motor 160 may urge hydraulic fluid through the retracting fluid path 320 into the piston retracting fluid path 322.

Hydraulic fluid may flow along the retracting route 364 into the cylinder 168. Hydraulic fluid flowing into the cylinder 168 may cause hydraulic fluid to flow into the piston extending fluid path 312 as the piston 465 retracts. Hydraulic fluid may then flow along the retracting route 364 into the extending fluid path 310.

The hydraulic circuit 300 may further include a retracting return fluid path 308 in fluidic communication with each of the extending fluid path 310 and the fluid reservoir 162. In some embodiments, the retracting return fluid path 308 may include a counterbalance valve 336 configured to allow hydraulic fluid to flow from the fluid reservoir 162 to the extending fluid path 310, and prevent hydraulic fluid from flowing from the extending fluid path 310 to the fluid reservoir 162, unless an appropriate pressure is received via a pilot line 318. The pilot line 318 may be in fluidic communication with both the pump retract fluid path 316 and the counterbalance valve 336. Accordingly, when the pump motor 160 pumps hydraulic fluid through the pump retract fluid path 316, the pilot line 318 may cause the counterbalance valve 336 to modulate and allow hydraulic fluid to flow from the extending fluid path 310 to the fluid reservoir 162.

Referring collectively to FIGS. 20A-20D, while the leg actuation system 420 is typically powered by the pump motor 160, the leg actuation system 420 may be actuated manually after bypassing the pump motor 160. Specifically, the hydraulic circuit 300 may include a manual supply fluid path 370, a manual retract return fluid path 372, and a manual extend return fluid path 374. The manual supply fluid path 370 may be configured for supplying fluid to the cylinder 168. In some embodiments, the manual supply fluid path 370 may be in fluidic communication with the fluid reservoir 162 and the extending fluid path 310. In further embodiments, the manual supply fluid path 370 may include a check valve 348 that is configured to prevent hydraulic fluid from flowing from the manual supply fluid path 370 to the fluid reservoir 162 and allow hydraulic fluid to flow from the fluid reservoir 162 to the extending fluid path 310. Accordingly, manual manipulation of the piston 465 may cause hydraulic fluid to flow through the check valve 348. In some embodiments, a relatively low amount of pressure may be required to open the check valve 348 compared to a relatively large amount of pressure required to open the check valve 346. In further embodiments, the relatively low amount of pressure required to open the check valve 348 may be less than or equal to about ½ of the relatively large amount of pressure required to open the check valve 346 such as, for example, less than or equal to about ⅕ in another embodiment, or less than or equal to about 1/10 in yet another embodiment.

The manual retract return fluid path 372 may be configured to return hydraulic fluid from the cylinder 168, to the fluid reservoir 162, and back to the cylinder 168. In some embodiments, the manual retract return fluid path 372 may be in fluidic communication with the extending fluid path 310 and the extending return fluid path 306. The manual retract return fluid path 372 may include a manual valve 342 that may be actuated from a normally closed position to an open position and a flow regulator 344 configured to limit the amount of hydraulic fluid that may flow through the manual retract return fluid path 372, i.e., volume per unit time. Accordingly, the flow regulator 344 may be utilized to provide a controlled descent of the cot 10. It is noted that, while the flow regulator 344 is depicted in FIGS. 20A-20D as being located between the manual valve 342 and the extending fluid path 310, the flow regulator 344 may be located in any position throughout the hydraulic circuit 300 suitable for limiting the rate at which the piston 465 may retract.

The manual extend return fluid path 374 may be configured to return hydraulic fluid from the cylinder 168 to the fluid reservoir 162, and back to the cylinder 168 along the opposite side of the working diameter 464 of the piston 465. In some embodiments, the manual extend return fluid path 374 may be in fluidic communication with the retracting fluid path 320, the manual retract return fluid path 372 and the extending return fluid path 306. The manual extend return fluid path 374 may include a manual valve 343 that may be actuated from a normally closed position to an open position.

In some embodiments, the hydraulic circuit 300 may also include a manual release component (e.g., a button, tension member, switch, linkage or lever) that actuates the manual valve 342 and manual valve 343 to allow the piston 465 to extend and retract without the use of the pump motor 160. Referring to the embodiments of FIG. 20C, the manual valve 342 and the manual valve 343 may be opened, e.g., via the manual release component. A force may act upon the hydraulic circuit 300 to extend the piston 465 such as, for example, gravity or manual articulation of the piston 465. With the manual valve 342 and the manual valve 343 opened, hydraulic fluid may flow along the manual extend route 366 to facilitate extension of the piston 465. Specifically, as the piston 465 is extended, hydraulic fluid may be displaced from the cylinder 168 into the piston retracting fluid path 322. Hydraulic fluid may travel from the piston retracting fluid path 322 into the retracting fluid path 320.

Hydraulic fluid may also travel through the manual extend return fluid path 374 towards the extending return fluid path 306 and the manual retract return fluid path 372. Depending upon the rate of extension of the piston 465, or applied force, hydraulic fluid may flow through the extending return fluid path 306, beyond the check valve 346 and into the fluid reservoir 162. Hydraulic fluid may also flow through the manual retract return fluid path 372 towards the extending fluid path 310. Hydraulic fluid may also be supplied from the fluid reservoir 162 via the manual supply fluid path 370 to the extending fluid path 310, i.e., when the manual operation generates sufficient pressure for the hydraulic fluid to flow beyond check valve 348. Hydraulic fluid at the extending fluid path 310 may flow to the piston extending fluid path 312. The manual extension of the piston 465 may cause hydraulic fluid to flow into the cylinder 168 from the piston extending fluid path 312.

Referring again to FIG. 20D, when the manual valve 342 and the manual valve 343 are opened, hydraulic fluid may flow along the manual retract route 368 to facilitate retraction of the piston 465. Specifically, as the piston 465 is retracted, hydraulic fluid may be displaced from the cylinder 168 into the piston extending fluid path 312. Hydraulic fluid may travel from the piston extending fluid path 312 into the extending fluid path 310.

Hydraulic fluid may also travel through the manual retract return fluid path 372 towards the flow regulator 344, which operates to limit the rate at which the hydraulic fluid may flow and the rate at which the piston 465 may retract. Hydraulic fluid may then flow towards the manual extend return fluid path 374. The hydraulic fluid may then flow through the manual extend return fluid path 374 and into the retracting fluid path 320. Depending upon the rate of retraction of the piston 465 and the permissible flow rate of the flow regulator 344, some hydraulic fluid may leak beyond the check valve 346 and into the fluid reservoir 162. In some embodiments, the rate of permissible flow rate of the flow regulator 344 and the opening pressure of the check valve 346 may be configured to substantially prevent hydraulic fluid from flowing beyond the check valve 346 during manual retraction. It has been discovered by the applicants that prohibiting flow beyond the check valve 346 may ensure that the cylinder 168 remain primed with reduced air infiltration during manual retraction.

Figure 20C:
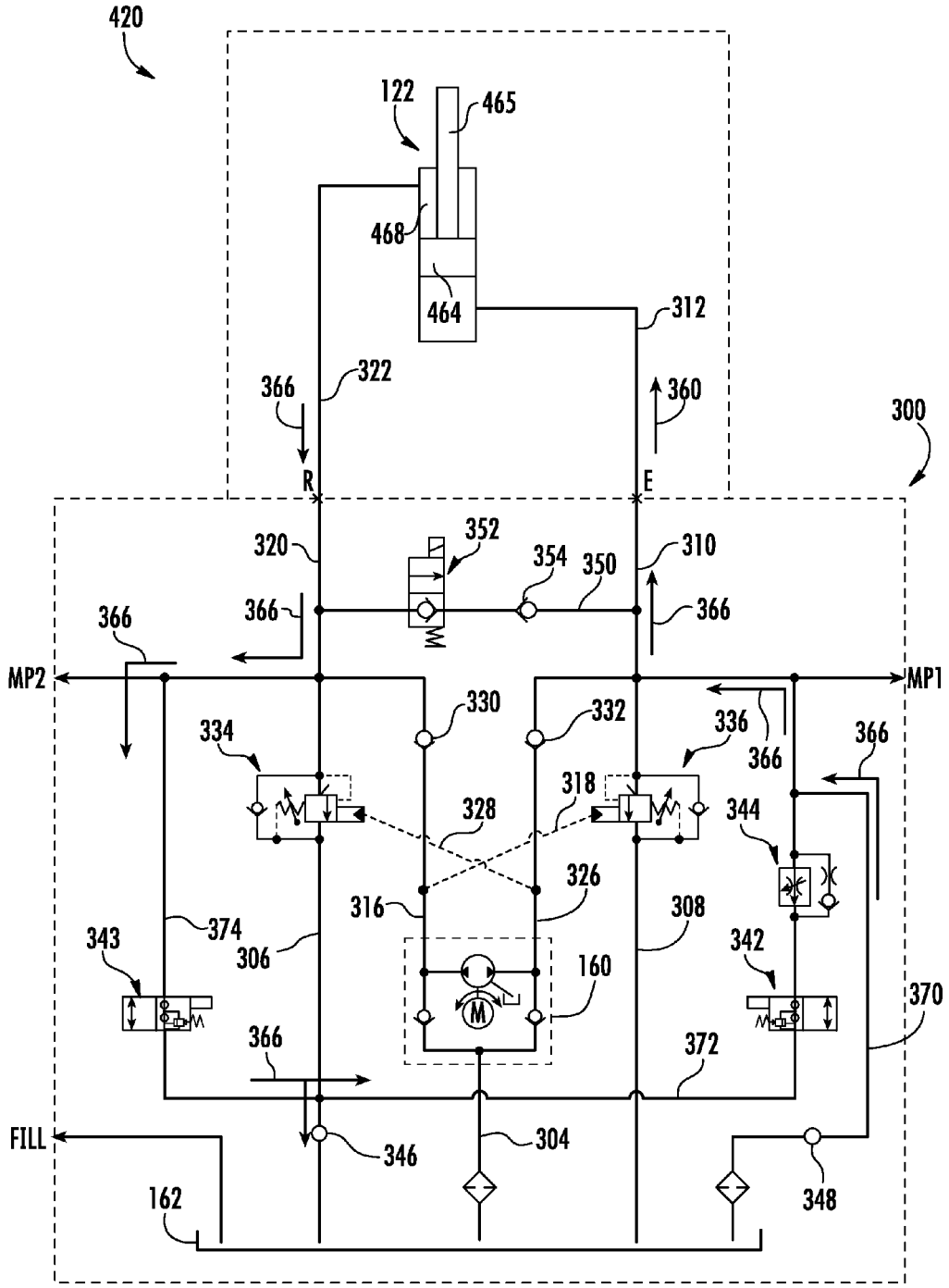
Figure 20D:
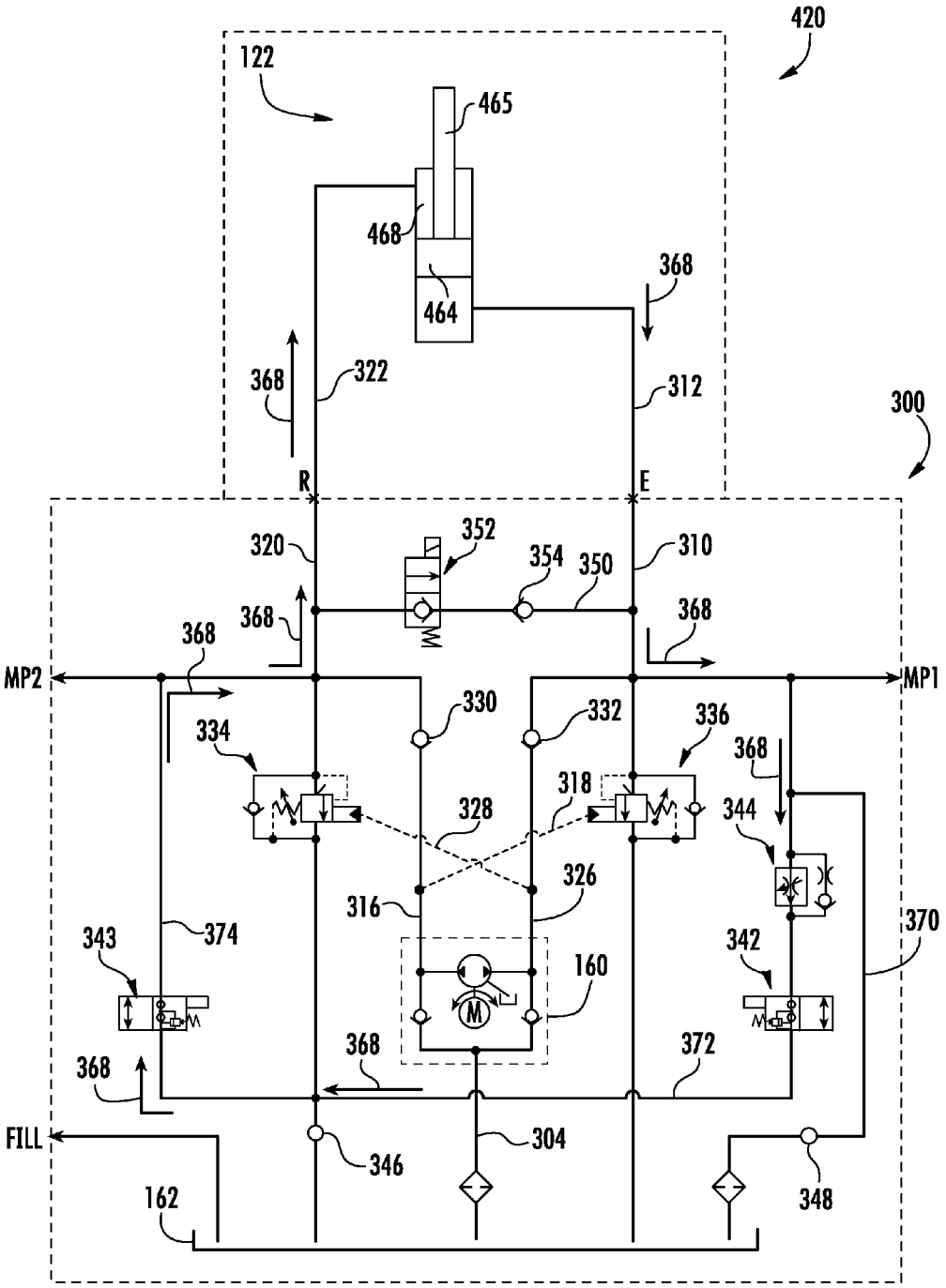
Figure 21:
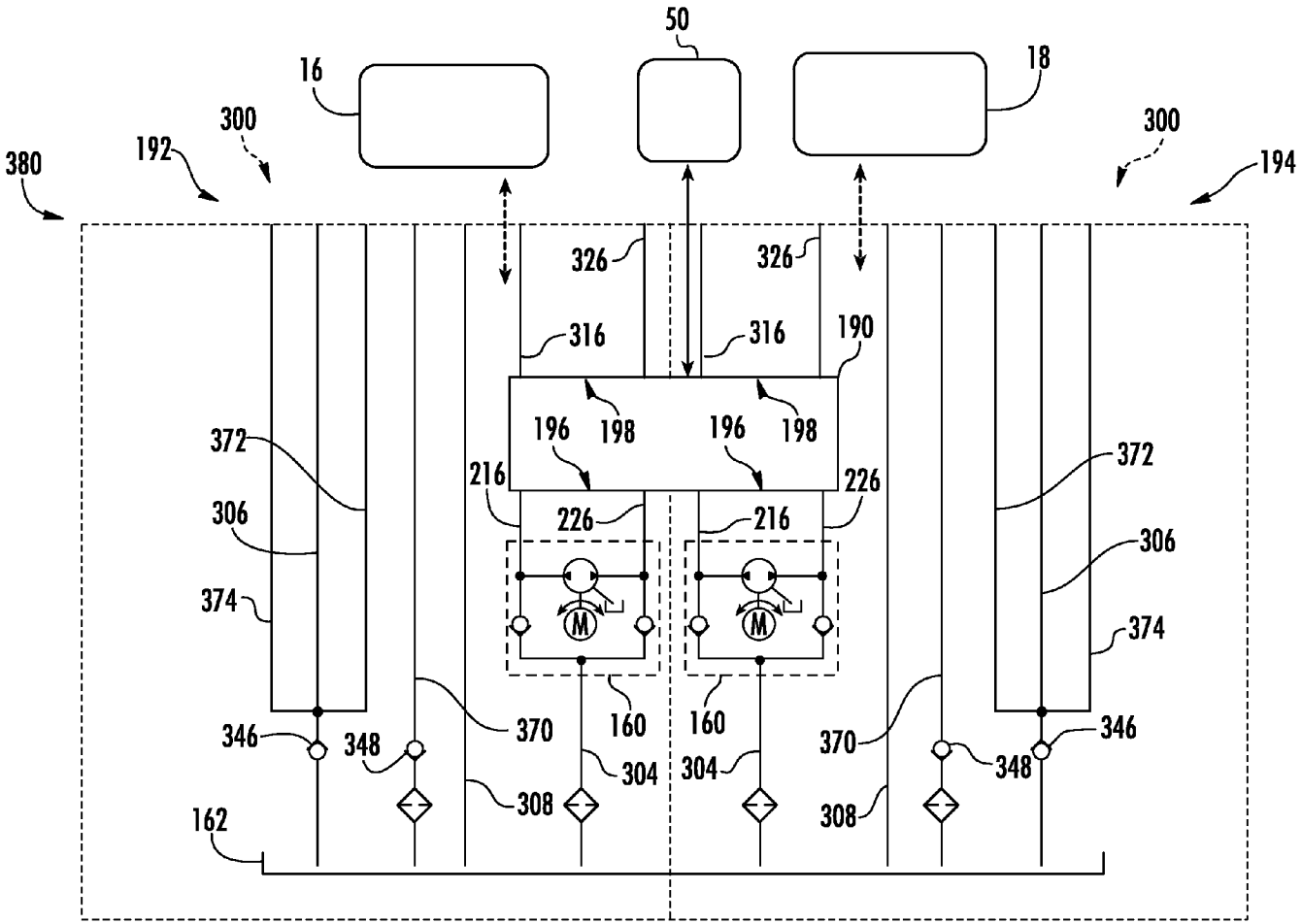
FIG. 21 schematically depicts an electronic switching valve for directing hydraulic fluid to the hydraulic circuits of FIGS. 12A-12D and 20A-20D according to one or more embodiments described herein.
Figure 22:
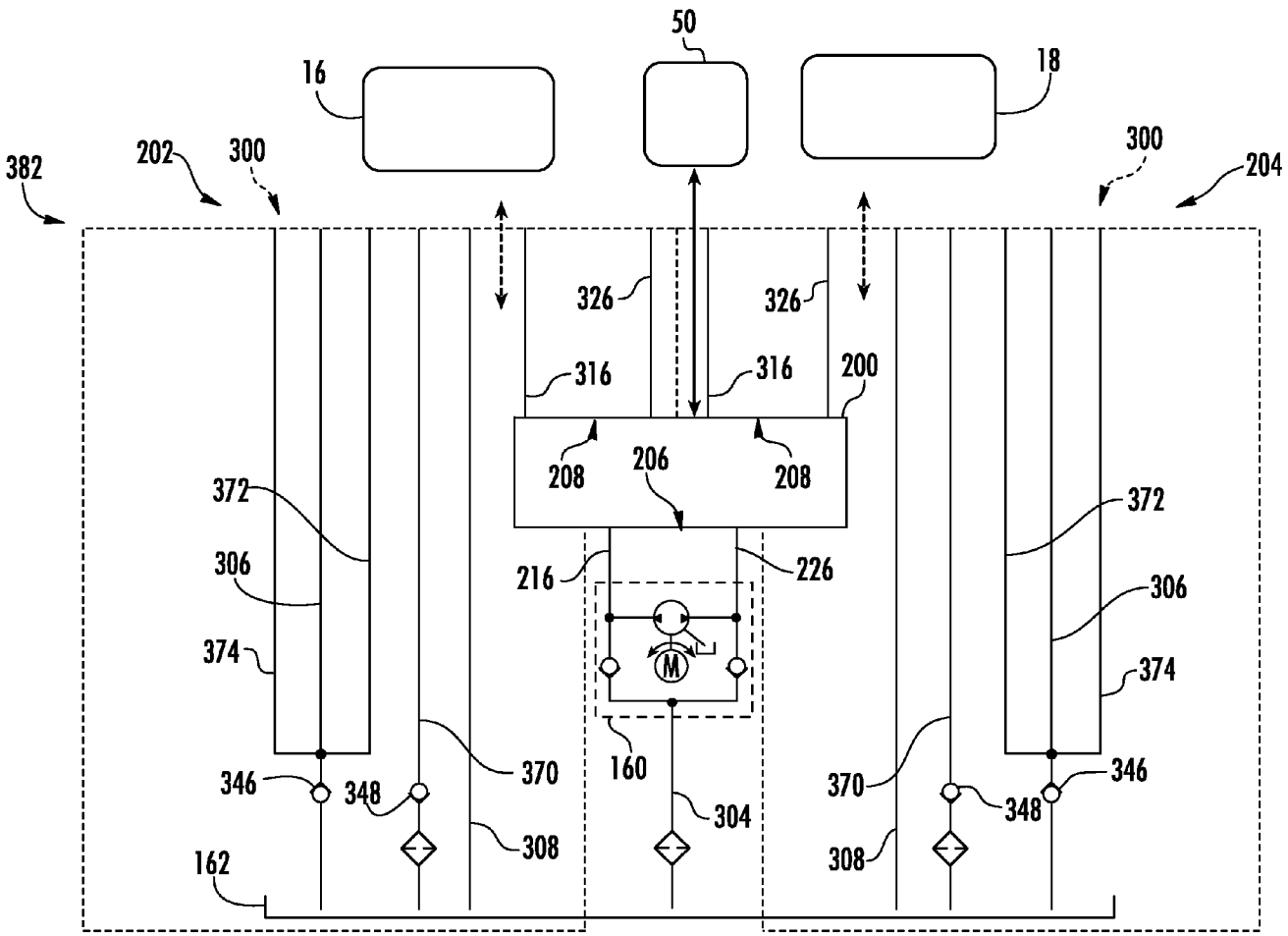
FIG. 22 schematically depicts a flow control valve for directing hydraulic fluid to the hydraulic circuits of FIGS. 12A-12D and 20A-20D according to one or more embodiments described herein.

Hydraulic fluid at the retracting fluid path 320 may flow to the piston retracting fluid path 322. The manual retraction of the piston 465 may cause hydraulic fluid to flow into the cylinder 168 from the piston retracting fluid path 322. It is noted that, while the manual embodiments described with respect to FIGS. 20C and 20D depict extension and retraction as separate operations, it is contemplated that manual extension and manual retraction may be performed within a single operation. For example, upon opening the manual valve 342 and the manual valve 343, the piston 465 may extend, retract, or both sequentially in response to an applied force.

Referring collectively to FIGS. 12A-12D, 20A-20D, and 21 a centralized hydraulic circuit 380 can be provided with an electronic switching valve 190 configured to direct hydraulic fluid to multiple actuators. In some embodiments, the centralized hydraulic circuit 380 can comprise a front actuator side 192 for supplying hydraulic fluid to the front actuator 16 and a back actuator side 194 for supplying hydraulic fluid to the back actuator 18. Each of the front actuator side 192 and the back actuator side 194 of the centralized hydraulic circuit 380 can comprise a hydraulic circuit 300. For example, each of the hydraulic circuits 300 of FIGS. 12A-12D and 20A-20D can be adapted to supply two actuators with hydraulic fluid from the fluid reservoir 162 instead of a single actuator. Specifically, the fluid reservoir 162 can be in fluidic communication with the pump motor 160 of each of the front actuator side 192 and the back actuator side 194 of the centralized hydraulic circuit 380. The pump motor 160 of each of the front actuator side 192 and the back actuator side 194 can be in fluidic communication with the electronic switching valve 190 via a first input fluid path 216 and a second input fluid path 226. The electronic switching valve 190 can be in fluidic communication with the pump retract fluid path 316 and the pump extend fluid path 326 of each of the front actuator side 192 and the back actuator side 194 of the centralized hydraulic circuit 380. Accordingly, inputs 196 of the electronic switching valve 190 can be in fluidic communication with the first input fluid path 216 and the second input fluid path 226 of each of the front actuator side 192 and the back actuator side 194 of the centralized hydraulic circuit 380. Outputs 198 of the electronic switching valve 190 can be in fluidic communication with the pump retract fluid path 316 and the pump extend fluid path 326 of each of the front actuator side 192 and the back actuator side 194 of the centralized hydraulic circuit 380.

The electronic switching valve 190 can be configured to direct hydraulic fluid to any of the outputs 198. For example, the electronic switching valve 190 can comprise a plurality of electrically actuated valves that can selectively direct hydraulic fluid received from any of the inputs 196 to any of the outputs 198. In some embodiments, the electronic switching valve 190 can be communicatively coupled to the control box 50, which can comprise or be communicatively coupled to one or more processors. Accordingly, the control box 50 can provide control signals to the electrically actuated valves of the electronic switching valve 190 and selectively place any of the inputs 196 in fluidic communication with any of the outputs 198.

In some embodiments, the centralized hydraulic circuit 380 can be configured for simultaneous actuation of the front actuator 16 and the back actuator 18. For example, during simultaneous actuation, the pump motor 160 of the front actuator side 192 can actuate the front actuator 16 with hydraulic fluid and the pump motor 160 of the back actuator side 194 can actuate the back actuator 18. Accordingly, the electronic switching valve 190 can place the first input fluid path 216 and the pump retract fluid path 316 of the front actuator side 192 in fluidic communication. Alternatively or additionally, the electronic switching valve 190 can place the second input fluid path 226 and the pump extend fluid path 326 of the front actuator side 192 in fluidic communication. Thus, during simultaneous actuation, the front actuator 16 can be actuated by the pump motor 160 in a similar manner to the hydraulic circuits 300 described hereinabove with respect to FIGS. 12A-12D and 20A-20D. Similarly, the electronic switching valve 190 can place the first input fluid path 216 and the pump retract fluid path 316 of the back actuator side 194 in fluidic communication. Alternatively or additionally, the electronic switching valve 190 can place the second input fluid path 226 and the pump extend fluid path 326 of the back actuator side 194 in fluidic communication. Thus, during simultaneous actuation, the back actuator 18 can be actuated by the pump motor 160 in a similar manner to the hydraulic circuits 300 described hereinabove with respect to FIGS. 12A-12D and 20A-20D.

In some embodiments, the centralized hydraulic circuit 380 can be configured for independent actuation of the front actuator 16 or the back actuator 18. For example, during independent actuation, the pump motor 160 of the front actuator side 192 and the pump motor 160 of the back actuator side 194 can actuate the front actuator 16 with hydraulic fluid. Accordingly, the electronic switching valve 190 can place the first input fluid path 216 of the front actuator side 192 and the first input fluid path 216 of the back actuator side 194 in fluidic communication with the pump retract fluid path 316 of the front actuator side 192. Alternatively or additionally, the second input fluid path 226 of the front actuator side 192 and the second input fluid path 226 of the back actuator side 194 can be placed in fluidic communication with the pump extend fluid path 326 of the front actuator side 192.

Alternatively, during independent actuation, the pump motor 160 of the front actuator side 192 and the pump motor 160 of the back actuator side 194 can actuate the back actuator 18 with hydraulic fluid. Accordingly, the electronic switching valve 190 can place the first input fluid path 216 of the front actuator side 192 and the first input fluid path 216 of the back actuator side 194 in fluidic communication with the pump retract fluid path 316 of the back actuator side 194. Alternatively or additionally, the second input fluid path 226 of the front actuator side 192 and the second input fluid path 226 of the back actuator side 194 can be placed in fluidic communication with the pump extend fluid path 326 of the back actuator side 194. Accordingly, during independent actuation, both the pump motor 160 of the front actuator side 192 and the pump motor 160 of the back actuator side 194 can be utilized to drive the front actuator 16 or the back actuator 18 with greater pressure compared to simultaneous actuation.

Referring collectively to FIGS. 12A-12D, 20A-20D, and 22 a centralized hydraulic circuit 382 can be provided with a flow control valve 200 configured to direct hydraulic fluid to multiple actuators. In some embodiments, the centralized hydraulic circuit 382 can comprise a front actuator side 202 for supplying hydraulic fluid to the front actuator 16 and a back actuator side 204 for supplying hydraulic fluid to the back actuator 18. The centralized hydraulic circuit 382 can comprise a pump motor 160 that operates as one unit configured to actuate both the front actuator 16 and the back actuator 18 with hydraulic fluid from the reservoir 162. Each of the front actuator side 202 and the back actuator side 204 of the centralized hydraulic circuit 380 can comprise a hydraulic circuit 300. For example, each of the hydraulic circuits 300 of FIGS. 12A-12D and 20A-20D can supplied with hydraulic fluid from the pump motor 160 operating as one unit, which can consolidate the operation of the individual pump motors into one unit. Specifically, the fluid reservoir 162 can be in fluidic communication with the pump motor 160 of the centralized hydraulic circuit 382 via the fluid supply path 304. The pump motor 160 can be in fluidic communication with the flow control valve 200 via a first input fluid path 216 and a second input fluid path 226. The flow control valve 200 can be in fluidic communication with the pump retract fluid path 316 and the pump extend fluid path 326 of each of the front actuator side 202 and the back actuator side 204 of the centralized hydraulic circuit 380. Accordingly, inputs 206 of the flow control valve 200 can be in fluidic communication with the first input fluid path 216 and the second input fluid path 226 of the centralized hydraulic circuit 382. Outputs 208 of the flow control valve 200 can be in fluidic communication with the pump retract fluid path 316 and the pump extend fluid path 326 of each of the front actuator side 202 and the back actuator side 204 of the centralized hydraulic circuit 382.

The flow control valve 200 can be configured to direct hydraulic fluid to any of the outputs 208. For example, the flow control valve 200 can comprise a spool that can be manipulated by a solenoid into a plurality of positions that can selectively direct hydraulic fluid received from any of the inputs 206 to any of the outputs 208. In some embodiments, the flow control valve 200 can be communicatively coupled to the control box 50. Accordingly, the control box 50 can provide control signals to the solenoid of the flow control valve 200 and selectively place any of the inputs 206 in fluidic communication with any of the outputs 208. For the purpose of defining and describing the embodiments provided herein it is noted that the term "solenoid" can mean any electrically activated servo-mechanism.

In some embodiments, the centralized hydraulic circuit 382 can be configured for simultaneous actuation of the front actuator 16 and the back actuator 18. For example, during simultaneous actuation, the pump motor 160 can actuate the front actuator 16 and the back actuator 18 with hydraulic fluid. Accordingly, the flow control valve 200 can place the first input fluid path 216 in fluidic communication with both of the pump retract fluid path 316 of the front actuator side 202 and the pump retract fluid path 316 of the back actuator side 204. Alternatively or additionally, the flow control valve 200 can place the second input fluid path 226 in fluidic communication with both of the pump extend fluid path 326 of the front actuator side 202 and the pump extend fluid path 326 of the back actuator side 204. Accordingly, during simultaneous actuation, the flow control valve 200 can divide the hydraulic fluid supplied by the pump motor 160 between the front actuator side 202 and the back actuator side 204 of the centralized hydraulic circuit 382.

In some embodiments, the centralized hydraulic circuit 382 can be configured for independent actuation of the front actuator 16 or the back actuator 18. For example, during independent actuation, the pump motor 160 can actuate the front actuator 16 with hydraulic fluid. Accordingly, the flow control valve 200 can place the first input fluid path 216 in fluidic communication with the pump retract fluid path 316 of the front actuator side 192. Alternatively or additionally, the second input fluid path 226 can be placed in fluidic communication with the pump extend fluid path 326 of the front actuator side 192.

Alternatively, during independent actuation, the pump motor 160 can actuate the back actuator 18 with hydraulic fluid. Accordingly, the flow control valve 200 can place the first input fluid path 216 in fluidic communication with the pump retract fluid path 316 of the back actuator side 194. Alternatively or additionally, the second input fluid path 226 can be placed in fluidic communication with the pump extend fluid path 326 of the back actuator side 194. Accordingly, during independent actuation, the flow control valve 200 can direct the hydraulic fluid supplied by the pump motor 160 to the front actuator side 202 or the back actuator side 204 of the centralized hydraulic circuit 382.

Referring again to FIGS. 1 and 2, to determine whether the self-actuating cot 10 is level, sensors (not depicted) may be utilized to measure distance and/or angle. For example, the front actuator 16 and the back actuator 18 may each comprise encoders which determine the length of each actuator. In one embodiment, the encoders are real time encoders which are operable to detect movement of the total length of the actuator or the change in length of the actuator when the cot is powered or unpowered (i.e., manual control). While various encoders are contemplated, the encoder, in one commercial embodiment, may be the optical encoders produced by Midwest Motion Products, Inc. of Watertown, Minn. U.S.A. In other embodiments, the cot comprises angular sensors that measure actual angle or change in angle such as, for example, potentiometer rotary sensors, hall effect rotary sensors and the like. The angular sensors can be operable to detect the angles of any of the pivotingly coupled portions of the front legs 20 and/or the back legs 40. In one embodiment, angular sensors are operably coupled to the front legs 20 and the back legs 40 to detect the difference between the angle of the front leg 20 and the angle of the back leg 40 (angle delta). A loading state angle may be set to an angle such as about 20° or any other angle that generally indicates that the self-actuating cot 10 is in a loading state (indicative of loading and/or unloading). Thus, when the angle delta exceeds the loading state angle the self-actuating cot 10 may detect that it is in a loading state and perform certain actions dependent upon being in the loading state.

In the embodiments described herein, the control box 50 comprises or is operably coupled to one or more processors and memory. For the purpose of defining and describing the embodiments provided herein it is noted that the term "processor" can mean any device capable of executing machine readable instructions. Accordingly, each processor may be a controller, an integrated circuit, a microchip, a computer, or any other computing device. The memory can be any device capable of storing machine readable instructions. The memory can include any type of storage device such as, for example, read only memory (ROM), random access memory (RAM), secondary memory (e.g., hard drive), or combinations thereof. Suitable examples of ROM include, but are not limited to, programmable read-only memory (PROM), erasable programmable read-only memory (EPROM), electrically erasable programmable read-only memory (EEPROM), electrically alterable read-only memory (EAROM), flash memory, or combinations thereof. Suitable examples of RAM include, but are not limited to, static RAM (SRAM) or dynamic RAM (DRAM).

The embodiments described herein can perform methods automatically by executing machine readable instructions with one or more processors. The machine readable instructions can comprise logic or algorithm(s) written in any programming language of any generation (e.g., 1GL, 2GL, 3GL, 4GL, or 5GL) such as, for example, machine language that may be directly executed by the processor, or assembly language, object-oriented programming (OOP), scripting languages, microcode, etc., that may be compiled or assembled into machine readable instructions and stored. Alternatively, the machine readable instructions may be written in a hardware description language (HDL), such as logic implemented via either a field-programmable gate array (FPGA) configuration or an application-specific integrated circuit (ASIC), or their equivalents. Accordingly, the methods described herein may be implemented in any conventional computer programming language, as pre-programmed hardware elements, or as a combination of hardware and software components.

Additionally, it is noted that distance sensors may be coupled to any portion of the self-actuating cot 10 such that the distance between a lower surface and components such as, for example, the front end 17, the back end 19, the front load wheels 70, the front wheels 26, the intermediate load wheels 30, the back wheels 46, the front actuator 16 or the back actuator 18 may be determined. It is furthermore noted that the term "sensor," as used herein, means a device that measures a physical quantity and converts it into a signal which is correlated to the measured value of the physical quantity. Furthermore, the term "signal" means an electrical, magnetic or optical waveform, such as current, voltage, flux, DC, AC, sinusoidal-wave, triangular-wave, square-wave, and the like, capable of being transmitted from one location to another.

Referring collectively to FIGS. 2 and 4A-E, the front end 17 may also comprise a pair of front load wheels 70 configured to assist in loading the self-actuating cot 10 onto a loading surface 500 (e.g., the floor of an ambulance). The self-actuating cot 10 may comprise sensors operable to detect the location of the front load wheels 70 with respect to a loading surface 500 (e.g., distance above the surface or contact with the surface). In one or more embodiments, the front load wheel sensors comprise touch sensors, proximity sensors, or other suitable sensors effective to detect when the front load wheels 70 are above a loading surface 500. In one embodiment, the front load wheel sensors are ultrasonic sensors aligned to detect directly or indirectly the distance from the front load wheels to a surface beneath the load wheels. Specifically, the ultrasonic sensors, described herein, may be operable to provide an indication when a surface is within a definable range of distance from the ultrasonic sensor (e.g., when a surface is greater than a first distance but less than a second distance). Thus, the definable range may be set such that a positive indication is provided by the sensor when a portion of the self-actuating cot 10 is in proximity to a loading surface 500.

In a further embodiment, multiple front load wheel sensors may be in series, such that the front load wheel sensors are activated only when both front load wheels 70 are within a definable range of the loading surface 500 (i.e., distance may be set to indicate that the front load wheels 70 are in contact with a surface). As used in this context, "activated" means that the front load wheel sensors send a signal to the control box 50 that the front load wheels 70 are both above the loading surface 500. Ensuring that both front load wheels 70 are on the loading surface 500 may be important, especially in circumstances when the self-actuating cot 10 is loaded into an ambulance at an incline.

The front legs 20 may comprise intermediate load wheels 30 attached to the front legs 20. In one embodiment, the intermediate load wheels 30 may be disposed on the front legs 20 adjacent the front cross beam 22. Like the front load wheels 70, the intermediate load wheels 30 may comprise a sensor (not shown) which are operable to measure the distance the intermediate load wheels 30 are from a loading surface 500. The sensor may be a touch sensor, a proximity sensor, or any other suitable sensor operable to detect when the intermediate load wheels 30 are above a loading surface 500. As is explained in greater detail herein, the load wheel sensor may detect that the wheels are over the floor of the vehicle, thereby allowing the back legs 40 to safely retract. In some additional embodiments, the intermediate load wheel sensors may be in series, like the front load wheel sensors, such that both intermediate load wheels 30 must be above the loading surface 500 before the sensors indicate that the load wheels are above the loading surface 500 i.e., send a signal to the control box 50. In one embodiment, when the intermediate load wheels 30 are within a set distance of the loading surface the intermediate load wheel sensor may provide a signal which causes the control box 50 to activate the back actuator 18. Although the figures depict the intermediate load wheels 30 only on the front legs 20, it is further contemplated that intermediate load wheels 30 may also be disposed on the back legs 40 or any other position on the self-actuating cot 10 such that the intermediate load wheels 30 cooperate with the front load wheels 70 to facilitate loading and/or unloading (e.g., the support frame 12).

Referring again to FIG. 2, the self-actuating cot 10 may comprise a front actuator sensor 62 configured to detect positioning of the front actuator 16 and a back actuator sensor 64 configured to detect positioning of the back actuator 18. In some embodiments, the front actuator sensor 62 and the back actuator sensor 64 can be configured to detect the position of the front actuator 16 and the back actuator 18, respectively, with respect to a designated location of the support frame 12. For example, each of the front actuator sensor 62 and the back actuator sensor 64 can be moveably engaged with the support frame 12 and free to move between a first position, which can be relatively close to the designated location of the support frame 12, and a second position, which can be relatively distant from the designated location of the support frame 12. Each of the front actuator sensor 62 and the back actuator sensor 64 may be distance measuring sensors, string encoders, potentiometer rotary sensors, proximity sensors, reed switches, hall-effect sensors, combinations thereof or any other suitable sensor operable to detect when the front actuator 16 and/or back actuator 18 are either at and/or passed the first position and/or the second position. In further embodiments, the front actuator sensor 62 and the back actuator sensor 64 may be operable to detect the weight of a patient disposed on the self-actuating cot 10 (e.g., when strain gauges are utilized).

Referring again to the embodiment of FIG. 1, the back end 19 may comprise operator controls for the self-actuating cot 10. As used herein, the operator controls are the components used by the operator in the loading and unloading of the self-actuating cot 10 by controlling the movement of the front legs 20, the back legs 40, and the support frame 12. Referring to FIG. 2, the operator controls may comprise one or more hand controls 57 (for example, buttons on telescoping handles) disposed on the back end 19 of the self-actuating cot 10. Moreover, the operator controls may include a control box 50 disposed on the back end 19 of the self-actuating cot 10, which is used by the cot to switch from the default independent mode and the synchronized or "sync" mode. The control box 50 may comprise one or more buttons 54, 56 which place in the cot in sync mode, such that both the front legs 20 and back legs 40 can be raised and lowered simultaneously. In a specific embodiment, the sync mode may only be temporary and cot operation will return to the default mode after a period of time, for example, about 30 seconds. In a further embodiment, the sync mode may be utilized in loading and/or unloading the self-actuating cot 10. While various positions are contemplated, the control box may be disposed between the handles on the back end 19.

As an alternative to the hand control embodiment, the control box 50 may also include a component which may be used to raise and lower the self-actuating cot 10. In one embodiment, the component is a toggle switch 52, which is able to raise (+) or lower (−) the cot. Other buttons, switches, or knobs are also suitable. Due to the integration of the sensors in the self-actuating cot 10, as is explained in greater detail herein, the toggle switch 52 may be used to control the front legs 20 or back legs 40 which are operable to be raised, lowered, retracted or released depending on the position of the self-actuating cot 10. In one embodiment the toggle switch is analog (i.e., the pressure and/or displacement of the analog switch is proportional to the speed of actuation). The operator controls may comprise a visual display component 58 configured to inform an operator whether the front and back actuators 16, 18 are activated or deactivated, and thereby may be raised, lowered, retracted or released. While the operator controls are disposed at the back end 19 of the self-actuating cot 10 in the present embodiments, it is further contemplated that the operator controls be positioned at alternative positions on the support frame 12, for example, on the front end 17 or the sides of the support frame 12. In still further embodiments, the operator controls may be located in a removably attachable wireless remote control that may control the self-actuating cot 10 without physical attachment to the self-actuating cot 10.

Turning now to embodiments of the self-actuating cot 10 being simultaneously actuated, the self-actuating cot 10 of FIG. 2 is depicted as extended, thus front actuator sensor 62 and back actuator sensor 64 detect that the front actuator 16 and the back actuator 18 are at the first position such as when the front legs 20 and the back legs 40 are in contact with a lower surface and are loaded. The front and back actuators 16 and 18 are both active when the front and back actuator sensors 62, 64 detect both the front and back actuators 16, 18, respectively, are at the first position and can be raised or lowered by the operator using the operator controls (e.g., "–" to lower and "+" to raise).

Figure 3A:
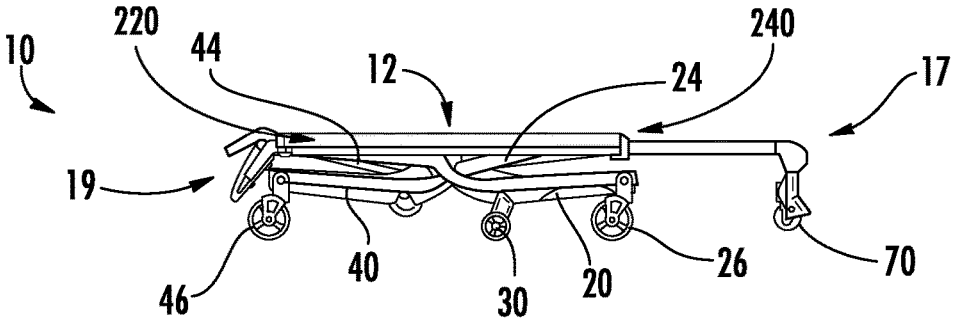
FIGS. 3A-3C is a side view depicting a raising and/or lower sequence of a cot according to one or more embodiments described herein.
Figure 3B:
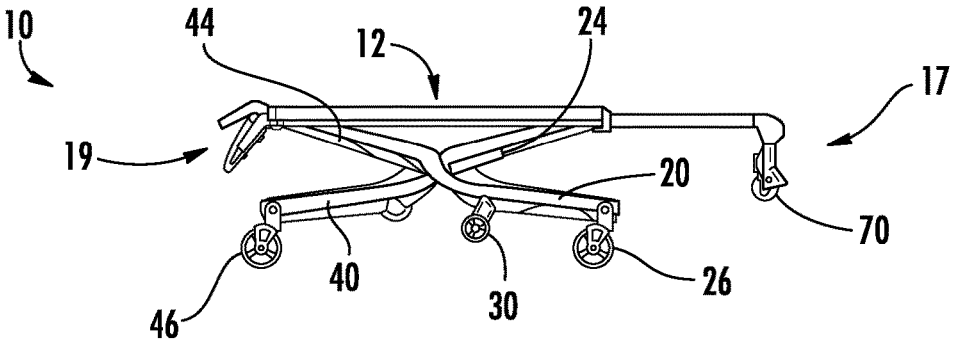
Figure 3C:
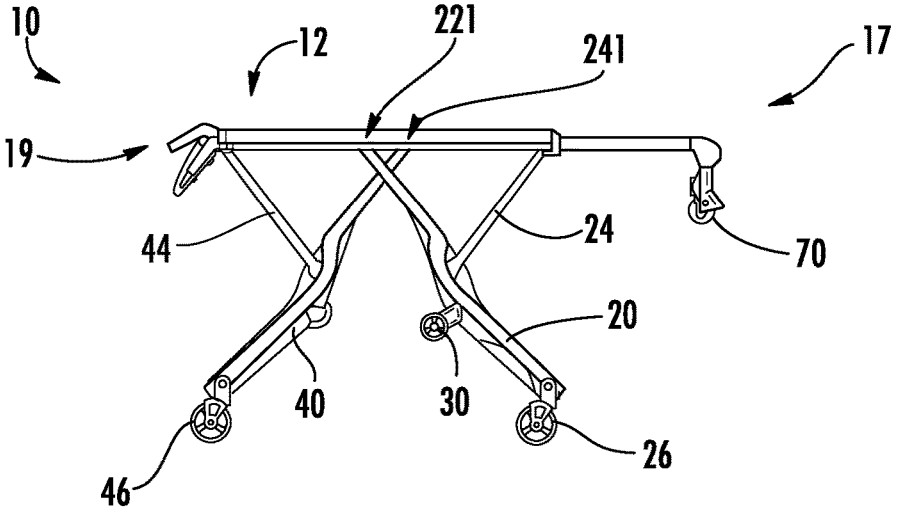

Referring collectively to FIGS. 3A-3C, an embodiment of the self-actuating cot 10 being raised (FIGS. 3A-3C) or lowered (FIGS. 3C-3A) via simultaneous actuation is schematically depicted (note that for clarity the front actuator 16 and the back actuator 18 are not depicted in FIGS. 3A-3C). In the depicted embodiment, the self-actuating cot 10 comprises a support frame 12 slidingly engaged with a pair of front legs 20 and a pair of back legs 40. Each of the front legs 20 are rotatably coupled to a front hinge member 24 that is rotatably coupled to the support frame 12. Each of the back legs 40 are rotatably coupled to a back hinge member 44 that is rotatably coupled to the support frame 12. In the depicted embodiment, the front hinge members 24 are rotatably coupled towards the front end 17 of the support frame 12 and the back hinge members 44 that are rotatably coupled to the support frame 12 towards the back end 19.

FIG. 3A depicts the self-actuating cot 10 in a lowest transport position. Specifically, the back wheels 46 and the front wheels 26 are in contact with a surface, the front leg 20 is slidingly engaged with the support frame 12 such that the front leg 20 contacts a portion of the support frame 12 towards the back end 19 and the back leg 40 is slidingly engaged with the support frame 12 such that the back leg 40 contacts a portion of the support frame 12 towards the front end 17. FIG. 3B depicts the self-actuating cot 10 in an intermediate transport position, i.e., the front legs 20 and the back legs 40 are in intermediate transport positions along the support frame 12. FIG. 3C depicts the self-actuating cot 10 in a highest transport position, i.e., the front legs 20 and the back legs 40 positioned along the support frame 12 such that the front load wheels 70 are at a maximum desired height which can be set to height sufficient to load the cot, as is described in greater detail herein.

The embodiments described herein may be utilized to lift a patient from a position below a vehicle in preparation for loading a patient into the vehicle (e.g., from the ground to above a loading surface of an ambulance). Specifically, the self-actuating cot 10 may be raised from the lowest transport position (FIG. 3A) to an intermediate transport position (FIG. 3B) or the highest transport position (FIG. 3C) by simultaneously actuating the front legs 20 and back legs 40 and causing them to slide along the support frame 12. When being raised, the actuation causes the front legs to slide towards the front end 17 and to rotate about the front hinge members 24, and the back legs 40 to slide towards the back end 19 and to rotate about the back hinge members 44. Specifically, a user may interact with a control box 50 (FIG. 2) and provide input indicative of a desire to raise the self-actuating cot 10 (e.g., by pressing "+" on toggle switch 52). The self-actuating cot 10 is raised from its current position (e.g., lowest transport position or an intermediate transport position) until it reaches the highest transport position. Upon reaching the highest transport position, the actuation may cease automatically, i.e., to raise the self-actuating cot 10 higher additional input is required. Input may be provided to the self-actuating cot 10 and/or control box 50 in any manner such as electronically, audibly or manually.

The self-actuating cot 10 may be lowered from an intermediate transport position (FIG. 3B) or the highest transport position (FIG. 3C) to the lowest transport position (FIG. 3A) by simultaneously actuating the front legs 20 and back legs 40 and causing them to slide along the support frame 12. Specifically, when being lowered, the actuation causes the front legs to slide towards the back end 19 and to rotate about the front hinge members 24, and the back legs 40 to slide towards the front end 17 and to rotate about the back hinge members 44. For example, a user may provide input indicative of a desire to lower the self-actuating cot 10 (e.g., by pressing a "–" on toggle switch 52). Upon receiving the input, the self-actuating cot 10 lowers from its current position (e.g., highest transport position or an intermediate transport position) until it reaches the lowest transport position. Once the self-actuating cot 10 reaches its lowest height (e.g., the lowest transport position) the actuation may cease automatically. In some embodiments, the control box 50 (FIG. 1) provides a visual indication that the front legs 20 and back legs 40 are active during movement.

In one embodiment, when the self-actuating cot 10 is in the highest transport position (FIG. 3C), the front legs 20 are in contact with the support frame 12 at a front-loading index 221 and the back legs 40 are in contact with the support frame 12 a back-loading index 241. While the front-loading index 221 and the back-loading index 241 are depicted in FIG. 3C as being located near the middle of the support frame 12, additional embodiments are contemplated with the front-loading index 221 and the back-loading index 241 located at any position along the support frame 12. For example, the highest transport position may be set by actuating the self-actuating cot 10 to the desired height and providing input indicative of a desire to set the highest transport position (e.g., pressing and holding the "+" and "–" on toggle switch 52 simultaneously for 10 seconds).

In another embodiment, any time the self-actuating cot 10 is raised over the highest transport position for a set period of time (e.g., 30 seconds), the control box 50 provides an indication that the self-actuating cot 10 has exceeded the highest transport position and the self-actuating cot 10 needs to be lowered. The indication may be visual, audible, electronic or combinations thereof.

When the self-actuating cot 10 is in the lowest transport position (FIG. 3A), the front legs 20 may be in contact with the support frame 12 at a front-flat index 220 located near the back end 19 of the support frame 12 and the back legs 40 may be in contact with the support frame 12 a back-flat index 240 located near the front end 17 of the support frame 12. Furthermore, it is noted that the term "index," as used herein means a position along the support frame 12 that corresponds to a mechanical stop or an electrical stop such as, for example, an obstruction in a channel formed in a lateral side member 15, a locking mechanism, or a stop controlled by a servomechanism.

The front actuator 16 is operable to raise or lower a front end 17 of the support frame 12 independently of the back actuator 18. The back actuator 18 is operable to raise or lower a back end 19 of the support frame 12 independently of the front actuator 16. By raising the front end 17 or back end 19 independently, the self-actuating cot 10 is able to maintain the support frame 12 level or substantially level when the self-actuating cot 10 is moved over uneven surfaces, for example, a staircase or hill. Specifically, if one of the front legs 20 or the back legs 40 is in the second position such as when the set of legs are not in contact with a surface (i.e., the set of legs that are unloaded) is activated by the self-actuating cot 10 (e.g., moving the self-actuating cot 10 off of a curb). Further embodiments of the self-actuating cot 10 are operable to be automatically leveled. For example, if back end 19 is lower than the front end 17, pressing the "+" on toggle switch 52 raises the back end 19 to level prior to raising the self-actuating cot 10, and pressing the "–" on toggle switch 52 lowers the front end 17 to level prior to lowering the self-actuating cot 10.

In one embodiment, depicted in FIG. 2, the self-actuating cot 10 receives a first location signal from the front actuator sensor 62 indicative of a detected position of the front actuator 16 and a second location signal from the back actuator sensor 64 indicative of a detected position of the back actuator 18. The first location signal and second location signal may be processed by logic executed by the control box 50 to determine the response of the cot 10 to input received by the cot 10. Specifically, user input may be entered into the control box 50. The user input is received as control signal indicative of a command to change a height of the self-actuating cot 10 by the control box 50. Generally, when the first location signal is indicative of the front actuator being in a first position and the second location signal is indicative of the back actuator being in a second position that is different relatively from the first position, with the first and second positions indicating distance, angles, or locations between two pre-determined relative positions, the front actuator actuates 16 the loading end legs 20 and the back actuator 18 remains substantially static (e.g., is not actuated). Therefore, when only the first location signal indicates the second position, the loading end legs 20 may be raised by pressing the "–" on toggle switch 52 and/or lowered by pressing the "+" on toggle switch 52. Generally, when the second location signal is indicative of second position and the first location signal is indicative of the first location, the back actuator 18 actuates the back legs 40 and the front actuator 16 remains substantially static (e.g., is not actuated). Therefore, when only the second location signal indicates the second position, the back legs 40 may be raised by pressing the "–" on toggle switch 52 and/or lowered by pressing the "+" on toggle switch 52. In some embodiments, the actuators may actuate relatively slowly upon initial movement (i.e., slow start) to mitigate rapid jostling of the support frame 12 prior to actuating relatively quickly.

Referring collectively to FIGS. 3C-4E, independent actuation may be utilized by the embodiments described herein for loading a patient into a vehicle (note that for clarity the front actuator 16 and the back actuator 18 are not depicted in FIGS. 3C-4E). Specifically, the self-actuating cot 10 can be loaded onto a loading surface 500 according the process described below. First, the self-actuating cot 10 may be placed into the highest transport position (FIG. 3C) or any position where the front load wheels 70 are located at a height greater than the loading surface 500. When the self-actuating cot 10 is loaded onto a loading surface 500, the self-actuating cot 10 may be raised via front and back actuators 16 and 18 to ensure the front load wheels 70 are disposed over a loading surface 500. Then, the self-actuating cot 10 may be lowered until front load wheels 70 contact the loading surface 500 (FIG. 4A).

Figure 4A:
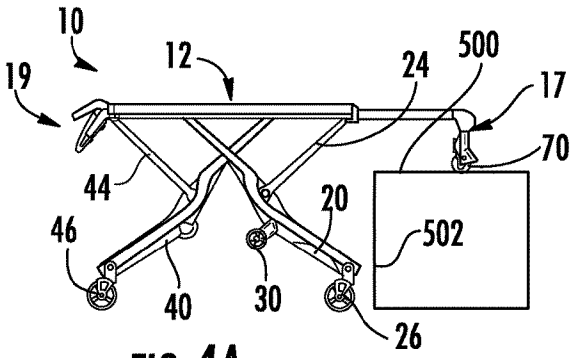
FIGS. 4A-4E is a side view depicting a loading and/or unloading sequence of a cot according to one or more embodiments described herein.
Figure 4B:
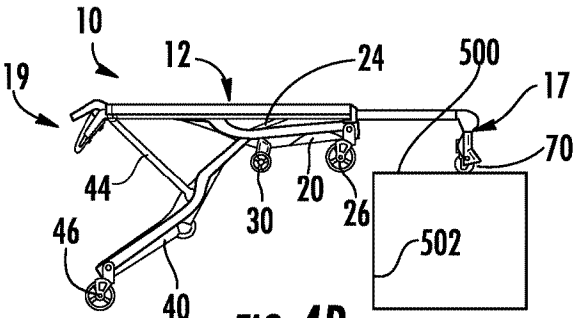

As is depicted in FIG. 4A, the front load wheels 70 are over the loading surface 500. In one embodiment, after the load wheels contact the loading surface 500 the pair of front legs 20 can be actuated with the front actuator 16 because the front end 17 is above the loading surface 500. As depicted in FIGS. 4A and 4B, the middle portion of the self-actuating cot 10 is away from the loading surface 500 (i.e., a large enough portion of the self-actuating cot 10 has not been loaded beyond the loading edge 502 such that most of the weight of the self-actuating cot 10 can be cantilevered and supported by the wheels 70, 26, and/or 30). When the front load wheels are sufficiently loaded, the self-actuating cot 10 may be held level with a reduced amount of force. Additionally, in such a position, the front actuator 16 can be at the second position and the back actuator 18 can be at the first position. Thus, for example, if the "–" on toggle switch 52 is activated, the front legs 20 are raised (FIG. 4B). In one embodiment, after the front legs 20 have been raised enough to trigger a loading state, the operation of the front actuator 16 and the back actuator 18 is dependent upon the location of the self-actuating cot. In some embodiments, upon the front legs 20 raising, a visual indication is provided on the visual display component 58 of the control box 50 (FIG. 2). The visual indication may be color-coded (e.g., activated legs in green and non-activated legs in red). This front actuator 16 may automatically cease to operate when the front legs 20 have been fully retracted. Furthermore, it is noted that during the retraction of the front legs 20, the front actuator sensor 62 may detect the second position relative to the first position, at which point, the front actuator 16 may raise the front legs 20 at a higher rate, for example, fully retract within about 2 seconds.

Figure 4C:
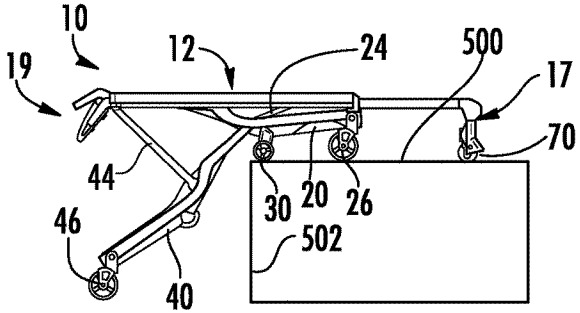

After the front legs 20 have been retracted, the self-actuating cot 10 may be urged forward until the intermediate load wheels 30 have been loaded onto the loading surface 500 (FIG. 4C). As depicted in FIG. 4C, the front end 17 and the middle portion of the self-actuating cot 10 are above the loading surface 500. As a result, the pair of back legs 40 can be retracted with the back actuator 18. Specifically, an ultrasonic sensor may be positioned to detect when the middle portion is above the loading surface 500. When the middle portion is above the loading surface 500 during a loading state (e.g., the front legs 20 and back legs 40 have an angle delta greater than the loading state angle), the back actuator may be actuated. In one embodiment, an indication may be provided by the control box 50 (FIG. 2) when the intermediate load wheels 30 are sufficiently beyond the loading edge 502 to allow for back leg 40 actuation (e.g., an audible beep may be provided).

It is noted that, the middle portion of the self-actuating cot 10 is above the loading surface 500 when any portion of the self-actuating cot 10 that may act as a fulcrum is sufficiently beyond the loading edge 502 such that the back legs 40 may be retracted a reduced amount of force is required to lift the back end 19 (e.g., less than half of the weight of the self-actuating cot 10, which may be loaded, needs to be supported at the back end 19). Furthermore, it is noted that the detection of the location of the self-actuating cot 10 may be accomplished by sensors located on the self-actuating cot 10 and/or sensors on or adjacent to the loading surface 500.

For example, an ambulance may have sensors that detect the positioning of the self-actuating cot 10 with respect to the loading surface 500 and/or loading edge 502 and communications means to transmit the information to the self-actuating cot 10.

Figure 4D:
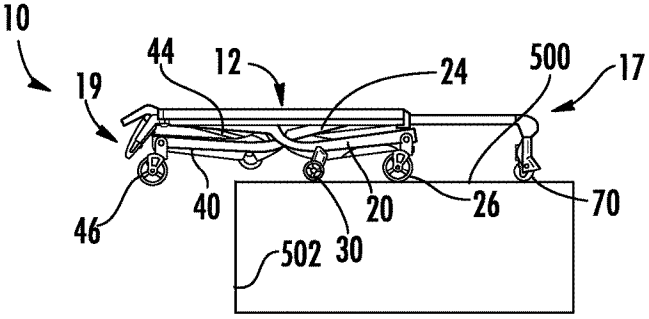

Referring to FIG. 4D, after the back legs 40 are retracted and the self-actuating cot 10 may be urged forward. In one embodiment, during the back leg retraction, the back actuator sensor 64 may detect that the back legs 40 are at the second position, at which point, the back actuator 18 may raise the back legs 40 at higher speed. Upon the back legs 40 being fully retracted, the back actuator 18 may automatically cease to operate. In one embodiment, an indication may be provided by the control box 50 (FIG. 2) when the self-actuating cot 10 is sufficiently beyond the loading edge 502 (e.g., fully loaded or loaded such that the back actuator is beyond the loading edge 502).

Once the cot is loaded onto the loading surface (FIG. 4E), the front and back actuators 16, 18 may be deactivated by being lockingly coupled to an ambulance. The ambulance and the self-actuating cot 10 may each be fitted with components suitable for coupling, for example, male-female connectors. Additionally, the self-actuating cot 10 may comprise a sensor which registers when the cot is fully disposed in the ambulance, and sends a signal which results in the locking of the actuators 16, 18. In yet another embodiment, the self-actuating cot 10 may be connected to a cot fastener, which locks the actuators 16, 18, and is further coupled to the ambulance's power system, which charges the self-actuating cot 10. A commercial example of such ambulance charging systems is the Integrated Charging System (ICS) produced by Ferno-Washington, Inc.

Figure 4E:
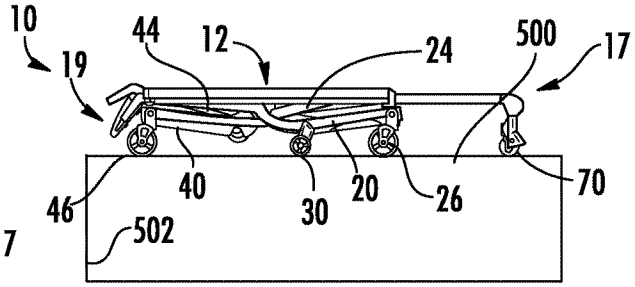

Referring collectively to FIGS. 4A-4E, independent actuation, as is described above, may be utilized by the embodiments described herein for unloading the self-actuating cot 10 from a loading surface 500. Specifically, the self-actuating cot 10 may be unlocked from the fastener and urged towards the loading edge 502 (FIG. 4E to FIG. 4D). As the back wheels 46 are released from the loading surface 500 (FIG. 4D), the back actuator sensor 64 detects that the back legs 40 are at the second position and allows the back legs 40 to be lowered. In some embodiments, the back legs 40 may be prevented from lowering, for example if sensors detect that the cot is not in the correct location (e.g., the back wheels 46 are above the loading surface 500 or the intermediate load wheels 30 are away from the loading edge 502). In one embodiment, an indication may be provided by the control box 50 (FIG. 2) when the back actuator 18 is activated (e.g., the intermediate load wheels 30 are near the loading edge 502 and/or the back actuator sensor 64 detects tension).

When the self-actuating cot 10 is properly positioned with respect to the loading edge 502, the back legs 40 can be extended (FIG. 4C). In some embodiments, when the back actuator sensor 64 detects the second position, the back legs 40 can be extended relatively quickly by opening the logical valve 352 to activate the regeneration fluid path 350 (FIGS. 12A-12D). For example, the back legs 40 may be extended by pressing the "+" on toggle switch 52. In one embodiment, upon the back legs 40 lowering, a visual indication is provided on the visual display component 58 of the control box 50 (FIG. 2). For example, a visual indication may be provided when the self-actuating cot 10 is in a loading state and the back legs 40 and/or front legs 20 are actuated. Such a visual indication may signal that the self-actuating cot should not be moved (e.g., pulled, pushed, or rolled) during the actuation. When the back legs 40 contact the floor (FIG. 4C), the back actuator sensor 64 can detect the first position and deactivate the back actuator 18.

When a sensor detects that the front legs 20 are clear of the loading surface 500 (FIG. 4B), the front actuator 16 is activated. In some embodiments, when the front actuator sensor 62 detects the second position, the front legs 20 can be extended relatively quickly by opening the logical valve 352 to activate the regeneration fluid path 350 (FIGS. 12A-12D). In one embodiment, when the intermediate load wheels 30 are at the loading edge 502 an indication may be provided by the control box 50 (FIG. 2). The front legs 20 are extended until the front legs 20 contact the floor (FIG. 4A). For example, the front legs 20 may be extended by pressing the "+" on toggle switch 52. In one embodiment, upon the front legs 20 lowering, a visual indication is provided on the visual display component 58 of the control box 50 (FIG. 2).

Referring again to FIG. 6, the cot 10 is provided with a pair of front loading wheels 70 projecting downwardly from the outermost ends of side frame sections. Also projecting downwardly from the outermost ends of the side frame sections is a front-side bail 72. In the depicted embodiment, the front-side bail 72 is a generally U-shaped tubular member. The front-side bail 72 is spring biased into the generally downward-extending position depicted in FIG. 6. In this position, the front-side bail 72 is configured to engage a tongue-like floor fitting that is mounted on the floor of the emergency vehicle when the front-side bail 72 translates in a direction corresponding to removing the cot 10 from the emergency vehicle. The front-side bail 72 is adapted to deflect away from the floor fitting when translating in a direction corresponding to loading the cot 10 into the emergency vehicle, thereby allowing the cot 10 to be loaded into the cot 10 without requiring the attendant to manually release the front-side bail 72.

The front-side bail 72 limits translation of the cot 10 along the floor of the emergency vehicle, thereby selectively preventing the cot 10 from being unloaded from the emergency vehicle. The front-side bail 72, therefore, may prevent undesired removal of the cot 10 from the emergency vehicle. The front-side bail 72 may also be deflected upwardly by a release arm 74 that is positioned adjacent to both sides of the cot 10. The release arm 74 permits the attendant to release the front-side bail 72 from engagement with the floor fitting of the emergency vehicle when the attendant desires to unload the cot from the emergency vehicle.

Still referring to FIG. 6, the cot 10 may also be provided with an intermediate bail 76 that protects downwardly from one of the front legs 20 or the rear legs 40. The intermediate bail 76 is positioned between the front wheels 26 and the rear wheels 46, evaluated when the legs 20, 40 of the cot 10 are in a fully-retracted position. In the depicted embodiment, the intermediate bail 76 is a generally U-shaped tubular member. Similar to the front-side bail 72, the intermediate bail 76 is also spring biased into the generally downward-extending position depicted in FIG. 6. In this position, the intermediate bail 76 is configured to engage a tongue-like floor fitting that is mounted on the floor of the emergency vehicle. In this position, the intermediate bail 76 is configured to engage a tongue-like floor fitting that is mounted on the floor of the emergency vehicle when the intermediate bail 76 translates in a direction corresponding to removing the cot 10 from the emergency vehicle. The intermediate bail 76 is adapted to deflect away from the floor fitting when translating in a direction corresponding to loading the cot 10 into the emergency vehicle, thereby allowing the cot 10 to be loaded into the cot 10 without requiring the attendant to manually release the intermediate bail 76.

The intermediate bail 76 limits translation of the cot 10 along the floor of the emergency vehicle, thereby selectively preventing the cot 10 from being further deployed from the emergency vehicle. Because of the position of the intermediate bail 76 at a location between the front wheels 26 and the rear wheels 46, the intermediate bail 76 may limit translation of the cot 10. In some embodiments, the intermediate bail 76 may limit translation of the cot 10 such that the center of gravity of the cot 10, with and/or without a patient positioned on the cot 10, remains positioned inside the emergency vehicle. The cot 10, therefore, may remain in stable engagement with the floor of the emergency vehicle without further application of force by the attendant. Accordingly, the intermediate bail 76 may prevent undesired instability of the cot 10 while the cot 10 is being loaded and unloaded from the emergency vehicle.

The intermediate bail 76 may also be deflected upwardly by a release arm 78 that is positioned adjacent to both sides of the cot 10. The release arm 78 permits the attendant to release the intermediate bail 76 from engagement with the floor fitting of the emergency vehicle when the attendant desires to translate the cot in a direction corresponding to unloading the cot 10 from the emergency vehicle.

Figure 23:
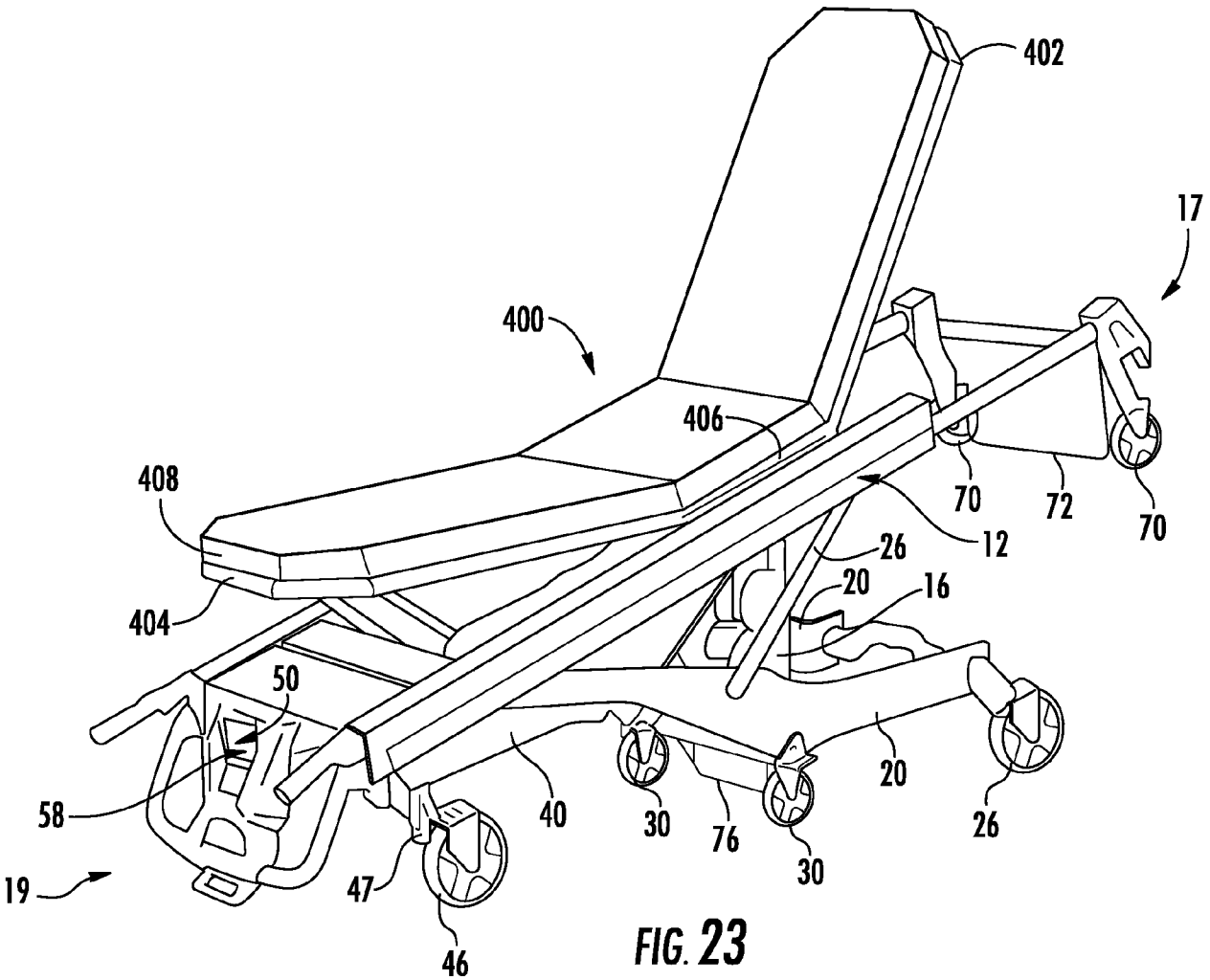
FIG. 23 schematically depicts a perspective view of a self-actuating cot in a seated loading position according to one or more embodiments described herein.
Figure 24:
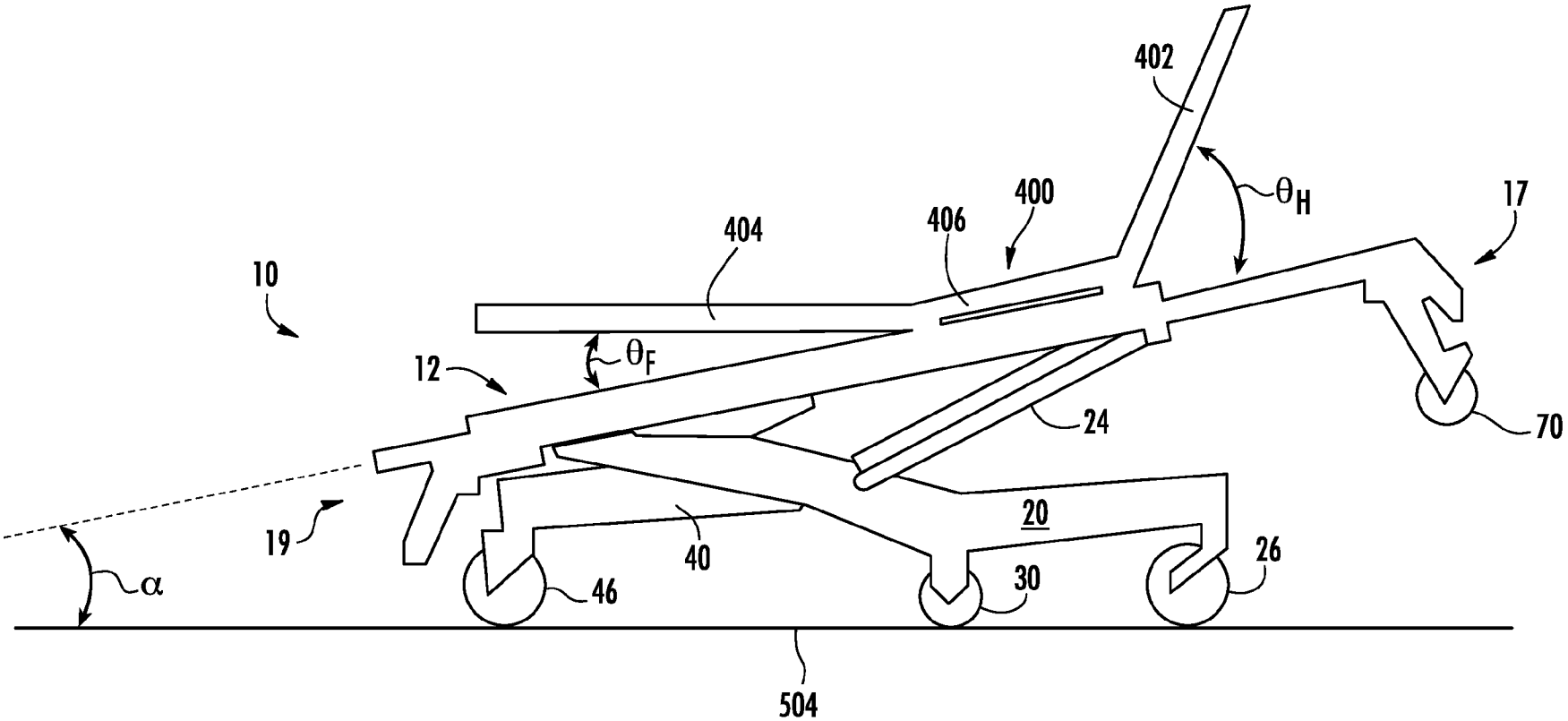
FIG. 24 schematically depicts a side view of a self-actuating cot in a seated loading position according to one or more embodiments described herein.

Referring collectively to FIGS. 23 and 24, embodiments of the self-actuating cot 10 can comprise a patient support member 400 for supporting patients upon the self-actuating cot 10. In some embodiments, the patient support member 400 can be coupled to the support frame 12 of the self-actuating cot 10. The patient support member 400 can comprise a head supporting portion 402 for supporting the back and head and neck regions of a patient, and a foot supporting portion 404 for supporting lower limb region of a patient. The patient support member 400 can further comprise a middle portion 406 located between the head supporting portion 402 and the foot supporting portion 404. Optionally, the patient support member 400 can comprise a support pad 408 for providing cushioning for patient comfort. The support pad 408 can include an outer layer formed from material that is non-reactive to biological fluids and materials.

Referring now to FIG. 24, the patient support member 400 can be operable to articulate with respect to the support frame 12 of the self-actuating cot 10. For example, the head supporting portion 402, the foot supporting portion 404, or both can be rotated with respect to the support frame 12. The head supporting portion 402 can be adjusted to elevate the torso of a patient with respect to a flat position, i.e., substantially parallel with the support frame 12. Specifically, a head offset angle $\Theta_H$ can be defined between the support frame 12 and the head supporting portion 402. The head offset angle $\Theta_H$ can increase as the head supporting portion 402 is rotated away from the support frame 12. In some embodiments, the head offset angle $\Theta_H$ can be limited to a maximum angle that is substantially acute such as, for example, about 85° in one embodiment, or about 76° in another embodiment. The foot supporting portion 404 can be adjusted to elevate the lower limb region of a patient with respect to a flat position, i.e., substantially parallel with the support frame 12. A foot offset angle $\Theta_F$ can be defined between the support frame 12 and the foot supporting portion 404. The foot offset angle $\Theta_F$ can increase as the foot supporting portion 404 is rotated away from the support frame 12. In some embodiments, the foot offset angle $\Theta_F$ can be limited to a maximum angle that is substantially acute such as, for example, about 35° in one embodiment, about 25° in another embodiment, or about 16° in a further embodiment.

Referring collectively to FIGS. 1 and 24, the self-actuating cot 10 can be configured to automatically actuate to a seated loading position. Specifically, the front actuator 16 can actuate the front legs 20, the back actuator 18 can actuate the back legs 40, or both the front actuator 16 and the back actuator 18 can actuate to lower the back end 19 of the self-articulating cot 10 with respect to the front end 17 of the self-articulating cot 10. When the back end 19 of the self-articulating cot 10 is lowered, a seated loading angle $\alpha$ can be formed between the support frame 12 and a substantially level surface 504. In some embodiments, the seated loading angle $\alpha$ can be limited to a maximum angle that is substantially acute such as, for example, about 35° in one embodiment, about 25° in another embodiment, or about 16° in a further embodiment. In some embodiments, the seated loading angle $\alpha$ can be substantially the same as the foot offset angle $\Theta_F$ such that the foot supporting portion 404 of the patient support member 400 is substantially parallel to the level surface 504.

Referring again to FIGS. 23 and 24, the head supporting portion 402 and the foot supporting portion 404 of the patient support member 400 can be raised away from the support frame 12 prior to automatically actuating the self-actuating cot 10 to the seated loading position. Additionally, the front wheels 26 and the back wheels 46 can be oriented in a substantially similar direction. Once aligned, the front wheels 26 and the back wheels 46 can be locked in place. In some embodiments, the self-actuating cot 10 can comprise an input configured to receive a command to actuate the cot to the seated loading position. For example, the visual display component 58 can include a touch screen input for receiving tactile input. Alternatively or additionally, various other buttons, or audio inputs can be configured to receive the command to actuate the self-actuating cot 10 to the seated loading position.

Once the control box 50 receives the command, the self-actuating cot 10 can be set into a seated loading position mode. In some embodiments, the self-actuating cot 10 can automatically actuate to the seated loading position upon entering the seated loading position mode without additional input. Alternatively, the self-actuating cot 10 can require additional input prior to transitioning to the seated loading position. For example, the back end 19 of the self-articulating cot 10 can be lowered by pressing the "–" on toggle switch 52 (FIG. 2), while in the seated loading position mode. In further embodiments, a time limit can be applied to the seated loading position mode to limit the total time the mode remains active. Accordingly, the seated loading position mode can automatically be deactivated upon an expiration of the time limit such as, for example, about 60 seconds in one embodiment, about 30 seconds in another embodiment, or about 15 seconds in further embodiment. In still further embodiments, upon entering the seated loading position mode, a confirmation that indicates that the self-actuating cot 10 is in the seated loading position mode can be provided such as, for example, an audible indication or a visual indication upon the visual display component 58.

It should now be understood that the embodiments described herein may be utilized to transport patients of various sizes by coupling a support surface such as a patient support surface to the support frame. For example, a lift-off stretcher or an incubator may be removably coupled to the support frame. Therefore, the embodiments described herein may be utilized to load and transport patients ranging from infants to bariatric patients. Furthermore the embodiments described herein, may be loaded onto and/or unloaded from an ambulance by an operator holding a single button to actuate the independently articulating legs (e.g., pressing the "–" on the toggle switch to load the cot onto an ambulance or pressing the "+" on the toggle switch to unload the cot from an ambulance). Specifically, the self-actuating cot 10 may receive an input signal such as from the operator controls. The input signal may be indicative a first direction or a second direction (lower or raise). The pair of front legs and the pair of back legs may be lowered independently when the signal is indicative of the first direction or may be raised independently when the signal is indicative of the second direction.

It is further noted that terms like "preferably," "generally," "commonly," and "typically" are not utilized herein to limit the scope of the claimed embodiments or to imply that certain features are critical, essential, or even important to the structure or function of the claimed embodiments. Rather, these terms are merely intended to highlight alternative or additional features that may or may not be utilized in a particular embodiment of the present disclosure.

For the purposes of describing and defining the present disclosure it is additionally noted that the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

Having provided reference to specific embodiments, it will be apparent that modifications and variations are possible without departing from the scope of the present disclosure defined in the appended claims. More specifically, although some aspects of the present disclosure are identified herein as preferred or particularly advantageous, it is contemplated that the present disclosure is not necessarily limited to these preferred aspects of any specific embodiment.

What is claimed is:

1. A self-actuating cot comprising a support frame, a pair of legs, and a hydraulic actuator, wherein:

the support frame extends from a front end to a back end;

the pair of legs is in movable engagement with the support frame;

the hydraulic actuator is in movable engagement with the pair of legs and the support frame, and extends and retracts the pair of legs with respect to the support frame;

the hydraulic actuator comprises a cylinder housing, a rod, and a sliding guide member;

the cylinder housing defines a hydraulic cylinder aligned with a motive direction of the rod;

the sliding guide member is in sliding engagement with the cylinder housing, and is in rigid engagement with the rod; and the sliding guide member slides along a sliding direction with respect to the cylinder housing as the rod extends and retracts from the cylinder housing along the motive direction.

2. The self-actuating cot of claim 1, wherein the sliding guide member comprises a rod side that faces the rod and an outer side that is opposite the rod side, and wherein the rod side is substantially straight and the outer side comprises an arcuate portion.

3. The self-actuating cot of claim 1, wherein:

the hydraulic actuator comprises a second rod and a second sliding guide member; and the second sliding guide member is in sliding engagement with the cylinder housing, and is in rigid engagement with the second rod.

4. The self-actuating cot of claim 3, wherein the hydraulic actuator is configured to operate in a self-balancing manner that allows the rod and the second rod to extend and retract at different rates.

5. The self-actuating cot of claim 3, wherein the sliding guide member travels along an upper course and the second sliding guide member travels along a lower course.

6. The self-actuating cot of claim 5, wherein the upper course and the lower course are offset.

7. The self-actuating cot of claim 5, wherein the upper course and the lower course are substantially parallel.

8. The self-actuating cot of claim 5, wherein the rod is substantially aligned with the lower course and the second rod is substantially aligned with the upper course.

9. A self-actuating cot comprising:

a support frame comprising a front end, and a back end;

a pair of front legs slidingly coupled to the support frame and having front wheels and intermediate loading wheels;

a pair of back legs slidingly coupled to the support frame and having back wheels; and a cot actuation system comprising a front actuator that moves the front legs and a back actuator that moves the back legs, wherein the cot actuation system is configured to automatically actuate to a seated loading position such that the support frame forms a seated loading angle between the support frame and a substantially level surface when the front wheels, the intermediate loading wheels, and back wheels are all in contact with the substantially level surface, and wherein the seated loading angle is acute and the intermediate loading wheels are located on the front legs in order to be situated between the front and back wheels when in contact with the substantially level surface; and at least one of the actuators comprise a cylinder housing, a rod, and a sliding guide member, wherein the at least one actuator comprises a transverse support platen coupled to the rod and the sliding guide member.

10. The self-actuating cot of claim 9, comprising a patient support member coupled to the support frame and operable to articulate with respect to the support frame, wherein the patient support member comprises a foot supporting portion that rotates away from the support frame and defines a foot offset angle with respect to the support frame.

11. The self-actuating cot of claim 10, wherein the foot offset angle is limited to a maximum angle that is acute.

12. The self-actuating cot of claim 11, wherein the seated loading angle is about equal to the foot offset angle.

13. The self-actuating cot of claim 10, wherein the patient support member comprises a head supporting portion that rotates away from the support frame and defines a head offset angle with respect to the support frame.

14. A self-actuating cot comprising:

a support frame comprising a front end, and a back end;

a pair of front legs slidingly coupled to the support frame;

a pair of back legs slidingly coupled to the support frame;

a front actuator in movable engagement with the front legs and the support frame, and extends and retracts the front legs with respect to the support frame;

a back actuator in movable engagement with the back legs and the support frame, and extends and retracts the back legs with respect to the support frame;

the front actuator and the back actuator each comprise a respective cylinder housing, a respective rod, and a respective sliding guide member;

each cylinder housing defines a respective hydraulic cylinder aligned with a motive direction of the respective rod;

each sliding guide member is in sliding engagement with the respective cylinder housing, and is in rigid engagement with the respective rod;

each sliding guide member slides along a sliding direction with respect to the respective cylinder housing as the respective rod extends and retracts from the respective cylinder housing along the motive direction; and a cot actuation system comprising the front actuator that moves the front legs and the back actuator that moves the back legs, and a centralized hydraulic circuit configured to direct hydraulic fluid to the front actuator and the back actuator.

15. The self-actuating cot of claim 14, wherein the front actuator and the back actuator are supplied with the hydraulic fluid from a single fluid reservoir.

16. The self-actuating cot of claim 14, wherein the cot actuation system comprises a single pump motor configured to actuate both the front actuator and the back actuator with the hydraulic fluid.

17. The self-actuating cot of claim 14, wherein the cot actuation system comprises a flow control valve or an electronic switching valve in fluidic communication with the front actuator and the back actuator.

18. A self-actuating cot comprising a support frame, a pair of legs, and a hydraulic actuator, wherein:

the support frame extends from a front end to a back end;

the pair of legs is in movable engagement with the support frame;

the hydraulic actuator is in movable engagement with the pair of legs and the support frame, and extends and retracts the pair of legs with respect to the support frame;

the hydraulic actuator comprises a cylinder housing, a rod, and a sliding guide member;

the cylinder housing defines a hydraulic cylinder aligned with a motive direction of the rod;

the sliding guide member is in sliding engagement with the cylinder housing, and is in rigid engagement with the rod; and the sliding guide member slides along a sliding direction with respect to the cylinder housing as the rod extends and retracts from the cylinder housing along the motive direction, wherein the hydraulic actuator comprises a transverse support platen coupled to the rod and the sliding guide member.

19. The self-actuating cot of claim 18, comprising a second sliding guide member that is in sliding engagement with the cylinder housing and is coupled to the transverse support platen, wherein the rod is coupled to the transverse support platen between the rod and the second sliding guide member.

20. The self-actuating cot of claim 18, wherein the transverse support platen of the hydraulic actuator is in movable engagement with the pair of legs, the support frame, or the pair of legs and the support frame.

* * * * *